US006468729B2

(12) United States Patent
Shimura et al.

(10) Patent No.: US 6,468,729 B2
(45) Date of Patent: Oct. 22, 2002

(54) SILVER HALIDE PHOTOGRAPHIC LIGHT-SENSITIVE MATERIAL

(75) Inventors: Yoshio Shimura; Hiroshi Fukuzawa; Hisashi Mikoshiba, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/799,587

(22) Filed: Mar. 7, 2001

(65) Prior Publication Data

US 2001/0031433 A1 Oct. 18, 2001

(30) Foreign Application Priority Data

Mar. 7, 2000 (JP) ..... 2000-062749

(51) Int. Cl.[7] ..... G03C 1/08; G03C 7/26; G03C 7/32

(52) U.S. Cl. ..... 430/558; 430/543

(58) Field of Search ..... 430/543, 558

(56) References Cited

U.S. PATENT DOCUMENTS

| | | | | |
|---|---|---|---|---|
| 4,835,094 A | | 5/1989 | Wolff et al. | |
| 5,272,049 A | | 12/1993 | Sakanoue et al. | |
| 5,656,418 A | * | 8/1997 | Nakamine et al. | 430/558 |
| 5,792,599 A | | 8/1998 | Taguchi | |
| 5,858,635 A | * | 1/1999 | Nakamine et al. | 430/558 |
| 6,074,810 A | * | 6/2000 | Kawagishi et al. | 430/558 |
| 6,159,671 A | * | 12/2000 | Matsuda | 430/558 |

FOREIGN PATENT DOCUMENTS

| | | |
|---|---|---|
| EP | 0512304 A1 | 11/1992 |
| EP | 1 033 621 A1 | 9/2000 |
| JP | 63-103245 | 5/1988 |
| JP | 5-204106 | 8/1993 |
| JP | 9-281675 | 10/1997 |

* cited by examiner

*Primary Examiner*—Geraldine Letscher
(74) *Attorney, Agent, or Firm*—Birch, Stewart, Kolasch & Birch, LLP

(57) ABSTRACT

Disclosed is a silver halide color photographic light-sensitive material comprising at least one silver halide emulsion layer on a support, said at least one emulsion layer containing a magenta coupler represented by formula (M-1):

(M-1)

where $R_1$ represents a substituted or unsubstituted alkyl group, each of $L_1$ and $L_2$ independently represents a substituted or unsubstituted alkylene group, or a substituted or unsubstituted arylene group, and A represents a substituted or unsubstituted aryl group, or a substituted or unsubstituted alkyl group, with the proviso that A is neither a 2-octyloxy-5-tert-octylphenyl group nor a 2-(4-methylphenoxy)ethoxy-5-tert-octylphenyl group.

8 Claims, No Drawings

SILVER HALIDE PHOTOGRAPHIC LIGHT-SENSITIVE MATERIAL

CROSS-REFERENCE TO RELATED APPLICATIONS

This application is based upon and claims the benefit of priority from the prior Japanese Patent Application No. 2000-062749, filed Mar. 7, 2000, the entire contents of which are incorporated herein by reference.

BACKGROUND OF THE INVENTION

The present invention relates to a novel color coupler compound and, more particularly, to a silver halide color photographic light-sensitive material using the compound and an image formation method using the material. More specifically, the present invention relates to a silver halide color reversal photographic light-sensitive material and an image formation method using the material.

Recently, silver halide color photographic light-sensitive materials are strongly required to have faithful color reproducibility in addition to high sensitivity, high sharpness, and high graininess.

In the field of silver halide color photographic light-sensitive materials, a 1-phenyl-5-pyrazolone coupler has been conventionally widely used as a magenta coupler. On the other hand, compounds having little side absorption and good hue which are preferred as image forming dyes are being sought recently, and some pyrazoloazole-based couplers having little side absorption near 430 nm have been put into practical use.

Pyrazolotriazole magenta couplers are excellent compounds in that they have good hue. However, when introduced into light-sensitive materials, they pose various problems such as a low color generation efficiency, low resistance against processing variations, and low color image storage stability.

For example, a 4-equivalent coupler which couples with the oxidized form of an aromatic primary amine developing agent in the position of hydrogen atom substitution has a low color generation efficiency, although it has high graininess, and hence causes yellow stains by aging after development. On the other hand, a 2-equivalent coupler whose coupling position is substituted by a split-off group (e.g., a halogen atom) except for a hydrogen atom generates a color with a smaller silver amount than a 4-equivalent coupler. Although this 2-equivalent coupler does not easily cause yellow stains, it unfortunately lowers the graininess and degrades the image quality.

Many such photographic couplers are used as they are dispersed in high-boiling organic solvents such as phosphoric ester and phthalic ester. However, with the recent demand for high sharpness, a reduction of the use amount of these high-boiling organic solvents, i.e., so-called oilless processing is being sought. Unfortunately, many conventional couplers including pyrazolotriazole magenta couplers significantly lower the color generation efficiency when used in oilless processing.

To solve these problems, couplers in which substituents on pyrazoloazole rings are variously improved have been proposed. For example, U.S. Pat. No. 4,882,266 and European Patent Publication No. 183,445 have disclosed improvements of the light fastness of a color image by couplers in which the bulkiness of a 6-position substituent is increased. Jpn. Pat. Appln. KOKAI Publication No. (hereinafter referred to as JP-A-)1-102557 has disclosed improvements of the color generation efficiency in oilless processing by couplers in which carboxylic acid is introduced as a dissociation group into coupler molecules. Unfortunately, when the present inventors attempted to apply these techniques, improvements of yellow stains and color image storage stability by these techniques during aging after processing were still unsatisfactory. Although the color generation efficiency was increased by the introduction of a dissociation group, the couplers increased the cost and deteriorated the crystallinity and hence cannot be used in industrial applications. Also, yellow stains were formed when non-color-forming portions were irradiated with light or in a high-humidity, high-temperature ambient. Furthermore, the sensitivity decreased when the couplers were retained before coating after they were mixed in color-sensitized silver halide emulsions.

Most pyrazoloazole-based couplers currently put into practical use are 2-equivalent couplers having a split-off group except for a hydrogen atom in a portion where these couplers react with the oxidized form of a color developing agent. Color reversal photographic light-sensitive materials are subjected to first development, reversal processing, and color development in this order. 2-equivalent couplers have an essential problem that since they have a high color generation efficiency per mol of silver, they decrease the sensitivity during the course of development compared to 4-equivalent couplers. Therefore, when pyrazoloazole magenta couplers are to be applied to color reversal photographic light-sensitive materials, 4-equivalent couplers are preferred in respect of sensitivity. Applications of 4-equivalent pyrazoloazole magenta couplers to color reversal photographic light-sensitive materials are described in, e.g., JP-A's-5-100382 and 63-153548. However, these techniques have not solved the above-mentioned problem of yellow stains caused by aging after processing.

BRIEF SUMMARY OF THE INVENTION

It is the first object of the present invention to provide a silver halide color photographic light-sensitive material which has high color reproducibility, high fastness, and high image stability, and produces stains little. It is the second object of the present invention to provide a coupler which achieves a high color generation efficiency even when the use amount of a high-boiling organic solvent is reduced, i.e., even in oilless processing. It is the third object of the present invention to provide a novel pyrazolotriazole-based compound which can be produced at low cost and has high producing suitability.

The present inventors made extensive studies to seek a coupler which has high image storage stability, improves sensitivity decrease occurring when mixed with a silver halide emulsion, and has a high color generation efficiency even in oilless processing, and have completed the present invention.

That is, the objects of the present invention are achieved by the following arrangements.

(1) A silver halide color photographic light-sensitive material comprising at least one silver halide emulsion layer on a support, the at least one emulsion layer containing a magenta coupler represented by formula (M-1):

(M-1)

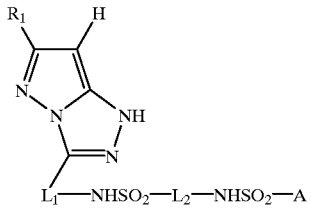

where $R_1$ represents a substituted or unsubstituted alkyl group, each of $L_1$ and $L_2$ independently represents a substituted or unsubstituted alkylene group, or a substituted or unsubstituted arylene group, and A represents a substituted or unsubstituted aryl group, or a substituted or unsubstituted alkyl group, with the proviso that A is neither a 2-octyloxy-5-tert-octylphenyl group nor a 2-(4-methylphenoxy)ethoxy-5-tert-octylphenyl group.

(2) The silver halide color photographic light-sensitive material according to item (1), wherein the magenta coupler is represented by formula (M-2):

(M-2)

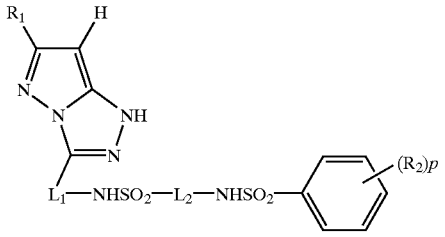

where $R_1$, $L_1$, and $L_2$ have the same meanings as in formula (M-1) of item (1), $R_2$ represents a halogen atom, nitro group, cyano group, —$COR_3$, —$COOR_3$, —$CON(R_4)R_3$, —$N(R_4)COOR_3$, —$N(R_4)CO\ N(R_5)R_3$, —$CON(R_4)SO_2R_3$, or —$N(R_4)COR_3$, p is an integer from 1 to 5, wherein a plurality of $R_2$'s may be the same or different if p is not less than 2, and each of $R_3$, $R_4$, and $R_5$ independently represents a hydrogen atom, a substituted or unsubstituted alkyl group, or a substituted or unsubstituted aryl group, $R_3$ and $R_4$ may be combined to form a ring, and the value of pKa at 25° C. of —$NHSO_2$— which bonds to $L_2$ and the phenyl group in a magenta coupler represented by formula (M-2) is not more than 12 in a solution of THF/$H_2O$=6/4.

(3) The silver halide color photographic light-sensitive material according to item (2), wherein the magenta coupler is represented by formula (M-5):

(M-5)

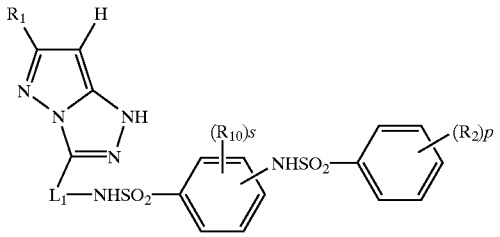

where $R_2$ and p have the same meanings as in formula (M-2) of item (2), $R_1$ represents a secondary or tertiary unsubstituted alkyl group having 1 to 8 carbon atoms, $R_{10}$ represents a substituent, s is an integer from 0 to 3, wherein a plurality of $R_{10}$'s may be the same or different if s is not less than 2, and $L_1$ represents a substituted or unsubstituted alkylene group represented by formula (M-5a) or a substituted or unsubstituted arylene group represented by formula (M-5b).

(M-5a)

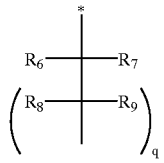

where each of $R_6$, $R_7$, $R_8$, and $R_9$ independently represents a hydrogen atom, a halogen atom, a substituted or unsubstituted alkyl group, or a substituted or unsubstituted aryl group, q is an integer from 0 to 3, wherein a plurality of $R_8$'s and $R_9$'s may be the same or different if q is not less than 2, two of $R_6$, $R_7$, $R_8$, and $R_9$ may be combined to form a ring, and * indicates the position where this alkylene group bonds to the pyrazoloazole ring.

(M-5b)

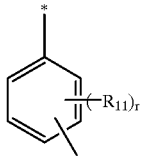

where $R_{11}$ represents a hydrogen atom, a halogen atom, a substituted or unsubstituted alkyl group, a substituted or unsubstituted aryl group, a substituted or unsubstituted alkoxy group, or a substituted or unsubstituted aryloxy group, r represents an integer from 1 to 4, wherein a plurality of $R_{11}$'s may be the same or different if r is not less than 2, and * indicates the position where this arylene group bonds to the pyrazoloazole ring.

(4) The silver halide color photographic light-sensitive material according to item (3), wherein the magenta coupler is represented by formula (M-7):

(M-7)

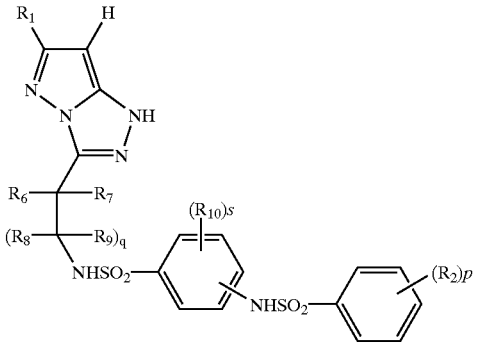

Where $R_1$ represents a secondary or tertiary unsubstituted alkyl group having 3 to 8 carbon atoms, $R_2$ represents a halogen atom (chlorine or bromine), a cyano group, —$COR_3$, —$COOR_3$, or —$CON(R_4)R_3$, each of $R_3$ and $R_4$ independently represents a hydrogen atom, a substituted or unsubstituted alkyl group, or a substituted or unsubstituted aryl group, $R_3$ and $R_4$ may be combined to form a ring, p is 2 or 3, each of $R_6$, $R_7$, $R_8$, and $R_9$ independently represents a hydrogen atom, or an alkyl group having 1 to 4 carbon atoms, wherein at least one of $R_6$ and $R_7$ represents a methyl group, an ethyl group, or an isopropyl group, q is 0 or 1, $R_{10}$ represents a halogen atom, a substituted or unsubstituted alkyl group having 1 to 25 carbon atoms in the alkyl moiety, a substituted or unsubstituted alkoxy group having 1 to 25 carbon atoms in the alkoxy moiety, or a substituted or unsubstituted aryloxy group having 6 to 30 carbon atoms in the aryloxy moiety, and s is 0, 1, or 2.

(5) The silver halide color photographic light-sensitive material according to item (4), wherein the magenta coupler is represented by formula (M-8):

(M-8)

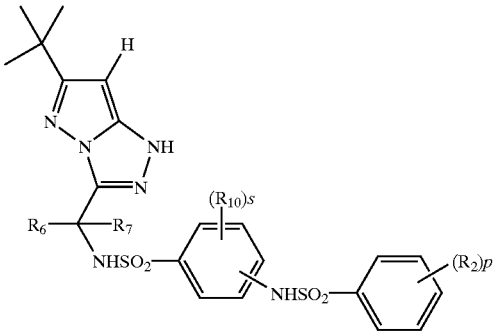

where $R_2$ represents a halogen atom (chlorine or bromine), a cyano group, —$COR_3$, —$COOR_3$, or —$CON(R_4)R_3$, $R_3$ represents a substituted or unsubstituted alkyl group having 1 to 25 carbon atoms in the alkyl moiety, or a substituted or unsubstituted aryl group having 6 to 30 carbon atoms in the aryl moiety, $R_4$ represents a hydrogen atom, a substituted or unsubstituted alkyl group having 1 to 25 carbon atoms in the alkyl moiety, or a substituted or unsubstituted aryl group having 6 to 30 carbon atoms in the aryl moiety, $R_3$ and $R_4$ may be combined to form a ring, p, $R_6$, $R_7$, $R_{10}$ and s have the same meanings as in formula (M-7) of item (4).

(6) The silver halide color photographic light-sensitive material according to item (5), wherein $R_3$ in formula (M-8) represents an unsubstituted cycloalkyl group having 5 to 7 carbon atoms, and $R_{10}$ in formula (M-8) represents a halogen atom, an unsubstituted alkoxy group having 10 to 22 carbon atoms, or an unsubstituted aryloxy group having 10 to 14 carbon atoms.

(7) A silver halide color photographic light-sensitive material comprising at least one silver halide emulsion layer on a support, the at least one emulsion layer containing a magenta coupler represented by formula (M-3):

(M-3)

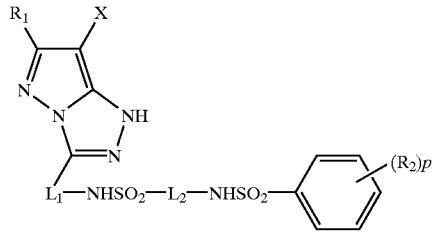

Where $R_1$, $L_1$, $L_2$, $R_2$, and p have the same meanings as in formula (M-2) of item (2), and X represents a group or an atom which splits off during a coupling reaction with an oxidized form of a developing agent, and the value of pKa at 25° C. of —$NHSO_2$— which bonds to $L_2$ and the phenyl group in a magenta coupler represented by formula (M-3) is not more than 12 in a solution of $THF/H_2O$=¾.

(8) The silver halide color photographic light-sensitive material according to item (7), wherein the magenta coupler is represented by formula (M-6):

(M-6)

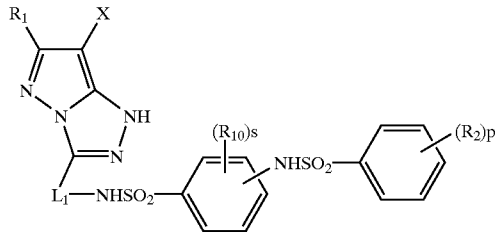

where $R_1$, $L_1$, $R_2$, p and X have the same meanings as in formula (M-3) of item (7), $R_{10}$ represents a halogen atom or a substituent, and s is an integer from 0 to 3, wherein a plurality of $R_{10}$'s may be the same or different if s is not less than 2.

(9) The silver halide color photographic light-sensitive material according to item (8), wherein the magenta coupler is represented by formula (M-9):

(M-9)

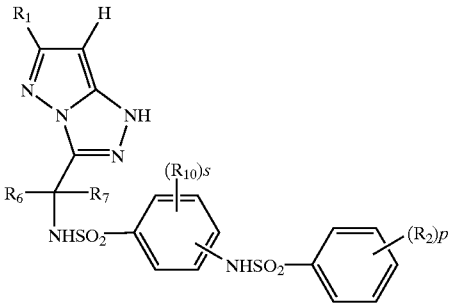

where $R_1$ represents a secondary or tertiary unsubstituted alkyl group having 3 to 8 carbon atoms, x represents a clorine atom or a substituted or unsubstituted aryloxy group having 6 to 30 carbon atoms in the aryloxy moiety, $R_2$ represents a halogen atom (chlorine or bromine), a cyano group, —$COR_3$, —$COOR_3$, or —$CON(R_4)R_3$, each of $R_3$ and $R_4$ independently represents a hydrogen atom, a substituted or unsubstituted alkyl group, or a substituted or unsubstituted aryl group, $R_3$ and $R_4$ may be combined to form a ring, p is 2 or 3, each of $R_6$ and $R_7$ independently represents a hydrogen atom, or an unsubstituted alkyl group having 1 to 4 carbon atoms, wherein at least one of $R_6$ and $R_7$ represents a methyl group, an ethyl group, or an isopropyl group, $R_{10}$ represents a halogen atom, a substituted or unsubstituted alkyl group having 1 to 25 carbon atoms in the alkyl moiety, a substituted or unsubstituted alkoxy group having 1 to 25 carbon atoms in the alkoxy moiety, or a substituted or unsubstituted aryloxy group having 6 to 30 carbon atoms in the aryloxy moiety, and s is 0, 1, or 2.

(10) A magenta coupler represented by formula (M-4):

(M-4)

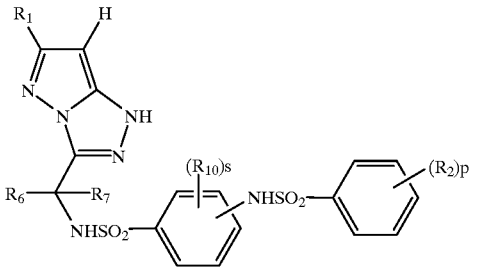

where $R_1$ represents a substituted or unsubstituted alkyl group having 1 to 8 carbon atoms in the alkyl moiety, $R_2$ represents a halogen atom, —$COR_3$, —$COOR_3$, or —$CON(R_4)R_3$, p is an integer from 1 to 3, wherein a plurality of $R_2$'s may be the same or different if p is not less than 2, each of $R_3$ and $R_4$ independently represents a hydrogen atom, a substituted or unsubstituted alkyl group having 1 to 35 carbon atoms in the alkyl moiety, or a substituted or unsubstituted aryl group having 6 to 40 carbon atoms in the aryl moiety, $R_3$ and $R_4$ may be combined to form a ring, each of $R_6$ and $R_7$ independently represents a hydrogen atom or an alkyl group having 1 to 3 carbon atoms, $R_{10}$ represents a halogen atom, a substituted or unsubstituted alkoxy group having 1 to 30 carbon atoms in the alkoxyl moiety, or a substituted or unsubstituted aryloxy group having 6 to 30 carbon atoms in the aryloxy moiety, and s represents an integer from 0 to 3, wherein a plurality of $R_{10}$'s may be the same or different if s is not less than 2.

A magenta coupler of the present invention is a novel compound and shows a very high color generation efficiency even in a color negative photographic light-sensitive material. In addition, a magenta coupler of the present invention is useful not only as a coupler for a silver halide photographic light-sensitive material but also as a material intermediate of medicines and agricultural chemicals.

DETAILED DESCRIPTION OF THE INVENTION

The present invention will be described in detail below. In this specification, "unsubstituted alkyl groups" mean straight-chain, branched, and cyclic alkyl groups, e.g., an n-butyl group, 2-ethylhexyl group, t-butyl group, and cyclohexyl group. "Substituted alkyl groups" will be described in detail below.

The present invention provides a silver halide color photographic light-sensitive material comprising at least one silver halide emulsion layer on a support, said at least one emulsion layer containing a magenta coupler represented by formula (M-1) below.

(M-1)

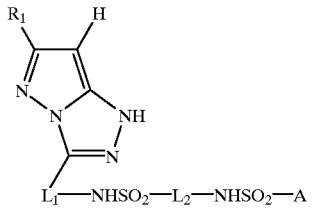

In formula (M-1), $R_1$ represents a substituted or unsubstituted alkyl group. $R_1$ is preferably a substituted or unsubstituted alkyl group having 1 to 30 carbon atoms in the alkyl moiety. Examples of a substituent for substituting this alkyl group are an aryl group, heterocyclic group, acyl group, acyloxy group, acylamino group, alkoxy group, aryloxy group, heterocyclic oxy group, alkoxycarbonyl group, aryloxycarbonyl group, a heterocyclic oxy carbonyl group, alkylcarbamoyl group, arylcarbamoyl group, alkylsulfonyl group, arylsulfonyl group, alkylsulfamoyl group, arylsulfamoyl group, alkylsulfonylamino group, amino group (including an anilino group), alkylsulfinyl group, arylsulfinyl group, alkylthio group, arylthio group, mercapto group, hydroxy group, cyano group, nitro group, hydroxyamino group, carbonyl group, sulfo group, and halogen atom. Examples of these groups are methyl, ethyl, n-propyl, isopropyl, t-butyl, n-octyl, eicosyl, 2-chloroethyl, 2-cyanoethyl, and 2-ethylhexyl. $R_1$ is particularly preferably an alkyl group not containing a hetero atom, and more preferably, a straight-chain, branched, or cyclic alkyl group having 1 to 10 carbon atoms. Practical examples of $R_1$ are presented by formulas (A-1) to (A-10) below. However, the present invention is not limited to these examples.

(A-1)

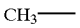

(A-2)

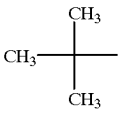

(A-3)

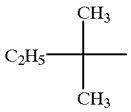

(A-4)

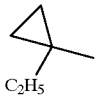

(A-5)

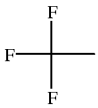

(A-6)

-continued (A-7)

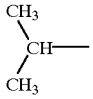

(A-8)

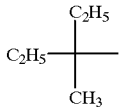

(A-9)

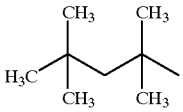

(A-10)

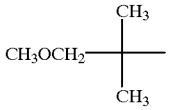

$L_1$ will be described below. $L_1$ represents a substituted or unsubstituted alkylene group or substituted or unsubstituted arylene group. Examples of a substituent when this alkylene group or arylene group is substituted are an alkyl group and the groups which may substitute $R_1$ described above. If $L_1$ is an alkylene group, this alkylene group is preferably a substituted or unsubstituted alkylene group having 1 to 30 carbon atoms in the alkylene moiety, which may be straight-chain, branched, or cyclic. Examples are methylene, 1,2-ethylene, 1,3-propylene, 1-methylmethylene, 1,1-dimethylmethylene, 1,1,2,2-tetramethyl-1,2-ethylene, 1,4-butylene, 1,4-cyclohexylene, and 1-phenylmethylene.

If $L_1$ is an arylene group, this arylene group is preferably a substituted or unsubstituted arylene group having 6 to 35 carbon atoms in the arylene moiety. Examples are 1,2-phenylene, 1,3-phenylene, 1,4-phenylene, and 2,4,6-trimethyl-1,3-phenylene. An alkylene group represented by $L_1$ is more preferably an alkylene group having 1 to 10 carbon atoms. An arylene group represented by $L_1$ is more preferably an arylene group having 6 to 12 carbon atoms. Practical examples of $L_1$ are presented by formulas (B-1) to (B-11) below, but the present invention is not limited to these examples. In these formulas (B-1) to (B-11), a symbol * indicates the position where $L_1$ bonds to a pyrazoloazole ring.

(B-1)

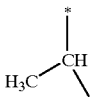

(B-2)

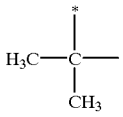

-continued (B-3)

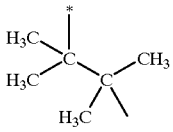

(B-4)

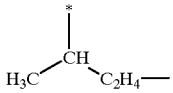

(B-5)

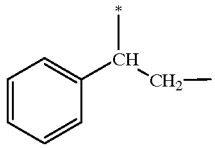

(B-6)

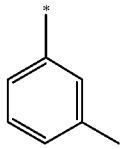

(B-7)

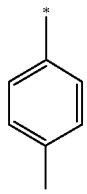

(B-8)

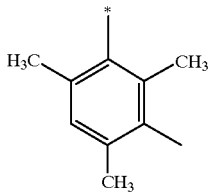

(B-9)

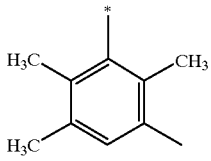

(B-10)

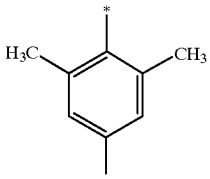

(B-11)

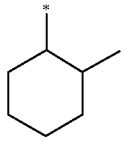

$L_2$ will be described below. $L_2$ represents a substituted or unsubstituted alkylene group or substituted or unsubstituted arylene group. Examples of a substituent when this alkylene group or arylene group is substituted are an alkyl group and the groups which may substitute $R_1$ described above. If $L_2$ is an alkylene group, this alkylene group is preferably an alkylene group having 1 to 30 carbon atoms which may be straight-chain, branched, or cyclic. Examples are 1,2-ethylene, 1,4-butylene, 1,14-tetradecylene, 1,4-cyclohexylene, 1-phenylmethylene, and 2-ethyl-1,6-cyclohexylene. If $L_2$ is an arylene group, this arylene group is preferably an arylene group having 6 to 40 carbon atoms. Examples are 1,2-phenylene, 1,3-phenylene, 1,4-phenylene, 2-butoxy-1,5-phenylene, 2-octyloxy-1,5-phenylene, 2-hexadecyloxy-1,5-phenylene, 4-methoxyphenoxy-1,5-phenylene, 4-chloro-1,5-phenylene, 2-methoxyethoxy-1,5-phenylene, 2-hexadecyl-1,5-phenylene, 4-hexadecyl-1,5-phenylene, 4-hexadecyloxy-1,5-phenylene, 2-hexadecyloxy-1,4-phenylene, 2-methylcyclohexyloxy-1,5-phenylene, and 2-benzyloxy-1,5-phenylene.

The 1-position of any of these arylene groups bonds to the right side of an —$L_1$—$NHSO_2$— group of formula (M-1). An alkylene group represented by $L_2$ is more preferably an alkylene group having 1 to 25 carbon atoms, and most preferably, an alkylene group having 1 to 20 carbon atoms. An arylene group represented by $L_2$ is more preferably an arylene group having 6 to 30 carbon atoms, and most preferably, an arylene group having 6 to 25 carbon atoms. Practical examples of $L_2$ are presented by formulas (C-1) to (C-20) below, but the present invention is not limited to these examples.

In these formulas (C-1) to (C-20), a symbol * indicates the position where $L_2$ bonds to the right side of an —$L_1$—$NHSO_2$— group of formula (M-1).

(C-1)

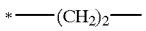

(C-2)

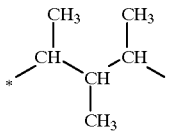

(C-3)

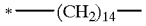

(C-4)

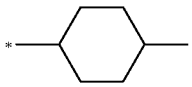

(C-5)

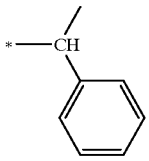

-continued (C-6)

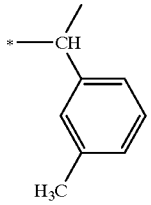

(C-7)

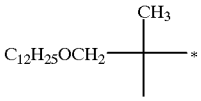

(C-8)

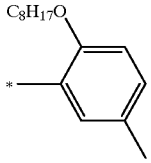

(C-9)

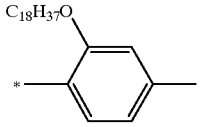

(C-10)

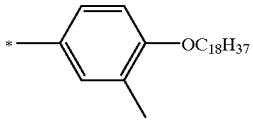

(C-11)

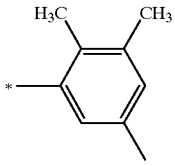

(C-12)

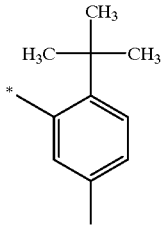

(C-13)

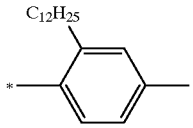

(C-14)

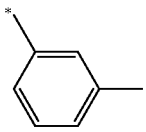

-continued (C-15)

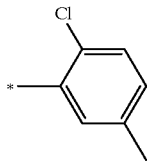

(C-16)

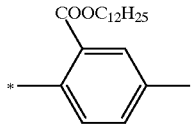

(C-17)

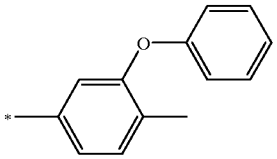

(C-18)

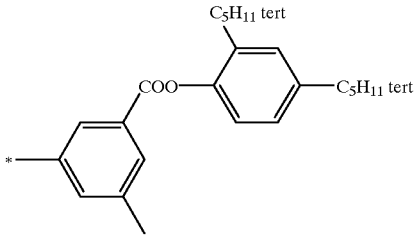

(C-19)

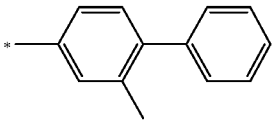

(C-20)

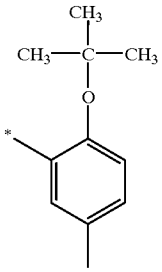

A will be described below. A represents a substituted or unsubstituted aryl group or a substituted or unsubstituted alkyl group except for a 2-octyloxy-5-tert-octylphenyl group and 2-(4-methylphenoxy)ethoxy-5-tert-octylphenyl group. Examples of a substituent are a halogen atom, alkyl group (including a cycloalkyl group), aryl group, heterocyclic group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including an anilino group), acylamino group, aminocarbonylamino group, alkoxycarbonylamino group, aryloxycarbonylamino group, sulfamoylamino group, alkylsulfonylamino and arylsulfonylamino groups, mercapto group, alkylthio group, arylthio group, heterocyclic thio group, sulfamoyl group, sulfo group, alkylsulfinyl and arylsulfinyl groups, alkylsulfonyl and arylsulfonyl groups, acyl group, aryloxycarbonyl group, alkoxycarbonyl group, carbamoyl group, arylazo and heterocyclic azo groups, imide group, phosphino group, phosphinyl group, phosphinyloxy group, phosphinylamino group, and silyl group.

More specifically, substituent examples are a halogen atom (e.g., a chlorine atom, bromine atom, and iodine atom), alkyl group [a straight-chain, branched, or cyclic, substituted or unsubstituted alkyl group having preferably 1 to 40 carbon atoms in the alkyl moiety (e.g., methyl, ethyl, n-propyl, isopropyl, t-butyl, n-octyl, n-octadecyl, eicosyl, 2-chloroethyl, 2-cyanoethyl, and 2-ethylhexyl), substituted or unsubstituted cycloalkyl group having preferably 3 to 40 carbon atoms in the cycloalkyl moiety (e.g., cyclohexyl, cyclopentyl, and 4-n-dodecylcyclohexyl), bicycloalkyl group (preferably a substituted or unsubstituted bicycloalkyl group having 5 to 30 carbon atoms in the bicycloalkyl moiety, i.e., a monovalent group obtained by removing one hydrogen atom from 5- to 30-carbon bicycloalkane, e.g., bicyclo[1,2,2]heptane-2-yl and bicyclo[2,2,2]octane-3-yl). This alkyl group includes a tricyclo structure having a larger number of ring structures. An alkyl group in substituents to be explained below (e.g., an alkyl group in an alkylthio group) also represents an alkyl group having this concept], aryl group (preferably a substituted or unsubstituted aryl group having 6 to 50 carbon atoms in the aryl moiety, e.g., phenyl, p-tolyl, naphthyl, m-chlorophenyl, o-hexadekanoylaminophenyl, and p-tert-octylphenyl), heterocyclic group (preferably a monovalent group obtained by removing one hydrogen atom from a 5- or 6-membered, substituted or unsubstituted, aromatic or nonaromatic heterocyclic compound, and more preferably, a 5- or 6-membered aromatic heterocyclic group having 3 to 30 carbon atoms, e.g., 2-furyl, 2-thienyl, 2-pyrimidinyl, and 2-benzothiazolyl), cyano group, hydroxyl group, nitro group, carboxyl group, alkoxy group (preferably a substituted or unsubstituted alkoxy group having 1 to 30 carbon atoms in the alkoxy moiety, e.g., methoxy, ethoxy, isopropoxy, t-butoxy, n-octyloxy, and 2-methoxyethoxy), aryloxy group (preferably a substituted or unsubstituted aryloxy group having 6 to 30 carbon atoms in the aryloxy moiety, e.g., phenoxy, 2-methylphenoxy, 4-t-butylphenoxy, 3-nitrophenoxy, and 2-tetradecanoylaminophenoxy), silyloxy group (preferably a silyloxy group having 3 to 20 carbon atoms, e.g., trimethylsilyloxy and t-butyldimethylsilyloxy), heterocyclic oxy group (preferably a substituted or unsubstituted heterocyclic oxy group having 2 to 30 carbon atoms in the heterocyclic oxy moiety, e.g., 1-phenyltetrazole-5-oxy and 2-tetrahydropyranyloxy), acyloxy group (preferably a formyloxy group, substituted or unsubstituted alkylcarbonyloxy group having 2 to 30 carbon atoms in the alkylcarbonyloxy moiety, and substituted or unsubstituted arylcarbonyloxy group having 6 to 30 carbon atoms in the arylcarbonyloxy moiety, e.g., formyloxy, acetyloxy, pivaloyloxy, stearoyloxy, benzoyloxy, and p-methoxyphenylcarbonyloxy), carbamoyloxy group (preferably a substituted or unsubstituted carbamoyloxy group having 1 to 30 carbon atoms in the carbamoyloxy moiety, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy), alkoxycarbonyloxy group (preferably a substituted or unsubstituted alkoxycarbonyloxy group having 2 to 30 carbon atoms in the alkoxycarbonyloxy moiety, e.g., methoxycarbonyloxy, ethoxycarbonyloxy, t-butoxycarbonyloxy, and n-octylcarbonyloxy), aryloxycarbonyloxy group (preferably a substituted or unsubstituted aryloxycarbonyloxy group having 7 to 30 carbon atoms in the aryloxycarbonyloxy moiety, e.g., phenoxycarbonyloxy, p-methoxyphenoxycarbonyloxy, and p-n-hexadecyloxyphenoxycarbonyloxy), amino group (preferably an amino group, substituted or unsubstituted alkylamino group having 1 to 30 carbon atoms in the alkylamino moiety, and substituted or unsubstituted anilino group having 6 to 30 carbon atoms in the anilino moiety, e.g., amino, mnethylamino, dimethylamino, anilino, N-methyl-anilino, and diphenylamino), acylamino group (preferably a formylamino group, substituted or unsubstituted alkylcarbonylamino group having 1 to 30 carbon atoms in the alkylcarbonylamino moiety, and substituted or unsubstituted arylcarbonylamino group having 6 to 30 carbon atoms in the arylcarbonylamino moiety, e.g., formylamino, acetylamino, pivaloylamino, lauroylamino, benzoylamino, and 3,4,5-tri-n-octyloxyphenylcarbonylamino), aminocarbonylamino group (preferably a substituted or unsubstituted aminocarbonylamino having 1 to 30 carbon atoms in the aminocarbonylamino moiety, e.g., carbamoylamino, N,N-dimethylaminocarbonylamino, N,N-diethylaminocarbonylamino, and morpholinocarbonylamino), alkoxycarbonylamino group (preferably a substituted or unsubstituted alkoxycarbonylamino group having 2 to 30 carbon atoms in the alkoxycarbonylamino moiety, e.g., methoxycarbonylamino, ethoxycarbonylamino, t-butoxycarbonylamino, n-octadecyloxycarbonylamino, and N-methylmethoxycarbonylamino), aryloxycarbonylamino group (preferably a substituted or unsubstituted aryloxycarbonylamino group having 7 to 30 carbon atoms in the aryloxycarbonylamino moiety, e.g., phenoxycarbonylamino, p-chlorophenoxycarbonylamino, and m-n-octyloxyphenoxycarbonylamino), sulfamoylamino group (preferably a substituted or unsubstituted sulfamoylamino group having 0 to 30 carbon atoms in the sulfamoylamino moiety, e.g., sulfamoylamino, N,N-dimethylaminosulfonylamino, and N-n-octylaminosulfonylamino), alkylsulfonylamino and arylsulfonylamino groups (preferably a substituted or unsubstituted alkylsulfonylamino having 1 to 30 carbon atoms in the alkylsulfonylamino moiety and substituted or unsubstituted arylsulfonylamino having 6 to 30 carbon atoms in the arylsulfonylamino moiety, e.g., methylsulfonylamino, butylsulfonylamino, phenylsulfonylamino, 2,3,5-trichlorophenylsulfonylamino, and p-methylphenylsulfonylamino), mercapto group, alkylthio group (preferably a substituted or unsubstituted alkylthio group having 1 to 30 carbon atoms in the alkylthio moiety, e.g., methylthio, ethylthio, and n-hexadecylthio), arylthio group (preferably a substituted or unsubstituted arylthio having 6 to 30 carbon atoms in the arylthio moiety, e.g., phenylthio, p-chlorophenylthio, and m-methoxyphenylthio), heterocyclic thio group (preferably a substituted or unsubstituted heterocyclic thio group having 2 to 30 carbon atoms in the heterocyclic thio moiety, e.g., 2-benzothioazolylthio and 1-phenyltetrazole-5-ylthio), sulfamoyl group (preferably a substituted or unsubstituted sulfamoyl group having 0 to 30 carbon atoms in the sulfamoyl moiety, e.g., N-ethylsulfamoyl, N-(3-dodecyloxypropyl)sulfamoyl, N,N-dimethylsulfamoyl, N-acetylsulfamoyl, N-benzoylsulfamoyl, and N-(N'-phenylcarbamoyl) sulfamoyl), sulfo group, alkylsulfinyl and arylsulfinyl groups (preferably a substituted or unsubstituted alkylsulfinyl group having 1 to 30 carbon atoms in the alkylsulfinyl moiety and substituted or unsubstituted arylsulfinyl group having 6 to 30 carbon atoms in the arylsulfinyl moiety, e.g., methylsulfinyl, ethylsulfinyl, phenylsulfinyl, and p-methylphenylsulfinyl), alkylsulfonyl and arylsulfonyl groups (preferably a substituted or unsubstituted alkylsulfonyl group having 1 to 30 carbon atoms in the alkylsulfonyl moiety and substituted or unsubstituted arylsulfonyl group having 6 to 30 carbon atoms in the arylsulfonyl moiety, e.g., methylsulfonyl, ethylsulfonyl, phenylsulfonyl, and p-methylphenylsulfonyl), acyl group (preferably a formyl group, substituted or unsubstituted alkylcarbonyl group having 2 to 30 carbon atoms in the alkylcarbonyl moiety, substituted or unsubstituted arylcarbonyl group having 7 to 30 carbon atoms in the arylcarbonyl moiety, and substituted or unsubstituted, 5- or 6-membered heterocyclic carbonyl group having 5 to 25 carbon atoms in the heterocyclic carbonyl moiety, e.g., acetyl, pivaloyl, 2-chloroacetyl, stearoyl, benzoyl, p-n-octyloxyphenylcarbonyl, and 2-pyridylcarbonyl), aryloxycarbonyl group (preferably a substituted or unsubstituted aryloxycarbonyl group having 7 to 30 carbon atoms in the aryloxycarbonyl moiety, e.g., phenoxycarbonyl, o-chlorophenoxycarbonyl, m-nitrophenoxycarbonyl, and p-t-butylphenoxycarbonyl), alkoxycarbonyl group (preferably a substituted or unsubstituted alkoxycarbonyl group having 2 to 30 carbon atoms in the alkoxycarbonyl moiety, e.g., methoxycarbonyl, ethoxycarbonyl, t-butoxycarbonyl, and n-octadecyloxycarbonyl), carbamoyl group (preferably a substituted or unsubstituted carbamoyl group having 1 to 30 carbon atoms in the carbamoyl moiety, e.g., carbamoyl, N-methylcarbamoyl, N,N-dimethylcarbamoyl, N,N-di-n-octylcarbamoyl, N-(methylsulfonyl)carbamoyl, and a group in which R and R' of —CON(R)R' are combined to form a ring (e.g., a morpholinocarbonyl group)), arylazo and heterocyclic azo groups (preferably a substituted or unsubstituted arylazo group having 6 to 30 carbon atoms in the arylazo moiety and substituted or unsubstituted heterocyclic azo group having 3 to 30 carbon atoms in the heterocyclic azo moiety, e.g., phenylazo, p-chlorophenylazo, and 5-ethylthio-1,3,4-thiadiazole-2-ylazo), imide group (preferably N-succinimide and N-phthalimide), phosphino group (preferably a substituted or unsubstituted phosphino group having 2 to 30 carbon atoms in the phosphino moiety, e.g., dimethylphosphino, diphenylphosphino, and methylphenoxyphosphino), phosphinyl group (preferably a substituted or unsubstituted phosphinyl group having 2 to 30 carbon atoms in the phosphinyl moiety, e.g., phosphinyl, dioctyloxyphosphinyl, and diethoxypho,sphinyl), phosphinyloxy group (preferably a substituted or unsubstituted phosphinyloxy group having 2 to 30 carbon atoms in the phosphinyloxy moiety, e.g., diphenoxyphosphinyloxy and dioctyloxyphosphinyloxy), phosphinylamino group (e.g., a substituted or unsubstituted phosphinylamino group having 2 to 30 carbon atoms in the phosphinylamino moiety, e.g., dimethoxyphosphinylamino and dimethylaminophosphinylamino), silyl group (preferably a substituted or unsubstituted silyl group having 3 to 30 carbon atoms in the silyl moiety, e.g., trimethylsilyl, t-butyldimethylsilyl, and phenyldimethylsilyl).

Of the above functional groups, those having a hydrogen atom may be further substituted by the above groups by removing the hydrogen atom, Examples of such functional groups are an alkylcarbonylaminosulfonyl group, arylcarbonylaminosulfonyl group, alkylsulfonylaminocarbonyl group, and arylsulfonylaminocarbonyl group. More specific examples are methylsulfonylaminocarbonyl, p-methylphenylsulfonylaminocarbonyl, acetylaminosulfonyl, and a benzoylaminosulfonyl group.

A preferably represents a substituted or unsubstituted aryl group having 6 to 30 carbon atoms in the aryl moiety or a substituted or unsubstituted alkyl group having 1 to 30 carbon atoms in the alkyl moiety. If A is a substituted or unsubstituted alkyl group, examples are methyl, ethyl, propyl, octyl, and trifluoromethyl.

A is preferably a substituted aryl group, and preferred examples of the substituent are a halogen atom (fluorine, chlorine, bromine, and iodine), nitro group, cyano group, alkylcarbonyl group, arylcarbonyl group, heterocyclic carbonyl group, alkyloxycarbonyl group, aryloxycarbonyl group, alkylaminocarbonyl group, arylaminocarbonyl group, alkyloxycarbonylamino group, aryloxycarbonylamino group, alkylaminocarbonylamino group, arylaminocarbonylamino group, alkylsulfonylaminocarbonyl group, arylsulfonylaminocarbonyl group, alkylcarbonylamino group, and arylcarbonylamino group. Practical examples of A are presented by formulas (D-1) to (D-30) below. However, the present invention is not. restricted to these examples. A symbol * indicates the position where the aryl group bonds to the right side of an —$L_2$—$NHSO_2$— group of formula (M-1).

(D-1)

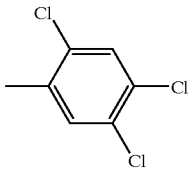

(D-2)

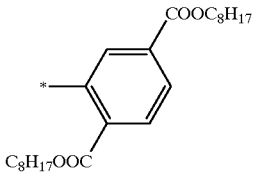

(D-3)

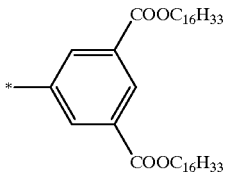

(D-4)

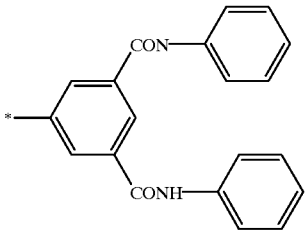

-continued (D-5)

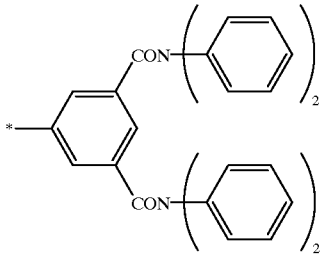

(D-6)

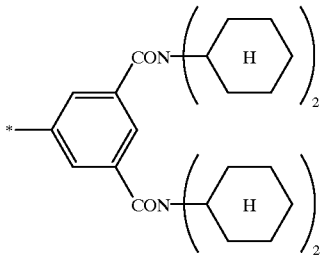

(D-7)

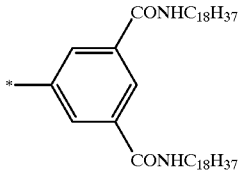

(D-8)

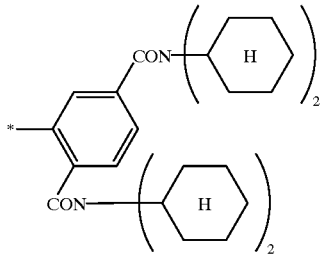

(D-9)

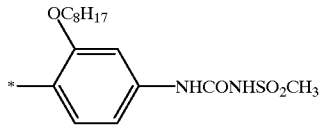

(D-10)

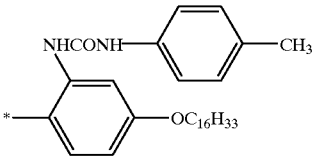

(D-11)

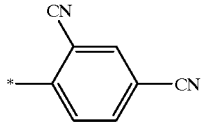

-continued
(D-12)
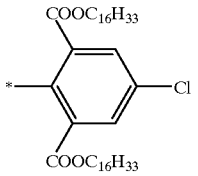
(D-13)
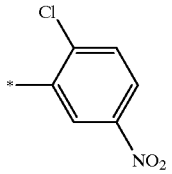
(D-14)
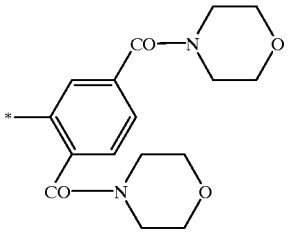
(D-15)
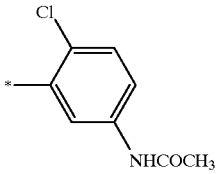
(D-16)
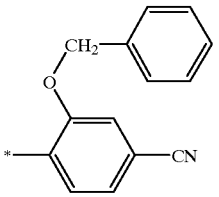
(D-17)
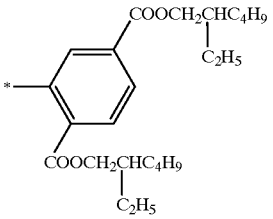
(D-18)
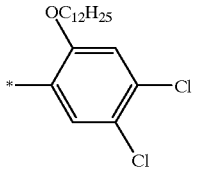
-continued
(D-19)
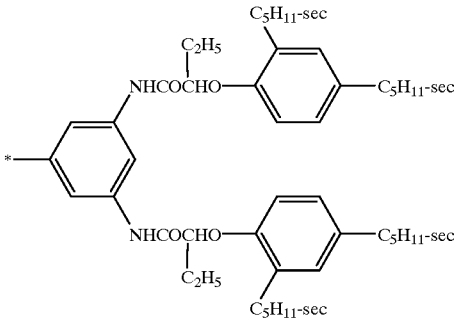
(D-20)
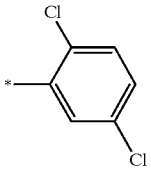
(D-21)
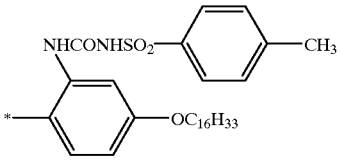
(D-22)
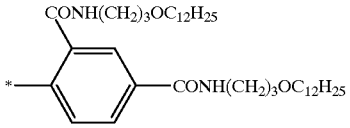
(D-23)
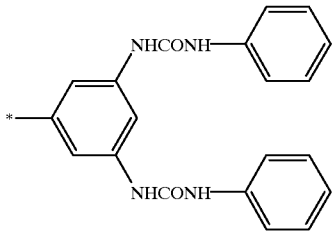
(D-24)
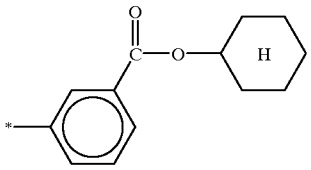
(D-25)
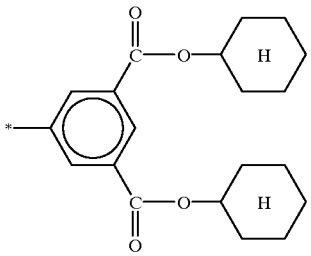

-continued (D-26)

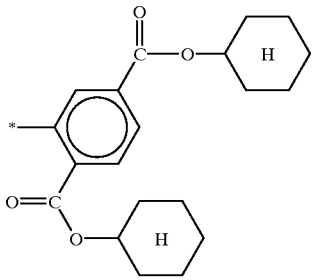

(D-27)

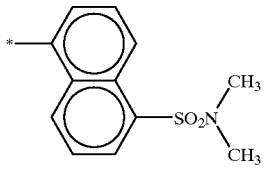

(D-28)

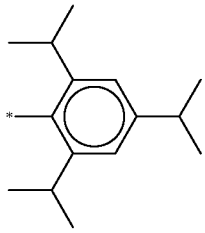

(D-29)

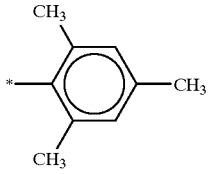

(D-30)

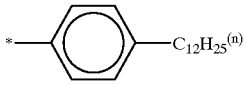

Formula (M-1) will be described in more detail below. Of couplers represented by formula (M-1), a coupler represented by formula (M-2) below is more preferred.

(M-2)

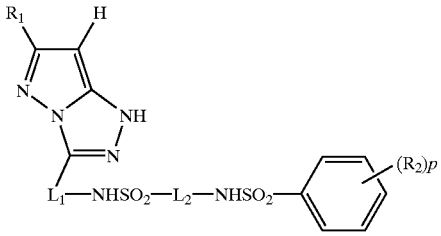

In formula (M-2), $R_1$ represents a substituted or unsubstituted alkyl group, preferably a unsubstituted alkyl group having 1 to 10 carbon atoms. Each of $L_1$ and $L_2$ independently represents a substituted or unsubstituted alkylene group or substituted or unsubstituted arylene group. $L_1$ is more preferably a unsubstituted alkylene group or substituted arylene group. $L_2$ is more preferably a substituted arylene group.

$R_2$ represents a halogen atom, nitro group, cyano group, —$COR_3$, —$COOR_3$, —$CON(R_4)R_3$, —$N(R_4)COOR_3$, —$N(R_4)CO\ N(R_5)R_3$, —$CON(R_4)SO_2R_3$, or —$N(R_4)COR_3$. p is an integer from 1 to 5. If p is 2 or more, a plurality of $R_2$'s may be the same or different. Each of $R_3$, $R_4$, and $R_5$ independently represents a hydrogen atom, substituted or unsubstituted alkyl group, or substituted or unsubstituted aryl group. $R_3$ and $R_4$ may be combined to form a ring.

$R_2$ is preferably a halogen atom (chlorine or bromine), cyano group, —$COR_3$, —$COOR_3$, —$CON(R_4)R_3$, —$N(R_4)COOR_3$, —$N(R_4)CO\ N(R_5)R_3$, or —$N(R_4)COR_3$, and more preferably, a halogen atom (chlorine or bromine), cyano group, —$COR_3$, —$COOR_3$, or —$CON(R_4)R_3$. If $R_3$, $R_4$, and $R_5$ are alkyl and aryl groups, these alkyl and aryl groups may be substituted. Examples of the substituent are those which may substitute A in formula (M-1) described above. Examples of these alkyl and aryl groups are an alkyl group [a straight-chain, branched, or cyclic, substituted or unsubstituted alkyl group having preferably 1 to 40 carbon atoms in the alkyl moiety (e.g., methyl, ethyl, n-propyl, isopropyl, t-butyl, n-octyl, n-octadecyl, eicosyl, 2-chloroethyl, 2-cyanoethyl, and 2-ethylhexyl), substituted or unsubstituted, preferably cycloalkyl group having 3 to 40 carbon atoms in the cycloalkyl moiety (e.g., cyclohexyl, cyclopentyl, and 4-n-dodecylcyclohexyl), aryl group (preferably a substituted or unsubstituted aryl group having 6 to 50 carbon atoms in the aryl moiety, e.g., phenyl, p-tolyl, naphthyl, m-chlorophenyl, o-hexadekanoylaminophenyl, and p-tert-octylphenyl). $R_3$ is preferably an alkyl group having 1 to 30 carbon atoms or aryl group having 6 to 40 carbon atoms, and more preferably, alkyl group having 1 to 25 carbon atoms or aryl group having 6 to 30 carbon atoms. Each of $R_4$ and $R_5$ is preferably a hydrogen atom, alkyl group having 1 to 30 carbon atoms, or aryl group having 6 to 35 carbon atoms, and more preferably, a hydrogen atom, alkyl group having 1 to 25 carbon atoms, or aryl group having 6 to 30 carbon atoms.

If $R_3$ and $R_4$ are combined to form a ring, this ring is a saturated or unsaturated, 5- or 6-membered heterocyclic ring having 4 to 25 carbon atoms. This ring may be substituted. Examples of the substituent are those which may substitute A in formula (M-1) described above. Examples of the heterocyclic ring are a morpholine ring, piperazine ring, piperidine ring, and pyrrolidine ring. A ring formed by $R_4$ and $R_5$ is preferably a saturated 5- or 6-membered heterocyclic ring containing at least one atom selected from N, O, and S in the ring, and more preferably, a substituted or unsubstituted morpholine, piperazine, piperidine, or pyrrolidine ring. p is an integer from 1 to 5. If p is 2 or more, a plurality of $R_2$'s may be the same or different. p is preferably 2 or 3.

A magenta coupler represented by formula (M-2) is more preferably a magenta coupler in which the value of pKa at 25° C. of a dissociation group of —$NHSO_2$— which bonds to $L_2$ and the phenyl group in the magenta coupler is 12 or less, preferably, 11 or less, more preferably, 10 or less, and most preferably, 9 or less, in a solution of $THF/H_2O$=6/4.

A magenta coupler represented by formula (M-2) is more preferably a magenta coupler represented by formula (M-5) below. In this magenta coupler represented by formula (M-5), the value of pKa at 25° C. of a dissociation group of —$NHSO_2$— which is bonded to the two benzene rings in the magenta coupler is 12 or less, preferably, 11 or less, more preferably, 10 or less, and most preferably, 9 or less, in a solution of THF/$H_2O$=6/4.

(M-5)

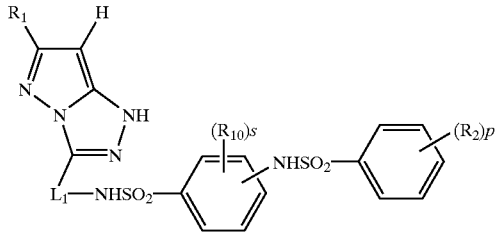

In formula (M-5), $R_2$ and p have the same meanings as in formula (M-2). $R_1$ represents a secondary or tertiary, unsubstituted alkyl group having 1 to 8 carbon atoms. $L_1$ is a substituted or unsubstituted alkylene group represented by formula (M-5a) below or a substituted or unsubstituted arylene group represented by formula (M-5b) below.

(M-5a)

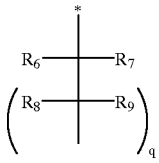

In formula (M-5a), each of $R_6$, $R_7$, $R_8$, and $R_9$ independently represents a hydrogen atom, halogen atom, substituted or unsubstituted alkyl group, or substituted or unsubstituted aryl group. Examples of the substituent are those which may substitute A in formula (M-1) described earlier. Examples of these alkyl and aryl groups are an alkyl group (a substituted or unsubstituted straight-chain or branched alkyl group having 1 to 10 carbon atoms in the alkyl moiety and a cycloalkyl group, e.g., methyl, ethyl, isopropyl, t-butyl, t-octyl, cyclohexyl, 3-methoxymethyl, and benzyl), and aryl group (a substituted or unsubstituted aryl group having 6 to 20 carbon atoms in the aryl moiety, e.g., phenyl, 4-chlorophenyl, 4-methoxyphenyl, and naphthyl). q is an integer from 0 to 3. If q is 2 or more, a plurality of $R_8$'s and $R_9$'s may be the same or different. Two of $R_6$, $R_7$, $R_8$, and $R_9$ may be combined to form a ring structure. Each of $R_6$, $R_7$, $R_8$, and $R_9$ is preferably a hydrogen atom, alkyl group, or aryl group. More preferably, at least one of $R_6$ and $R_7$ is an alkyl group or aryl group, and each of $R_8$ and $R_9$ is a hydrogen atom, alkyl group, or aryl group. Most preferably, at least one of $R_6$ and $R_7$ is a group selected from a methyl group, ethyl group, and isopropyl group, and each of $R_8$ and $R_9$ is a hydrogen atom, alkyl group, or aryl group. q is desirably 0 or 1. In formula (M-5a), a symbol * indicates the position where this alkylene group bonds to a pyrazoloazole ring.

(M-5b)

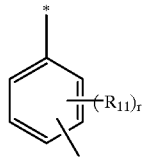

In formula (M-5b), $R_{11}$ represents a hydrogen atom, halogen atom, alkyl group, aryl group, alkoxy group, or aryloxy group. r represents an integer from 1 to 4. If r is 2 or more, a plurality of $R_{11}$'s may be the same or different. If $R_{11}$ is an alkyl group, aryl group, alkoxy group, or aryloxy group, this group may have a substituent. Examples of the substituent are those which may substitute A in formula (M-1) described previously. Examples of these alkyl, aryl, alkoxy, aryloxy groups are an alkyl group (a substituted or unsubstituted straight-chain or branched alkyl group having 1 to 40 carbon atoms in the alkyl moiety and a cycloalkyl group, e.g., methyl, ethyl, isopropyl, t-butyl, t-octyl, hexadecyl, cyclohexyl, 3-methoxymethyl, and benzyl), aryl group (a substituted or unsubstituted aryl group having 6 to 35 carbon atoms in the aryl moiety, e.g., phenyl, 4-chlorophenyl, 4-methoxyphenyl, and naphthyl), alkoxy group (a substituted or unsubstituted, straight-chain or branched alkoxy group having 1 to 40 carbon atoms in the alkoxy moiety, e.g., methoxy, ethoxy, isopropoxy, t-butoxy, t-octyloxy, hexadecyloxy, and 3-methoxyethoxy), and aryloxy group (a substituted or unsubstituted aryloxy group having 6 to 40 carbon atoms in the aryloxy moiety, e.g., phenoxy, 4-chlorophenoxy, 4-methoxyphenoxy, and naphthyloxy). $R_{11}$ is preferably a halogen atom, alkyl group, or alkoxy group, and more preferably, an alkyl group having 1 to 30 carbon atoms or an alkoxy group having 1 to 30 carbon atoms. r is preferably a integer from 1 to 3, and more preferably, 2 or 3. In formula (M-5b), a symbol * indicates the position where this arylene group bonds to a pyrazoloazole ring. The substitution position of a pyrazoloazole ring which bonds to $L_1$ and the substitution position of an —$NHSO_2$ group are preferably meta-position or para-position.

$R_{10}$ represents a substituent which can substitute a benzene ring. Examples are those which may substitute A in formula (M-1) described above. $R_{10}$ is preferably a halogen atom, a substituted or unsubstituted alkyl, substituted or unsubstituted aryl, substituted or unsubstituted alkoxy, substituted or unsubstituted aryloxy, substituted or unsubstituted alkoxycarbonyl, or substituted or unsubstituted aryloxycarbonyl group. Examples of these alkyl, aryl, alkoxy, aryloxy, alkoxycarbonyl, and aryloxycarbonyl groups are an alkyl group (a straight-chain, branched, or cyclic, substituted or unsubstituted alkyl group (preferably an alkyl group having 1 to 30 carbon atoms, e.g., methyl, ethyl, n-propyl, isopropyl, t-butyl, n-octyl, tert-octyl, 2-chloroethyl, n-hexadecyl, 2-cyanoethyl, and 2-ethylhexyl), and cycloalkyl group (preferably a substituted or unsubstituted cycloalkyl group having 3 to 30 carbon atoms in the cycloalkyl moiety, e.g., cyclohexyl, cyclopentyl, and 4-n-dodecylcyclohexyl)], aryl group (preferably a substituted or unsubstituted aryl group having 6 to 30 carbon atoms in the aryl moiety, e.g., phenyl, p-tolyl, naphthyl, m-chlorophenyl, and o-hexadecanoylaminophenyl), alkoxy group (preferably a substituted or unsubstituted alkoxy group having 1 to 30 carbon atoms in the alkoxy moiety, e.g., methoxy, ethoxy, isopropoxy, t-butoxy, n-octyloxy, n-octadecyloxy, 2-methoxyethoxy, and 2,4-di-tert-amylphenoxymethoxy), aryloxy group (preferably a substituted or unsubstituted aryloxy group , e.g., phenoxy, 2-methylphenoxy, 4-t-butylphenoxy, 3-nitrophenoxy, 2-tetradecanoylaminophenoxy, and 2,4-di-tert-amylphenoxy), alkoxycarbonyl group (preferably a substituted or unsubstituted alkoxycarbonyl group having 2 to 30 carbon atoms in the alkoxycarbonyl moiety, e.g., methoxycarbonyl, ethoxycarbonyl, t-butoxycarbonyl, and n-octadecylcarbonyl), and aryloxycarbonyl group (preferably a substituted or unsubstituted aryloxycarbonyl group having 7 to 30 carbon atoms in the aryloxycarbonyl moiety, e.g., phenoxycarbonyl, o-chlorophenoxycarbonyl, m-nitrophenoxycarbonyl, and p-t-butylphenoxycarbonyl). $R_{10}$ is particularly preferably a halogen atom, alkyl group, or alkoxy group, and more preferably, a halogen atom, alkyl group having 1 to 25 carbon atoms, alkoxy group having 1 to 25 carbon atoms, or aryloxy group having 6 to 30 carbon atoms. s is an integer from 0 to 3. If s is 2 or more, a plurality of $R_{10}$'s may be the same or different. s is preferably 0, 1, or 2.

A favorable structure of a magenta coupler represented by formula (M-5) is represented by formula (M-7) below. In this magenta coupler represented by formula (M-7), the value of pKa at 25° C. of a dissociation group of —$NHSO_2$— which is bonded to the two benzene rings in the magenta coupler is 12 or less, preferably, 11 or less, more preferably, 10 or less, and most preferably, 9 or less, in a solution of THF/$H_2O$=6/4.

(M-7)

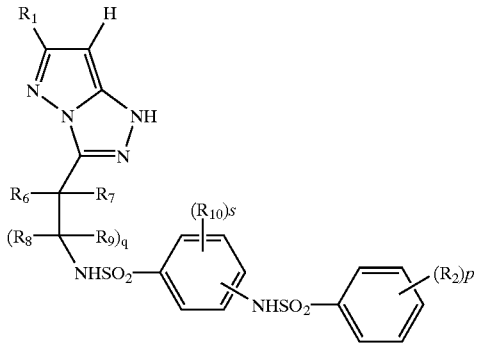

In formula (M-7), $R_1$ is a secondary or tertiary, unsubstituted alkyl group having 3 to 8 carbon atoms,. $R_2$ is a halogen atom (chlorine or bromine), cyano group, —$COR_3$, —$COOR_3$, or —$CON(R_4)R_3$. Each of $R_3$ and $R_4$ is independently a hydrogen atom, substituted or unsubstituted alkyl group, or substituted or unsubstituted aryl group. $R_3$ and $R_4$ may be combined to form a ring.

$R_3$ is preferably a substituted or unsubstituted alkyl group having 1 to 30 carbon atoms in the alkyl moiety, or substituted or unsubstituted aryl group having 6 to 40 carbon atoms in the aryl moiety, and more preferably, a substituted or unsubstituted alkyl group having 1 to 25 carbon atoms in the alkyl moiety or substituted or unsubstituted aryl group having 6 to 30 carbon atoms in the aryl moiety. $R_4$ is preferably a hydrogen atom, unsubstituted alkyl group having 1 to 30 carbon atoms, or unsubstituted aryl group having 6 to 18 carbon atoms, and more preferably, a hydrogen atom, substituted or unsubstituted alkyl group having 1 to 25 carbon atoms in the alkyl moiety, or unsubstituted aryl group having 6 to 10 carbon atoms. A ring which $R_3$ and $R_4$ are combined to form is preferably a 5- or 6-membered heterocyclic ring, and more preferably, a heterocyclic ring which contains at least one atom selected from N, O, and S in the ring.

p is 2 or 3. Each of $R_6$, $R_7$, $R_8$, and $R_9$ is independently a hydrogen atom or alkyl group having 1 to 4 carbon atoms. At least one of $R_6$ and $R_7$ is a group selected from a methyl group, ethyl group, and isopropyl group. q is 0 or 1. $R_{10}$ is a halogen atom, a substituted or unsubstituted alkyl group having 1 to 25 carbon atoms in the alkyl moiety, alkoxy group having 1 to 25 carbon atoms in the alkoxy moiety, or aryloxy group having 6 to 30 carbon atoms in the aryloxy moiety. s is 0, 1, or 2. It is desirable that, of the two —$NHSO_2$— groups, the —$NHSO_2$— group which is bonded to the two benzene rings is positioned meta to the other —$NHSO_2$— group, on the benzene ring having $R_{10}$.

A compound represented by formula (M-7) is more preferably a compound represented by formula (M-8) below. In this magenta coupler represented by formula (M-8), the value of pKa at 25° C. of a dissociation group of —$NHSO_2$— which is bonded to the two benzene rings in the magenta coupler is 12 or less, preferably, 11 or less, more preferably, 10 or less, and most preferably, 9 or less, in a solution of THF/$H_2O$=6/4.

(M-8)

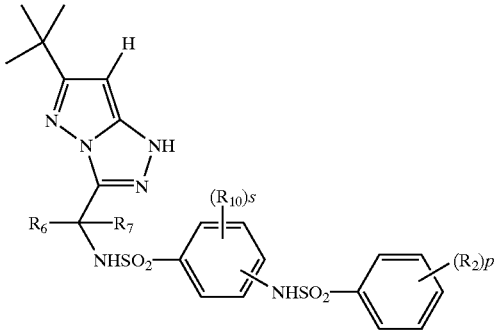

In formula (M-8), $R_2$ is a halogen atom (chlorine or bromine), cyano group, —$COR_3$, —$COOR_3$, or —$CON(R_4)R_3$. p is 2 or 3. $R_3$ is a substituted or unsubstituted alkyl group having 1 to 25 carbon atoms in the alkyl moiety or substituted or unsubstituted aryl group having 6 to 30 carbon atoms in the aryl moiety. If $R_3$ is an alkyl group, this substituent is preferably an unsubstituted cycroalkyl group having 5 to 7 carbon atoms. $R_4$ is a hydrogen atom, substituted or unsubstituted alkyl group having 1 to 25 carbon atoms in the alkyl moiety, or substituted or unsubstituted aryl group having 6 to 30 carbon atoms in the aryl moiety. $R_3$ and $R_4$ may be combined to form a ring. This ring formed by $R_3$ and $R_4$ is a 5- or 6-membered heterocyclic ring and more preferably a morpholine ring, piperazine ring, piperidine ring, or pyrrolidine ring. In a preferred form of this substituent $R_2$, each of $R_3$ and $R_4$ is an alkyl group or aryl group and they do not form a ring.

Each of $R_6$ and $R_7$ is independently a hydrogen atom or alkyl group having 1 to 4 carbon atoms. At least one of $R_6$ and $R_7$ is a group selected from a methyl group, ethyl group, and isopropyl group. $R_{10}$ is a halogen atom, substituted or unsubstituted alkyl group having 1 to 25 carbon atoms in the alkyl moiety, substituted or unsubstituted alkoxy group having 1 to 25 carbon atoms in the alkoxy moiety, or substituted or unsubstituted aryloxy group having 6 to 30 carbon atoms in the aryloxy moiety, preferably, a halogen atom, unsubstituted alkyl group having 8 to 22 carbon atoms, unsubstituted alkoxy group having 8 to 18 carbon atoms, or unsubstituted aryloxy group having 10 to 18 carbon atoms, and more preferably, a halogen atom, unsubstituted alkoxy group having 10 to 22 carbon atoms, or unsubstituted aryloxy group having 10 to 14 carbon atoms. s is 0, 1, or 2.

The present invention also provides a silver halide color photographic light-sensitive material having at least one silver halide emulsion layer on a support, said one emulsion layer containing a magenta coupler represented by formula (M-3) below.

Formula (M-3) will be described below. In this magenta coupler represented by formula (M-3), the value of pKa at 25° C. Of a dissociation group of —$NHSO_2$— which bonds to $L_2$ and the phenyl group in the magenta coupler is 12 or less, preferably, 11 or less, more preferably, 10 or less, and most preferably, 9 or less, in a solution of THF/$H_2O$ =6/4.

(M-3)

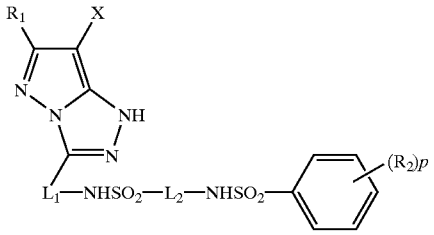

In formula (M-3), $R_1$, $L_1$, $L_2$, $R_2$, and p have the same meanings as in formula (M-2) described above. X represents a group or an atom which splits off during a coupling reaction with an oxidized form of a developing agent. x is preferably a halogen atom, substituted or unsubstituted alkoxy group having 1 to 30 carbon atoms in the alkoxy moiety, substituted or unsubstituted alkoxycarbonyl group having 2 to 30 carbon atoms in the alkoxycarbonyl moiety, substituted or unsubstituted aryloxycarbonyloxy group having 7 to 30 carbon atoms in the aryloxycarbonyloxy moiety, substituted or unsubstituted aminocarbonyloxy group having 1 to 30 carbon atoms in the aminocarbonyloxy moiety, substituted or unsubstituted acyloxy group having 1 to 30 carbon atoms in the acyloxy moiety, substituted or unsubstituted alkylsulfonylamino group having 1 to 30 carbon atoms in the alkylsulfonylamino moiety, substituted or unsubstituted arylsulfonylamino group having 6 to 30 carbon atoms in the arylsulfonylamino moiety, substituted or unsubstituted arylthio group having 6 to 30 carbon atoms in the arylthio moiety, substituted or unsubstituted heterocyclic thio group having 3 to 30 carbon atoms in the heterocyclic thio moiety, or substituted or unsubstituted group having 3 to 30 carbon atoms which bonds by a nitrogen atom. Practical examples of X are those explained earlier as groups which substitute A in formula (M-1). X is more preferably a chlorine atom or substituted or unsubstituted aryloxy group having 6 to 30 carbon atoms in the aryloxy moiety.

A coupler represented by formula (M-3) is more preferably a coupler represented by formula (M-6) below. In this magenta coupler represented by formula (M-6), the value of pKa at 25° C. of a dissociation group of —$NHSO_2$— which is bonded to the two benzene rings in the magenta coupler is 12 or less, preferably, 11 or less, more preferably, 10 or less, and most preferably, 9 or less, in a solution of THF/$H_2O$=6/4.

(M-6)

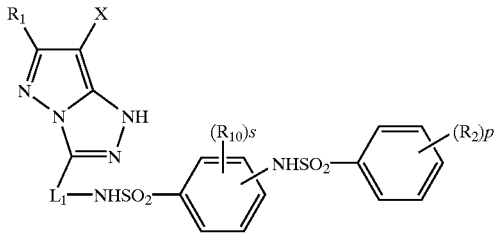

In formula (M-6), $R_1$, $L_1$, $R_2$, p, and X have the same meanings as in formula (M-3) described above. $R_{10}$ represents a halogen atom a substituent which may substitute a benzene ring. If $R_{10}$ is a substituent which can substitute a benzene ring, examples of this substituent are those which may substitute A in formula (M-1) described previously. $R_{10}$ is preferably a halogen atom, a substituted or unsubstituted alkyl, substituted or unsubstituted aryl, substituted or unsubstituted alkoxy, substituted or unsubstituted aryloxy, substituted or unsubstituted alkoxycarbonyl, or substituted or unsubstituted aryloxycarbonyl group. Examples of these alkyl, aryl, alkoxy, aryloxy, alkoxycarbonyl, and aryloxycarbonyl groups are an alkyl group [a straight-chain, branched, or cyclic, substituted or unsubstituted alkyl group (preferably a substituted or unsubstituted alkyl group having 1 to 30 carbon atoms in the alkyl moiety, e.g., methyl, ethyl, n-propyl, isopropyl, t-butyl, n-octyl, tert-octyl, 2-chloroethyl, n-hexadecyl, 2-cyanoethyl, and 2-ethylhexyl), and cycloalkyl group (preferably a substituted or unsubstituted cycloalkyl group having 3 to 30 carbon atoms in the cycloalkyl moiety, e.g., cyclohexyl, cyclopentyl, and 4-n-dodecylcyclohexyl)], aryl group (preferably a substituted or unsubstituted aryl group having 6 to 30 carbon atoms in the aryl moiety, e.g., phenyl, p-tolyl, naphthyl, m-chlorophenyl, and o-hexadecanoylaminophenyl), alkoxy group (preferably a substituted or unsubstituted alkoxy group having 1 to 30 carbon atoms in the alkoxy moiety, e.g., methoxy, ethoxy, isopropoxy, t-butoxy, n-octyloxy, n-octadecyloxy, 2-methoxyethoxy, and 2,4-di-tert-amylphenoxymethoxy), aryloxy group (preferably a substituted or unsubstituted aryloxy group having 6 to 30 carbon atoms in the aryloxy moiety, e.g., phenoxy, 2-methylphenoxy, 4-t-butylphenoxy, 3-nitrophenoxy, 2-tetradecanoylaminophenoxy, and 2,4-di-tert-amylphenoxy), alkoxycarbonyl group (preferably a substituted or unsubstituted alkoxycarbonyl group having 2 to 30 carbon atoms in the alkoxycarbonyl moiety, e.g., methoxycarbonyl, ethoxycarbonyl, t-butoxycarbonyl, and n-octadecylcarbonyl), and aryloxycarbonyl group (preferably a substituted or unsubstituted aryloxycarbonyl group having 7 to 30 carbon atoms in the aryloxycarbonyl moiety, e.g., phenoxycarbonyl, o-chlorophenoxycarbonyl, m-nitrophenoxycarbonyl, and p-t-butylphenoxycarbonyl). $R_{10}$ is particularly preferably a halogen atom, alkyl group having 1 to 30 carbon atoms, or alkoxy group having 1 to 30 carbon atoms, or aryloxy group having 6 to 35 carbon atoms, and more preferably, a halogen atom, alkyl group having 1 to 25 carbon atoms, alkoxy group having 1 to 25 carbon atoms, or aryloxy group having 6 to 30 carbon atoms. s is an integer from 0 to 3. If s is 2 or more, a plurality of $R_{10}$'s may be the same or different. s is preferably 0, 1, or 2. It is desirable that the —$NHSO_2$— group which is bonded to the two benzene rings is positioned meta to the other —$NHSO_2$— group which is bonded to $L_1$.

A favorable structure of a magenta coupler represented by formula (M-6) is represented by formula (M-9) below. In this magenta coupler represented by formula (M-9), the value of pKa at 25° C. of a dissociation group of —$NHSO_2$— which is bonded to the two benzene rings in the magenta coupler is 12 or less, preferably, 11 or less, more preferably, 10 or less, and most preferably, 9 or less, in a solution of THF/$H_2O$ =6/4.

(M-9)

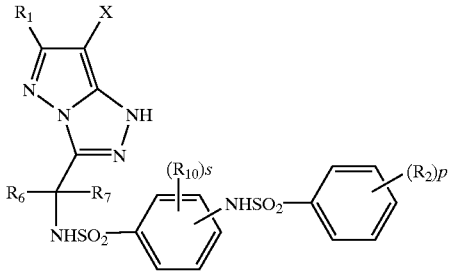

In formula (M-9), $R_1$ is a secondary or tertiary, unsubstituted alkyl group having 3 to 8 carbon atoms. X is a chlorine atom or substituted or unsubstituted aryloxy group having 6 to 30 carbon atoms in the aryloxy moiety. $R_2$ is a halogen atom (chlorine or bromine), cyano group, —$COR_3$, —$COOR_3$, or —$CON(R_4)R_3$.

Each of $R_3$ and $R_4$ is independently a hydrogen atom, substituted or unsubstituted alkyl group, or substituted or unsubstituted aryl group. $R_3$ is preferably a substituted or unsubstituted alkyl group having 1 to 30 carbon atoms in the alkyl moiety or substituted or unsubstituted aryl group having 6 to 40 carbon atoms in the aryl moiety, more preferably, a substituted or unsubstituted alkyl group having 1 to 25 carbon atoms in the alkyl moiety or substituted or unsubstituted aryl group having 10 to 30 carbon atoms in the aryl moiety, and most preferably, an unsubstituted alkyl group having 10 to 22 carbon atoms or unsubstituted aryl group having 6 to 14 carbon atoms. If $R_3$ is an alkyl group, this substituent is preferably an unsubstituted cycroalkyl group having 5 to 7 carbon atoms. $R_4$ is preferably a hydrogen atom, substituted or unsubstituted alkyl group having 1 to 30 carbon atoms in the alkyl moiety, or substituted or unsubstituted aryl group having 6 to 35 carbon atoms in the aryl moiety, more preferably, a hydrogen atom, unsubstituted alkyl group having 5 to 22 carbon atoms, or unsubstituted aryl group having 6 to 14 carbon atoms. $R_3$ and $R_4$ may be combined to form a ring. A ring which $R_3$ and $R_4$ are combined to form is preferably a 5- or 6-membered heterocyclic ring, and more preferably, a heterocyclic ring which contains at least one atom selected from N, O, and S in the ring.

p is 2 or 3. Each of $R_6$ and $R_7$ is independently a hydrogen atom or unsubstituted alkyl group having 1 to 4 carbon atoms. At least one of $R_6$ and $R_7$ is a group selected from a methyl group, ethyl group, and isopropyl group.

$R_{10}$ is a halogen atom, substituted or unsubstituted alkyl group having 1 to 25 carbon atoms in the alkyl moiety, substituted or unsubstituted alkoxy group having 1 to 25 carbon atoms in the alkoxy moiety, or substituted or unsubstituted aryloxy group having 6 to 30 carbon atoms in the aryloxy moiety. s is 0, 1, or 2.

The present invention also provides a coupler represented by formula (M-4) below. This compound represented by formula (M-4) is a novel pyrazoloazole compound which is useful not only as a silver halide photographic light-sensitive material but also as an intermediate material of medicines and agricultural chemicals.

(M-4)

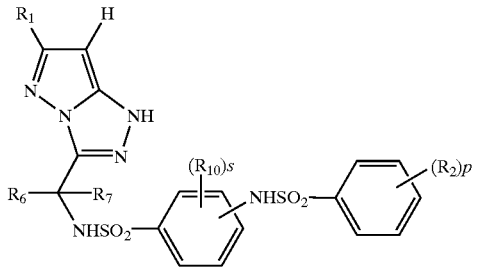

In formula (M-4), $R_1$ is a substituted or unsubstituted alkyl group having 1 to 8 carbon atoms, and more preferably, a secondary or tertiary alkyl group having 3 to 8 carbon atoms. $R_2$ represents a halogen atom, —$COR_3$, —$COOR_3$, or —$CON(R_4)R_3$. p is an integer from 1 to 3. If p is 2 or more, a plurality of $R_2$'s may be the same or different. p is preferably 2 or 3. Each of $R_3$ and $R_4$ independently represents a hydrogen atom, substituted or unsubstituted alkyl group having 1 to 35 carbon atoms in the alkyl moiety [a straight-chain, branched, or cyclic, substituted or unsubstituted alkyl group (e.g., methyl, ethyl, n-propyl, isopropyl, t-butyl, n-octyl, n-octadecyl, eicosyl, 2-chloroethyl, 2-cyanoethyl, and 2-ethylhexyl), and cycloalkyl group (e.g., cyclohexyl, cyclopentyl, and 4-n-dodecylcyclohexyl)], substituted or unsubstituted aryl group having 6 to 40 carbon atoms in the aryl moiety (e.g., phenyl, p-tolyl, naphthyl, m-chlorophenyl, o-hexadecanoylaminophenyl, and p-tert-octylphenyl). $R_3$ is preferably an unsubstituted alkyl group having 1 to 22 carbon atoms or having 1 to 4 carbon atoms aryl group having 6 to 18 carbon atoms. $R_4$ is preferably a hydrogen atom, substituted or unsubstituted alkyl group having 1 to 35 carbon atoms in the alkyl moiety, or substituted or unsubstituted aryl group having 6 to 35 carbon atoms in the aryl moiety, and more preferably, a hydrogen atom, unsubstituted alkyl group having 1 to 22 carbon atoms, or unsubstituted aryl group having 6 to 18 carbon atoms. $R_3$ and $R_4$ may be combined to form a ring. A ring which $R_3$ and $R_4$ are combined to form is preferably a 5- or 6-membered heterocyclic ring, and more preferably, a heterocyclic ring which contains at least one atom selected from N, O, and S in the ring. This ring formed by $R_3$ and $R_4$ is preferably a unsubstituted morpholine ring, piperazine ring, or piperidine ring. Each of $R_6$ and $R_7$ independently represents a hydrogen atom or unsubstituted alkyl group having 1 to 3 carbon atoms.

$R_{10}$ is a halogen atom, a substituted or unsubstituted alkoxy or substituted or unsubstituted aryloxy group. Examples of these alkoxy and aryloxy groups are an alkoxy group (preferably a substituted or unsubstituted alkoxy group having 1 to 30 carbon atoms in the alkoxy moiety, e.g., methoxy, ethoxy, isopropoxy, t-butoxy, n-octyloxy, n-octadecyloxy, 2-methoxyethoxy, and 2,4-di-tert-amylphenoxymethoxy), aryloxy group (preferably a substituted or unsubstituted aryloxy group having 6 to 30 carbon atoms in the aryloxy moiety, e.g., phenoxy, 2-methylphenoxy, 4-t-butylphenoxy, 3-nitrophenoxy, 2-tetradecanoylaminophenoxy, and 2,4-di-tert-amylphenoxy). $R_{10}$ is preferably a halogen atom or a alkoxy group having 1 to 30 carbon atoms, and more preferably, a halogen atom or an unsubstituted alkoxy group having 1 to 22 carbon atoms. s is an integer from 0 to 3. If s is 2 or more, a plurality of $R_{10}$'s may be the same or different. s is preferably 0, 1, or 2. It is most desirable for s to be 1. In this case, it is preferable that $R_{10}$ is positioned ortho to the —$NHSO_2$— group having $R_6$—C— $R_7$ group bonded thereto. Further, it is preferred that, of the two —$NHSO_2$— groups, the —$NHSO_2$— group which is bonded to the two benzene tings is positioned para to $R_{10}$ and also meta to the other —$NHSO_2$— group, on the benzene ring having $R_{10}$.

The measurement of the pKa value in the present invention will be described below. The pKa value was measured under the following conditions by using the AT-210 measurement device (Kyoto Denshi Kogyo K. K.) That is, $1\times10^{-5}$ mL of a magenta coupler of the present invention was accurately weighed at room temperature (25° C.) and dissolved in 30 mL of THF. 20 mL of $H_2O$ were then added to completely dissolve the material. Subsequently, 0.25 mL of an aqueous 0.2 N hydrochloric acid solution was added, and the resultant solution was stirred. An aqueous 0.2 N NaOH solution was dropped into this solution, and the pKa value was obtained from the neutralization middle point. All pKa values in the present invention were obtained under the above measurement conditions.

Table 1 shows the pKa values of magenta couplers of the present invention. All magenta couplers of the present invention had pKa values of 12 or less. In contrast, the pKa values of comparative compounds (G-1 to G-10 to be presented later) were 12 more, indicating an obvious difference.

TABLE 1

| Compound of present invention | pKa value | Comparative Compound | pKa value |
|---|---|---|---|
| MC-1 | 8.44 | G-1 | more than 12 |
| MC-2 | 9.7 | G-2 | more than 12 |
| MC-3 | 8.59 | G-3 | more than 12 |
| MC-4 | 8.72 | G-4 | more than 12 |
| MC-5 | 9.01 | G-5 | more than 12 |
| MC-6 | 8.68 | G-6 | more than 12 |
| MC-7 | 8.63 | G-7 | more than 12 |
| MC-8 | 8.46 | G-8 | more than 12 |
| MC-12 | 8.62 | G-9 | more than 12 |
| MC-13 | 8.48 | G-10 | more than 12 |

Compound examples (MC-1 to MC-60) of the present invention are presented below, but the present invention is not restricted to these examples.

Example compound (MC-1 - MC-3)

MC-1

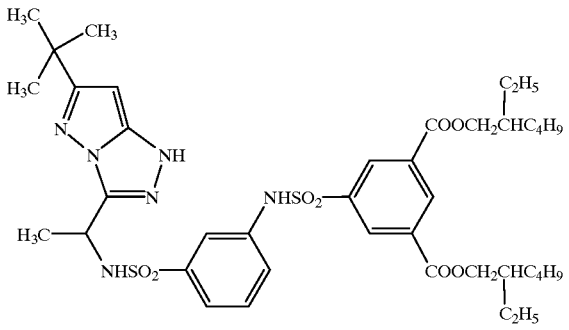

-continued

MC-2

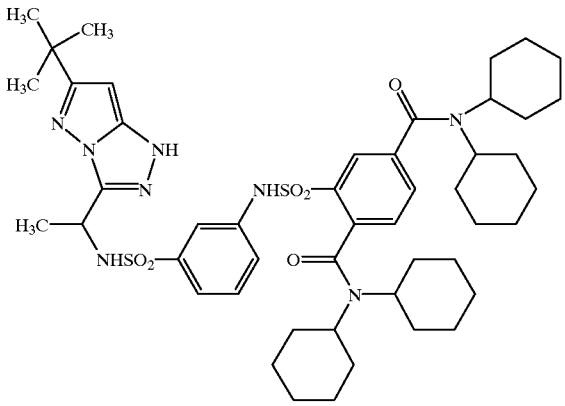

MC-3

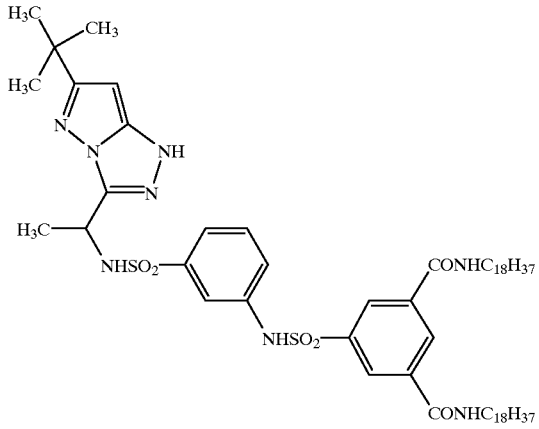

Example compound (MC-4 - MC-6)

MC-4

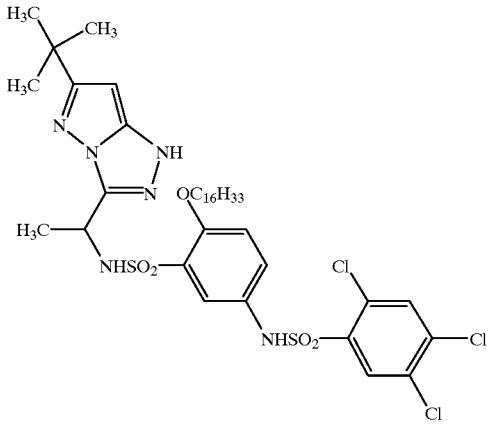

-continued
MC-5
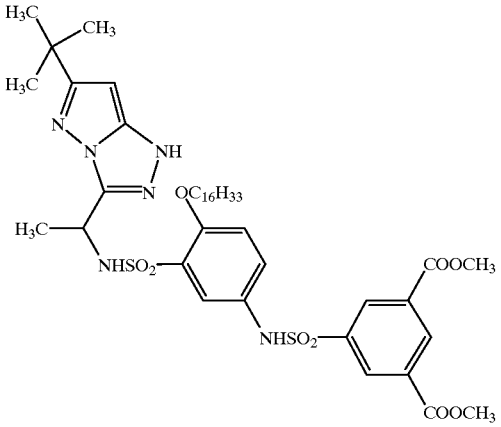
MC-6
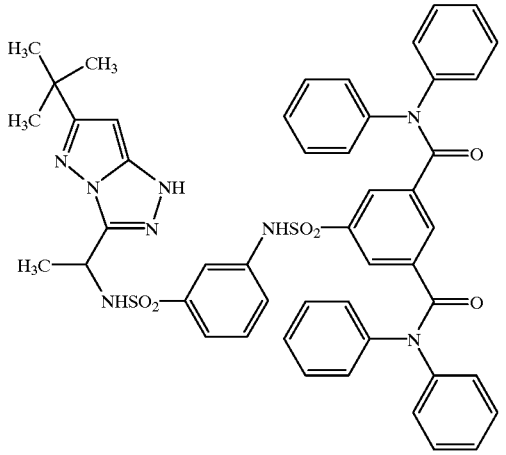
Example compound (MC-7 - MC-9)
MC-7
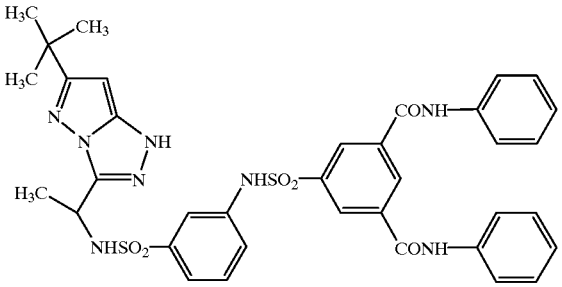
MC-8
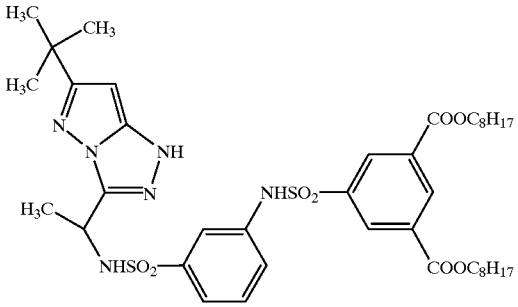
-continued
MC-9
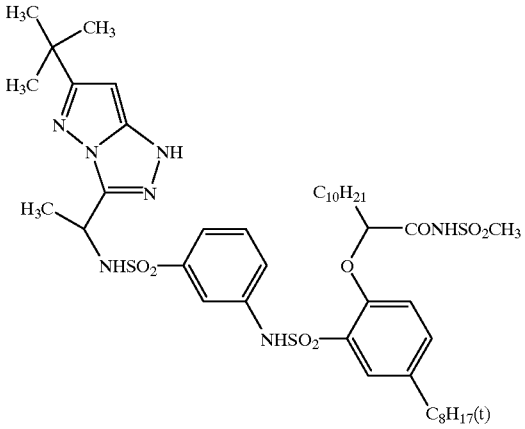
Example compound (MC-10 - MC-12)
MC-10
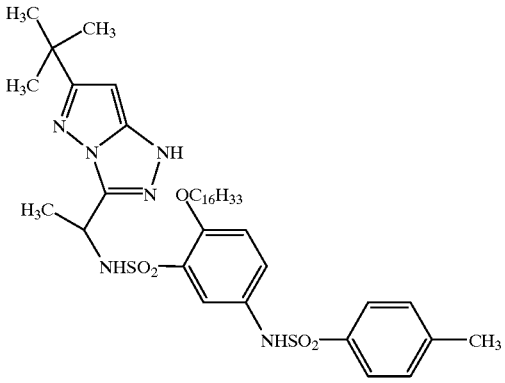
MC-11
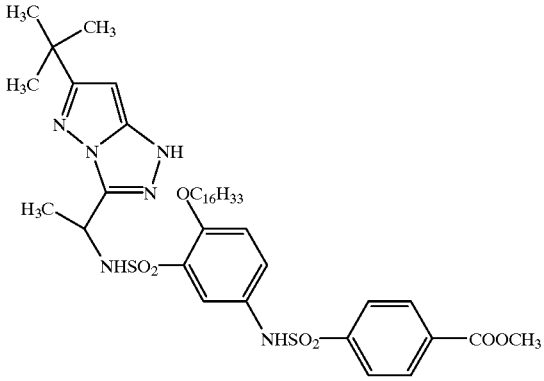

MC-12
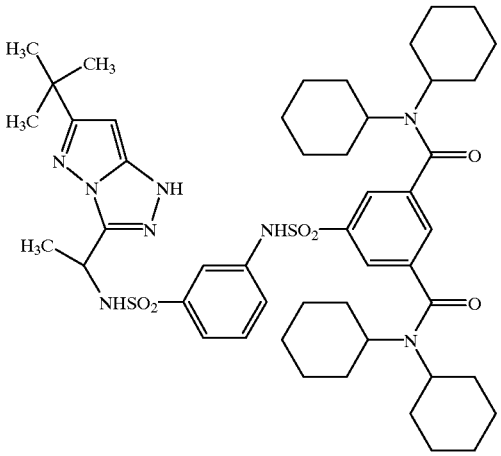
Example compound (MC-13 - MC-15)
MC-13
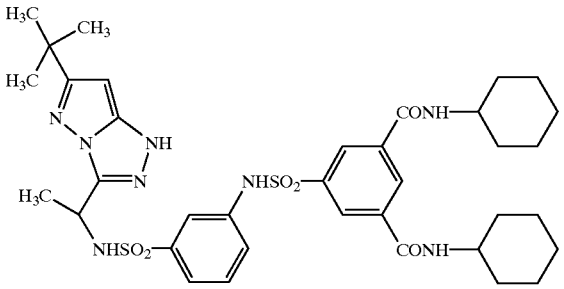
MC-14
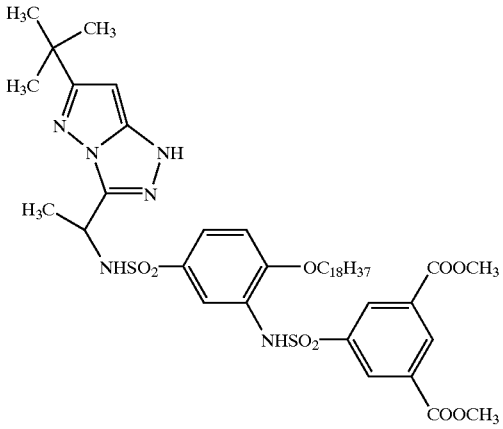
MC-15
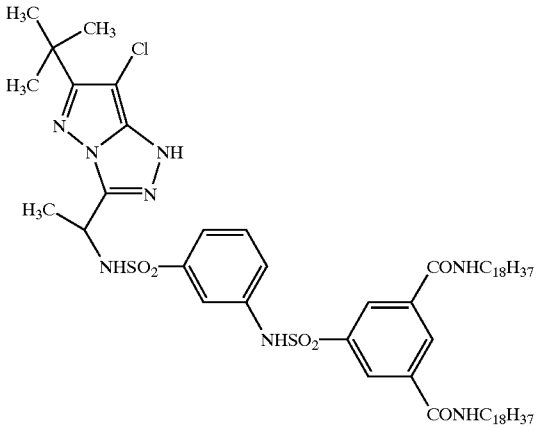
Example compound (MC-16 - MC-18)
MC-16
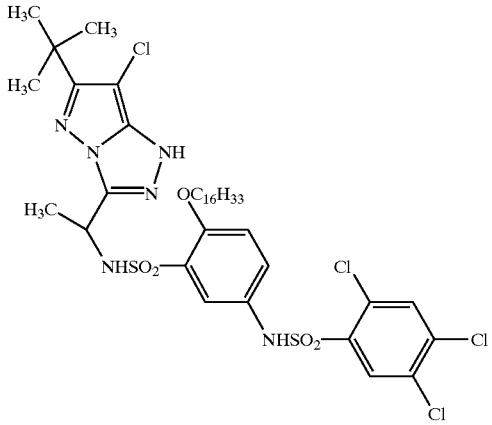
MC-17
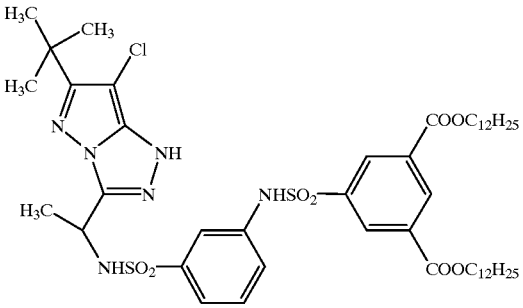

MC-18
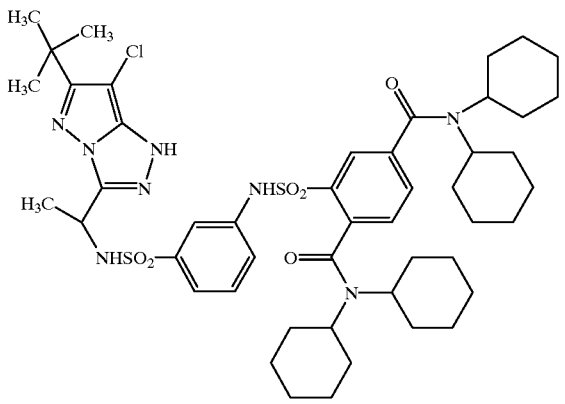
Example compound (MC-19 - MC-21)
MC-19
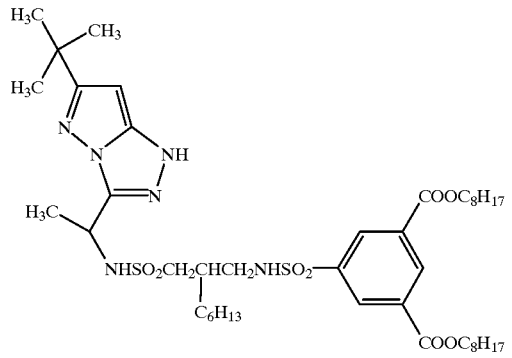
MC-20
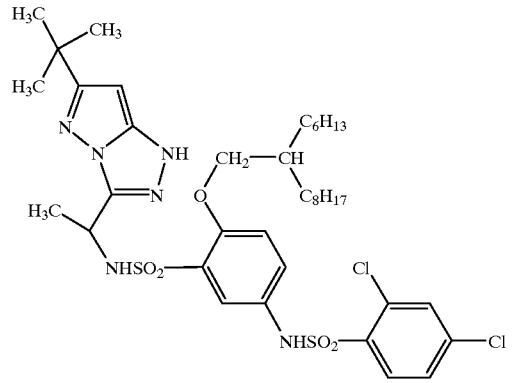
MC-21
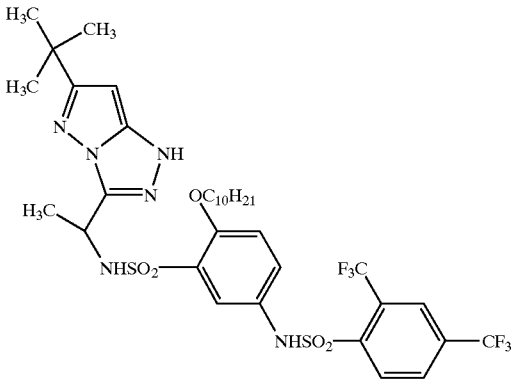
Example compound (MC-22 - MC-24)
MC-22
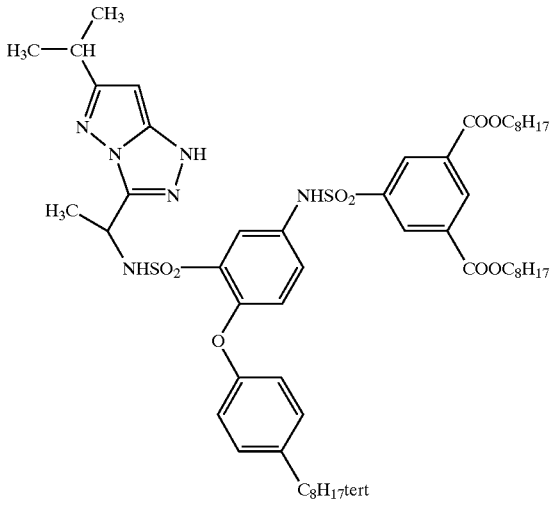
MC-23
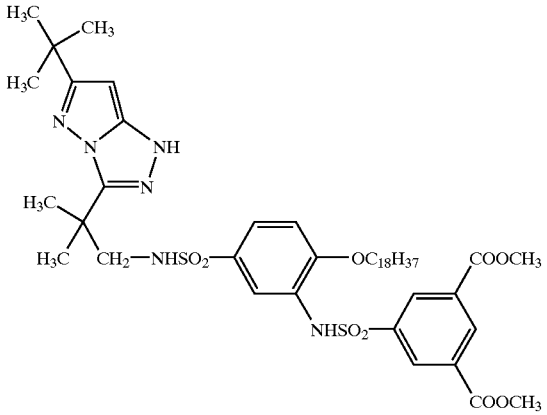

-continued
MC-24
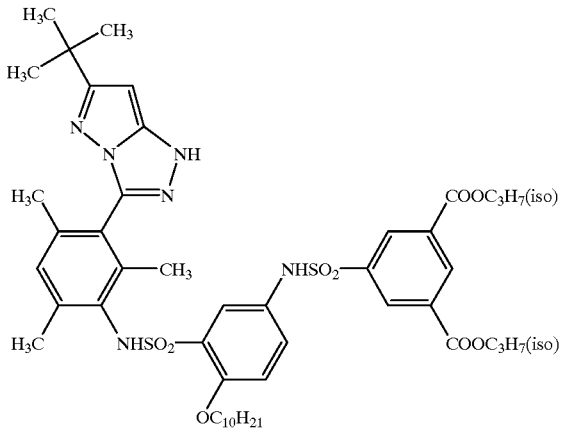
Example compound (MC-25 - MC-27)
MC-25
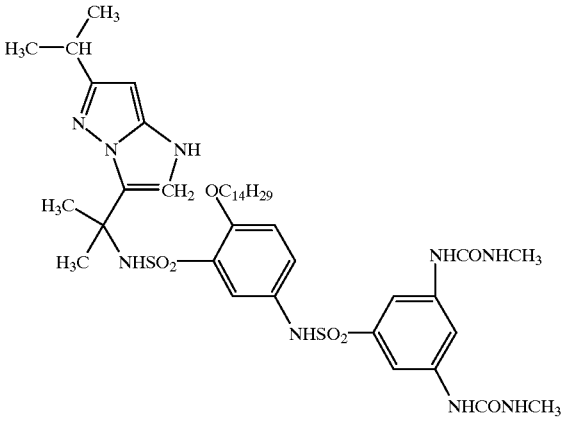
MC-26
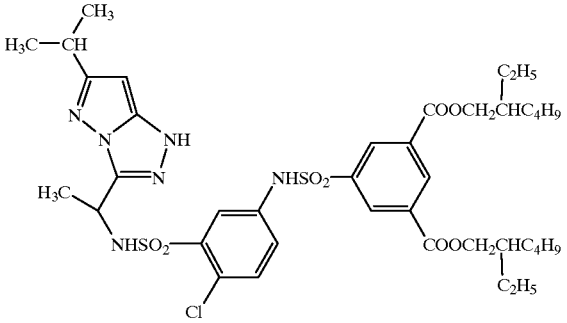
-continued
MC-27
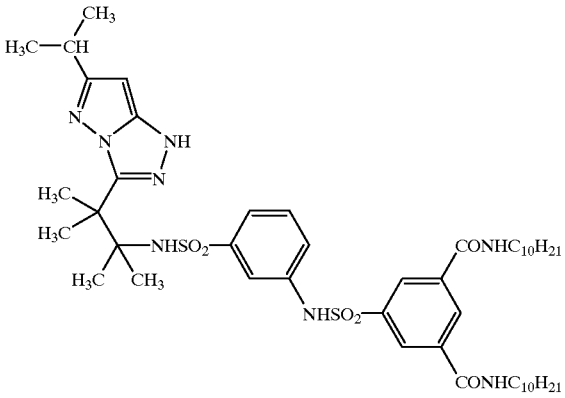
Example compound (MC-28 - MC-30)
MC-28
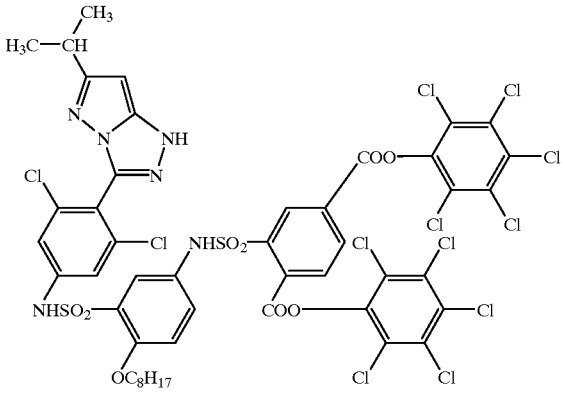
MC-29
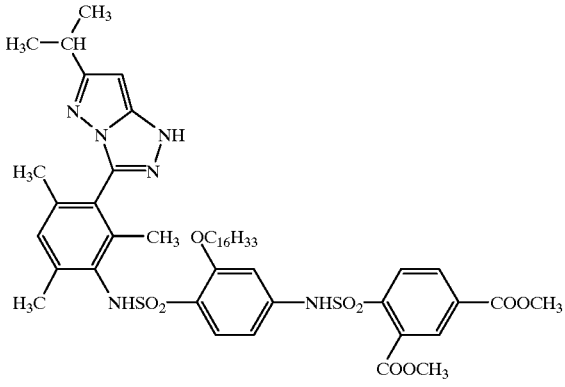

-continued
MC-30
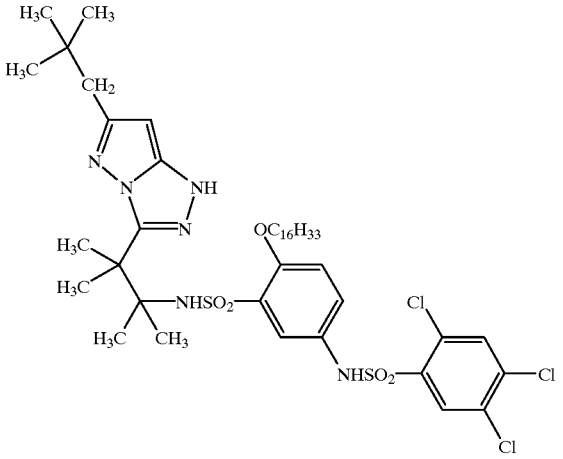
Example compound (MC-31 - MC-33)
MC-31
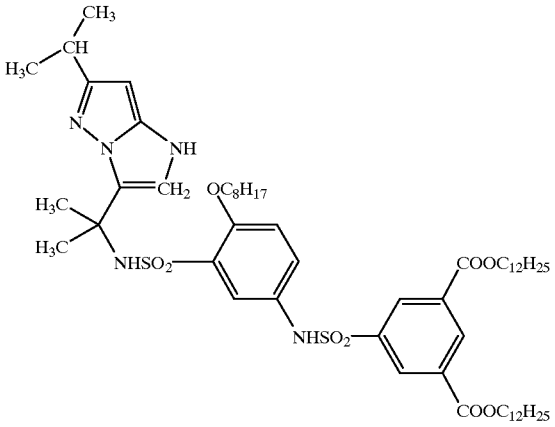
MC-32
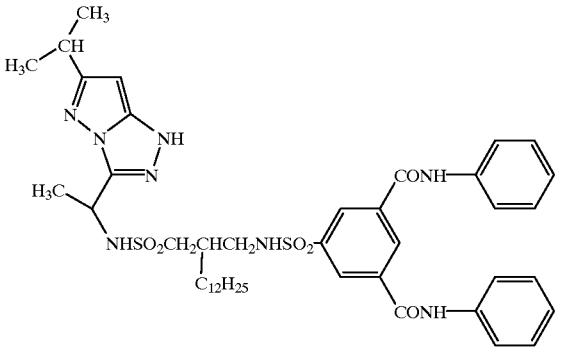
-continued
MC-33
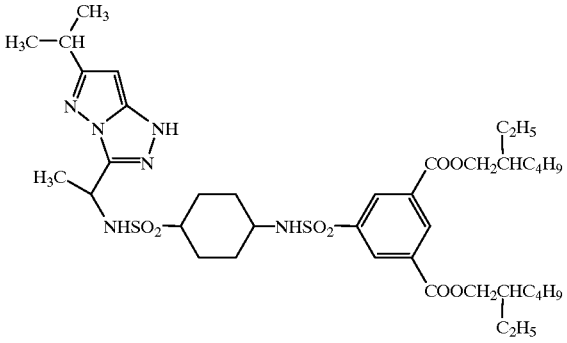
Example compound (MC-34 - MC-36)
MC-34
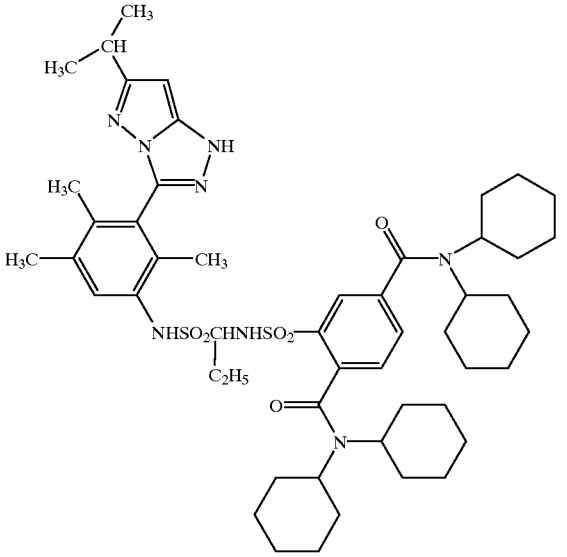
MC-35
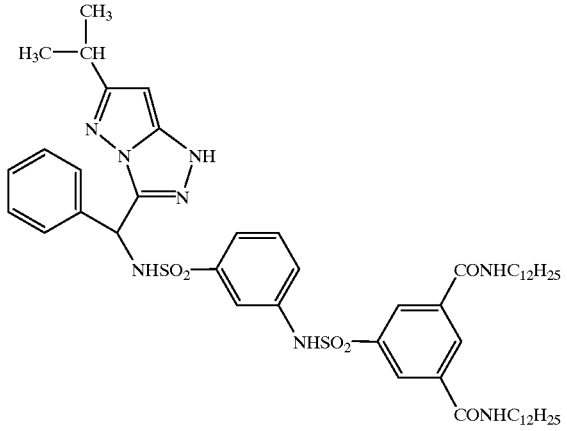

-continued
MC-36
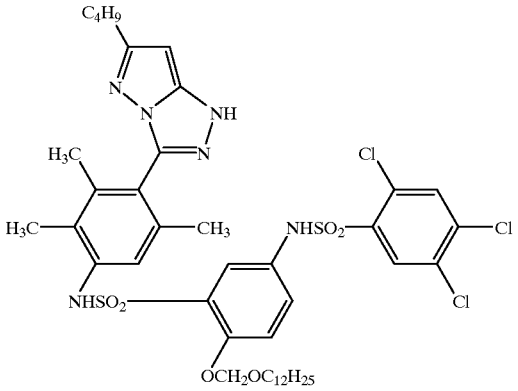
Example compound (MC-37 - MC-39)
MC-37
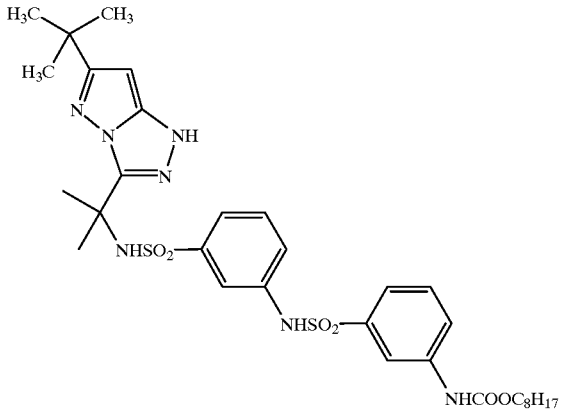
MC-38
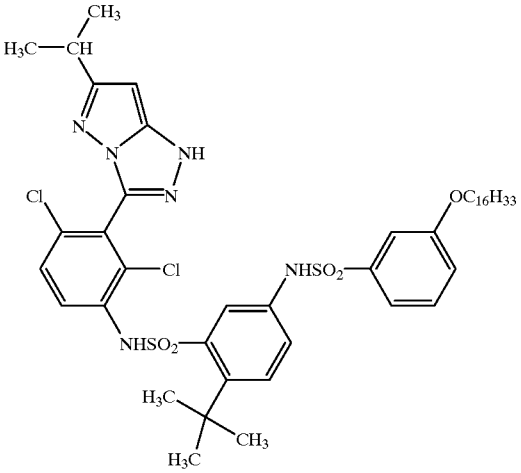
-continued
MC-39
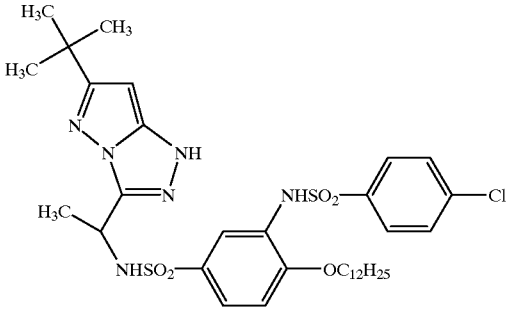
Example compound (MC-40 - MC-42)
MC-40
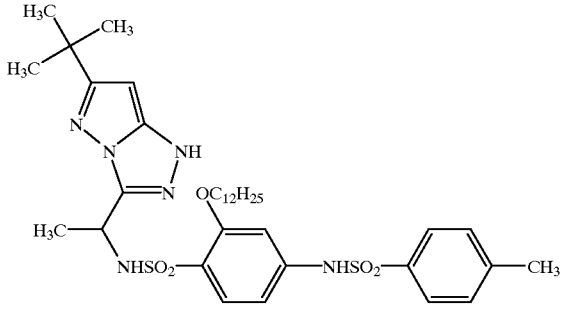
MC-41
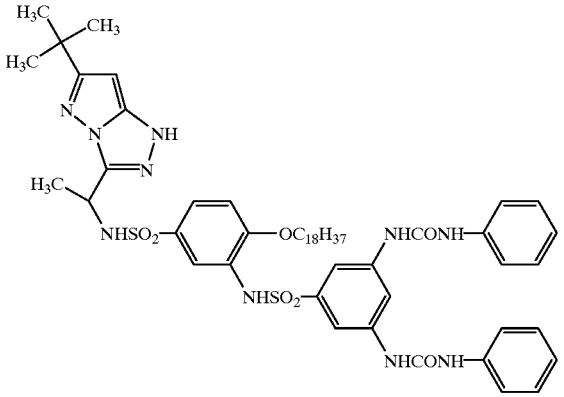
MC-42
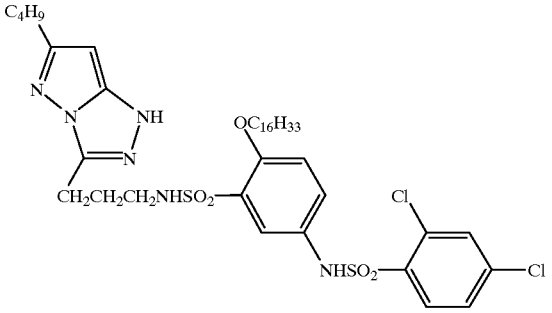

Example compound (MC-43 - MC-45)
MC-43
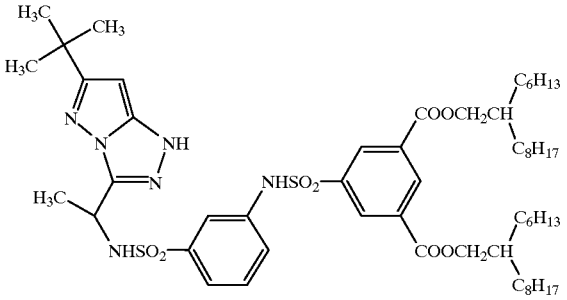
MC-44
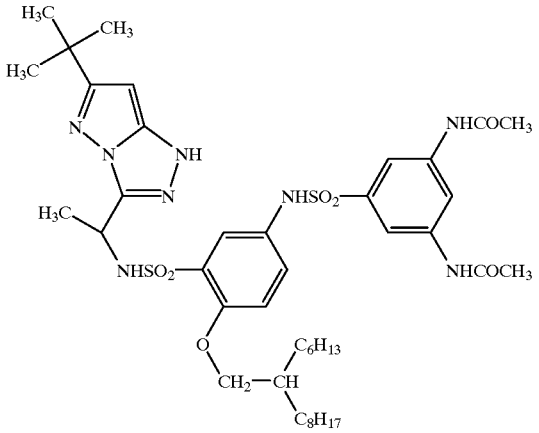
MC-45
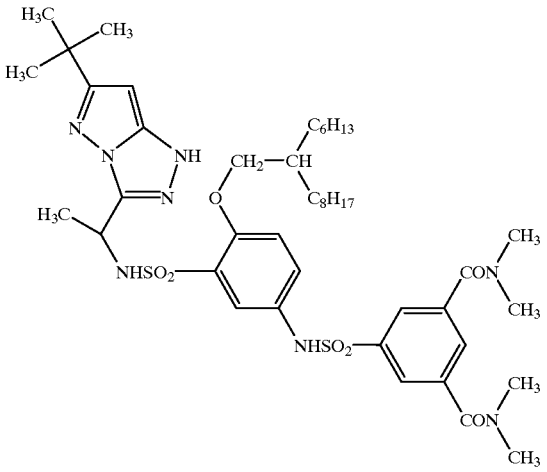
Example compound (MC-46 - MC-48)
MC-46
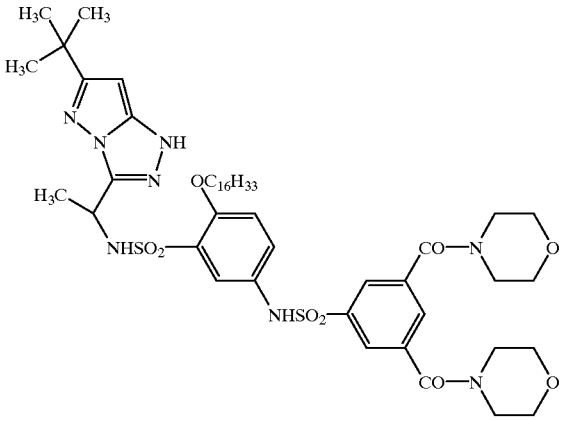
MC-47
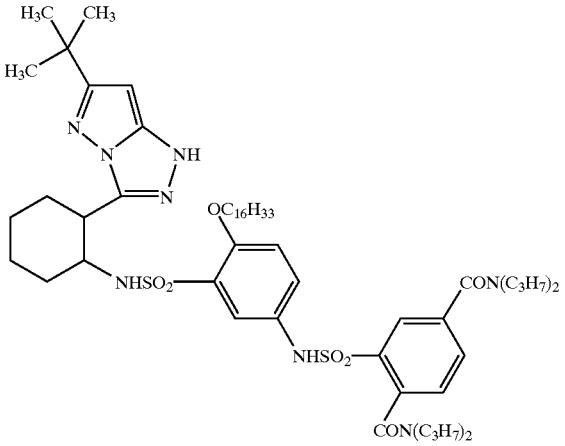
MC-48
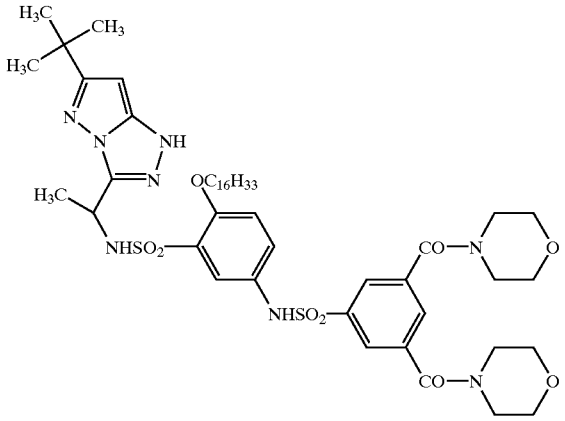

-continued
Example compound (MC-49 - MC-51)
MC-49
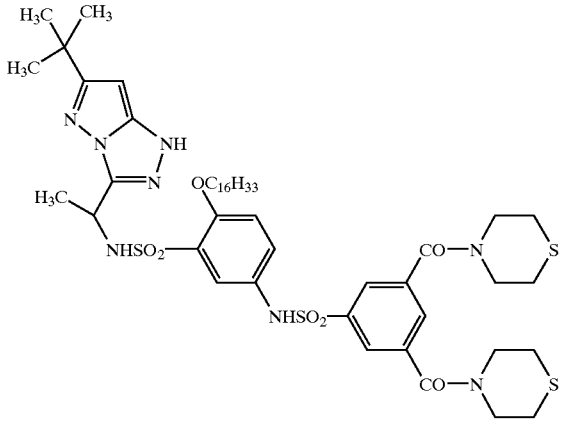
MC-50
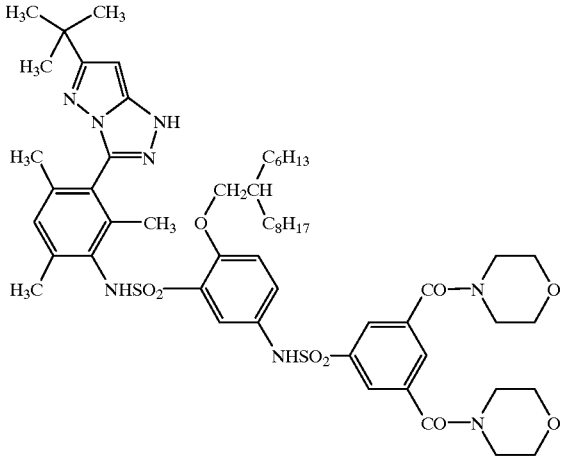
MC-51
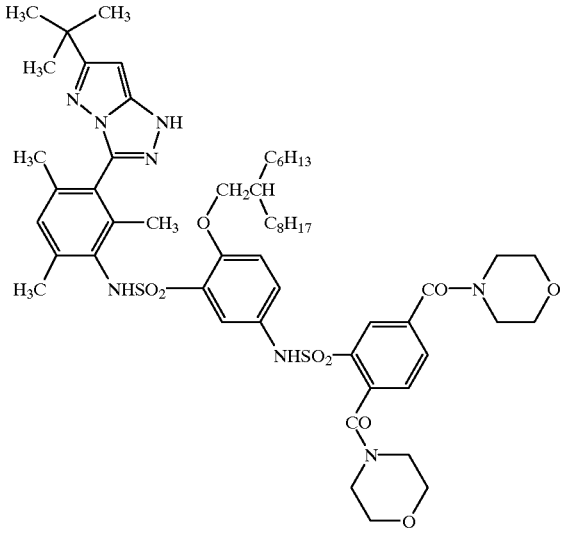
-continued
Example compound (MC-52 - MC-54)
MC-52
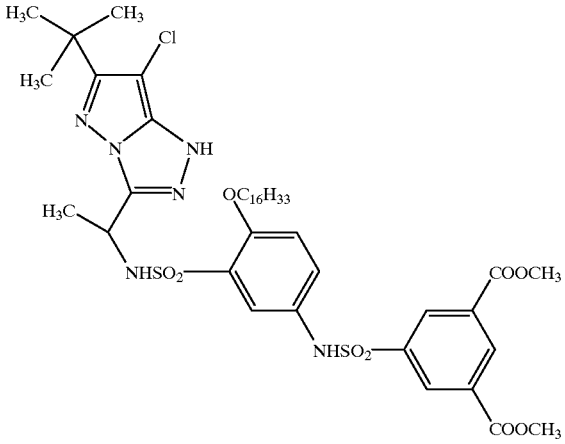
MC-53
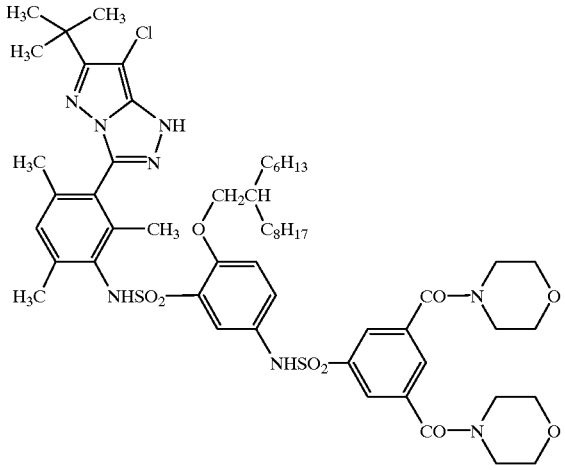
MC-54
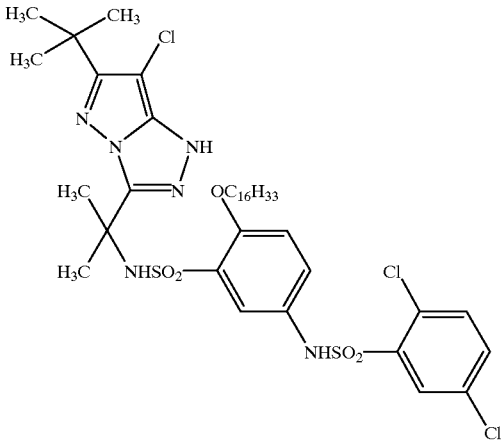

-continued

Example compound (MC-55 - MC-57)

MC-55

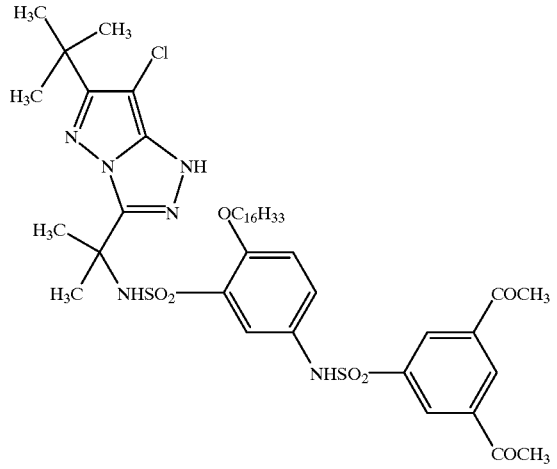

MC-56

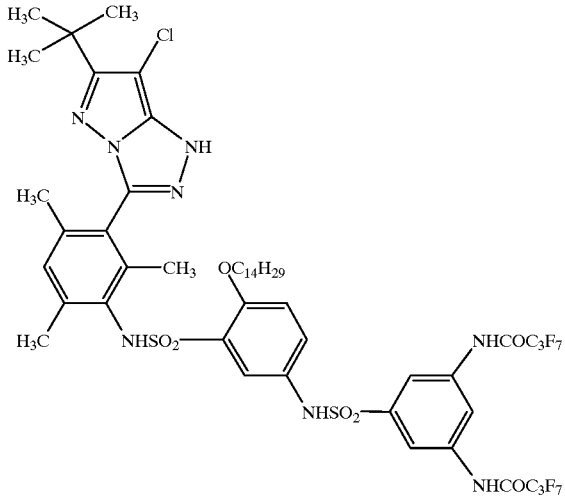

MC-57

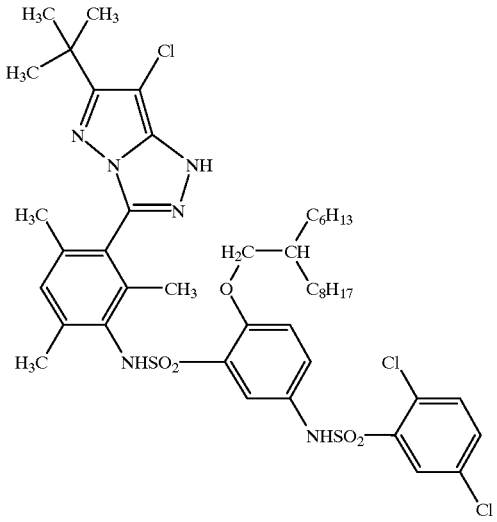

-continued

Example compound (MC-58 - MC-60)

MC-58

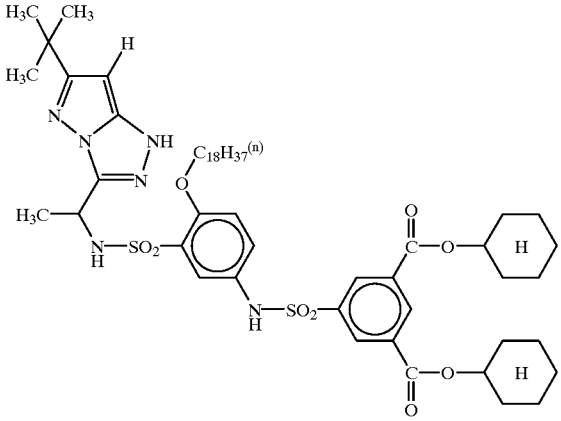

MC-59

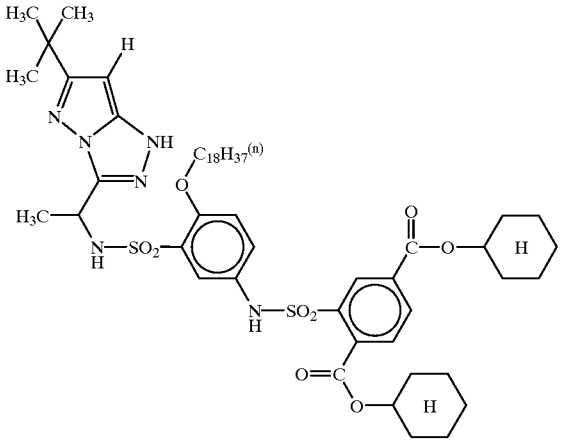

MC-60

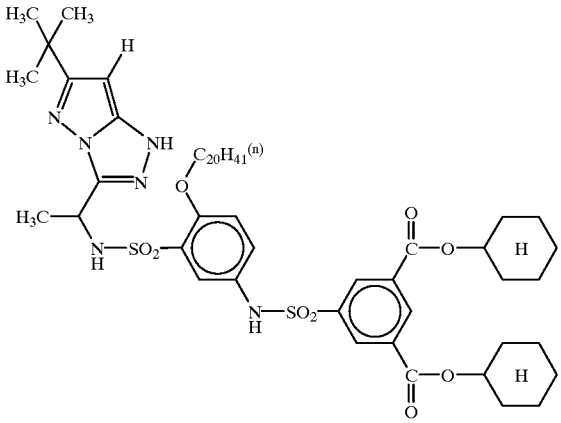

General synthesis methods of magenta couplers of the present invention will be described below. Couplers of the present invention can be synthesized by general methods known in organic synthesis. One synthesis route is shown below as an example. A material 1 in the formula can be readily synthesized by methods described in JP-A's-61-292143 and 10-161285, the disclosures of which are incorporated herein by reference. Intermediates 2 and 4 are prepared by common methods of organic synthesis.

Although synthesis examples 1 to 6 of compounds of the present invention will be described below, the other compounds can also be synthesized by similar methods.

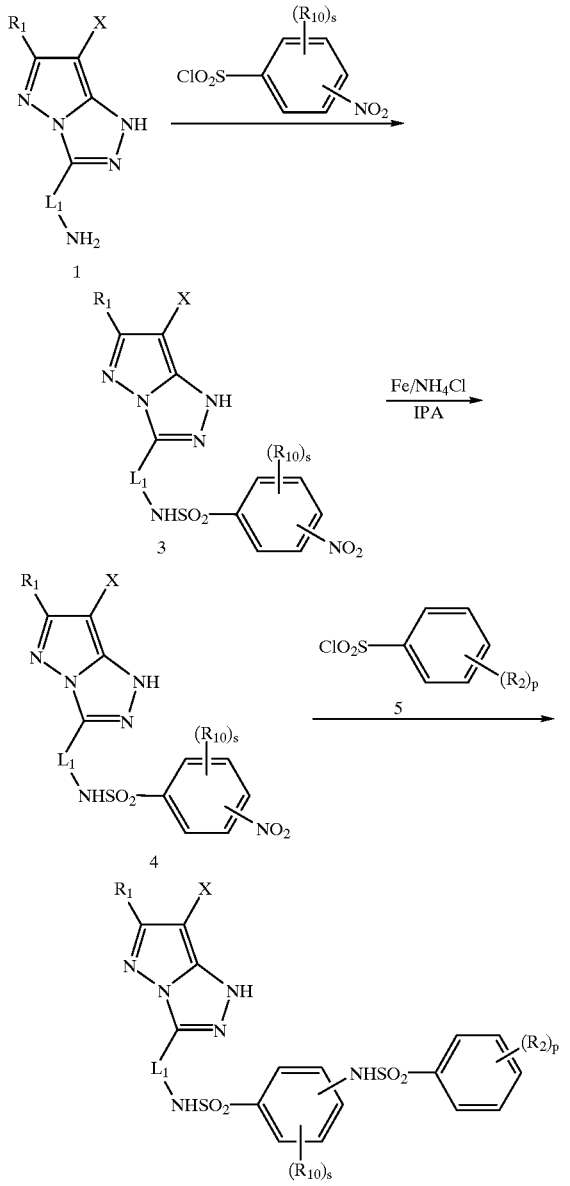

wherein $R_1$, X, $L_1$, $R_{10}$, $R_2$, and p have the same meanings as in formula (M-3).

Synthesis example 1 (Synthesis of Example Compound MC-1)

Synthesis of intermediate A

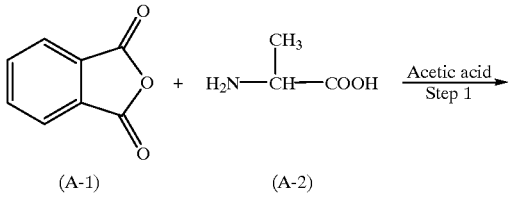

-continued

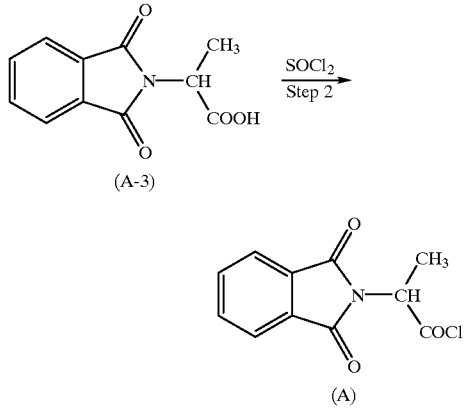

Synthesis of intermediate B

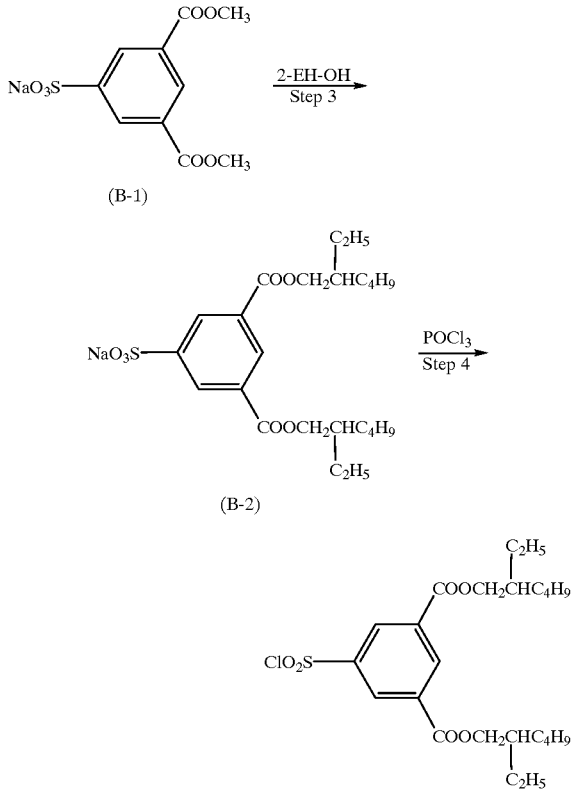

Synthesis of example compound MC-1

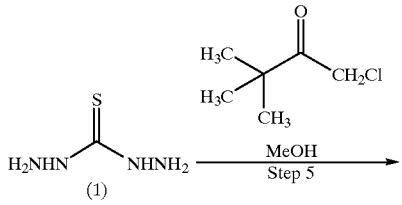

-continued

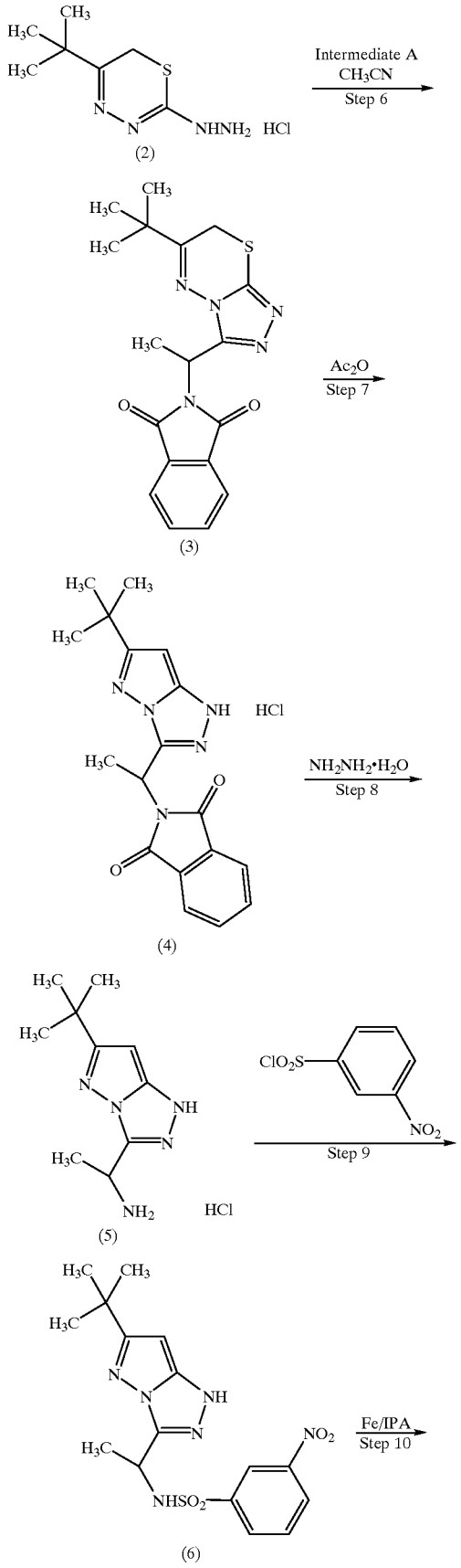

-continued

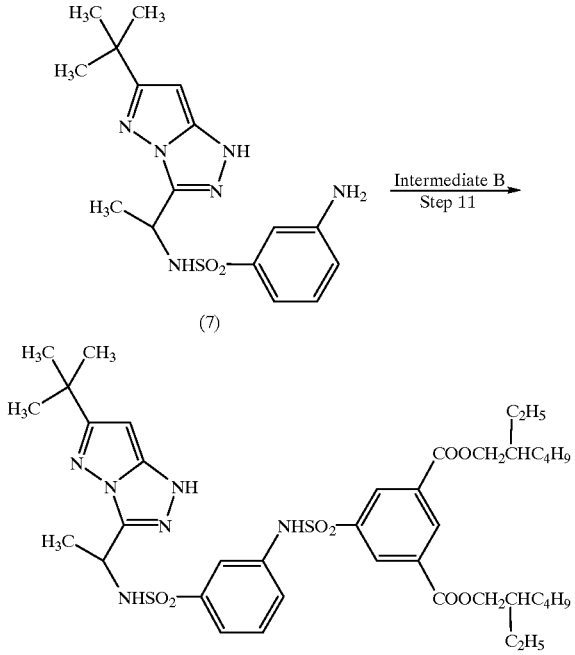

Example compound MC-1

Synthesis of Intermediate (A) (steps 1 & 2)

A mixture of 148.2 g of phthalic anhydride (A-1), 91.7 g of α-alanine (A-2), and 150 mL of acetic acid was refluxed under heating for 2 hr in an oil bath. After the reaction, the reaction solution was cooled to 60° C. and dropped into 500 mL of ice water with stirring. After that, the resultant solution was stirred at 20° C. for 1 hr, and the precipitated crystal was filtered by suction. The obtained crystal was washed with 500 mL of water and dried at 5020 C. to obtain a white crystal weighing 208.3 g of an intermediate (A-3). 0.5 mL of DMF and 150 mL of toluene were added to 150 g of this intermediate (A-3), and the resultant solution was heated to 70° C. under stirring. 74.5 g of thionyl chloride were dropped into the reaction solution over 1 hr, and the solution was allowed to further react for 1 hr. After that, the solvent was distilled off by reduced-pressure concentration to obtain oily matter weighing 162.5 g of an intermediate (A).

Synthesis of Intermediate (B) (steps 3 & 4)

A mixture of 26.4 g of 5-sulfoisophthalic acid dimethyl Na (B-1), 23.2 g of 2-ethylhexyl alcohol, 8.6 g of methanesulfonic acid, 60 mL of toluene, and 30 mL of sulforan was stirred at 140° C. After the mixture was allowed to react for 5 hr, 150 mL of ethyl acetate were added, and the solution was washed twice with 100 mL of water. The organic layer was dried by anhydrous magnesium sulfate and concentrated to obtain coarse oily matter. This coarse oily matter was purified by column chromatography by using a solvent mixture of methylene chloride and ethanol, thereby obtaining oily matter weighing 39.5 g of an intermediate (B-2).

39.5 g of this intermediate (B-2) were dissolved in 150 mL of toluene. 1 mL of DMF and 29.5 mL of phosphorus oxychloride were added to the solution, and the solution was stirred at 100° C. for 3 hr. After the reaction solution was cooled, 150 mL of ethyl acetate were added, and the resultant solution was washed twice with 100 mL of water.

The organic layer was dried by sulfinic Mg anhydride and concentrated to obtain oily matter weighing 30 g of an intermediate (B).

Synthesis of Intermediate (2) (step 5)

141.4 g of 1-chloropinacolone were dropped into a mixture of 106.1 g of thiocarbohydrazide (1) and 500 mL of methyl alcohol under water cooling at 15° C. over 45 min. The water bath was removed, and the solution was allowed to further react for 2 hr and refluxed under heating for 3 hr. Subsequently, the solvent was distilled off under reduced pressure. 500 mL of acetonitrile were added to the concentrated oily matter, and the precipitated crystal was filtered by suction and washed with 150 mL of cold acetonitrile to obtain an intermediate (2) weighing 179.2 g (yield =80.4%).

Synthesis of Intermediate (3) (step 6)

A mixture of 111.4 g of the intermediate (2) and 350 mL of acetonitrile was refluxed under heating. A solution containing 123.4 g of the intermediate (A) and 120 mL of acetonitrile was dropped into the mixture over 2.5 hr. After the resultant solution was further refluxed under heating for 7 hr, the reaction solution was cooled and stirred at 10° C. or less for 1 hr. The precipitated crystal was filtered by suction and washed with 100 mL of cold acetonitrile to obtain hydrochloride weighing 151.5 g of an intermediate (3). This hydrochloride was dispersed in 350 mL of water, and a solution containing 14.6 g of NaOH and 12 mL of water was dropped into the dispersion at 40° C. over 30 min. The resultant solution was cooled after being stirred for 1 hr, and the precipitated crystal was filtered by suction and washed with 200 mL of water to obtain a free body weighing 128.2 g of the intermediate (3).

Synthesis of Intermediate (4) (step 7)

A mixture of 123.2 g of the intermediate (3) and 300 mL of acetic anhydride was refluxed under heating and stirred for 5 hr. After the reaction solvent was distilled off under reduced pressure by an aspirator, 335 mL of acetonitrile and 17 mL of methanol were dropped in this order, and the resultant material was refluxed under heating and dissolved. 57.4 mL of hydrochloric acid were dropped over 30 min, and the solution was further refluxed under heating for 2 hr. The reaction solution was cooled and stirred at 10° C. or less for 1 hr. The precipitated crystal was filtered by suction and washed with 100 mL of cold acetonitrile to obtain a compound (4) weighing 128 g. The purity of the obtained intermediate (4) was 93% (HPLC), and this intermediate contained sulfur produced during ring condensation as an impurity.

Synthesis of Intermediate (5) (step 8)

56.1 g of the intermediate (4) were dispersed in 200 mL of $H_2O$, and the dispersion was heated to 40 to 50° C. A solution containing 5.6 g of NaOH and 10 mL of $H_2O$ was dropped over 10 min. Subsequently, a solution containing 1.7 g of $NaHCO_3$ and 3 mL of $H_2O$ was dropped. After the resultant solution was stirred for 30 min, the reaction solution was filtered by suction and washed with 200 mL of water. A free body of an obtained compound (5) was dispersed in 100 mL of isopropyl alcohol, and the dispersion was stirred and refluxed under heating. 18.8 g of hydrazine monohydrate were dropped over 15 min, and the solution was refluxed under heating for 1 hr. The reaction solution was cooled with water, the produced phthalhydrazide and sulfur were removed by suction filtration, and the filtrate was concentrated. The concentrated oily matter was dissolved in 300 mL of ethyl acetate, and insoluble matter was filtered. The filtrate was cooled to 5° C. or less, and 12.2 g of hydrochloric acid gas were blown into the filtrate over 1 hr. The precipitated hydrochloride of the intermediate (5) was filtered and washed with 50 mL of ethyl acetate, 50 mL of acetone, and 50 mL of ethyl acetate in this order to obtain a light yellow crystal (hydrochloride) weighing 66.9 g (yield =91.5%) of the intermediate (5).

Synthesis of Intermediate (6) (step 9)

A mixture of 56.0 g of the intermediate (5), 104 g of m-nitrobenzenesulfonyl chloride, and 400 mL of acetonitrile was stirred under ice cooling, and 94 mL of triethylamine were dropped at 10° C. or less. The ice bath was removed, and the solution was stirred at room temperature for 1 hr. 500 mL of ethyl acetate and 300 mL of dilute hydrochloric acid water were added to the reaction solution to perform extraction. The organic layer was separated and washed twice with 300 mL of water. This organic layer was dried with anhydrous magnesium sulfate and concentrated to obtain oily matter weighing 128.3 g. This oily matter was dissolved in 40 mL of ethyl acetate, and the solution was dropped into 128 mL of concentrated sulfuric acid at room temperature. The resultant solution was stirred at 60 to 70° C. for 2 hr and poured into a mixture of 500 mL of ice water and 700 mL of ethyl acetate with stirring. This solution was separated, and the organic layer was washed twice with 300 mL of water. This organic layer was dried with anhydrous magnesium sulfate and concentrated to obtain oily matter weighing 95.2 g of an intermediate (6).

Synthesis of Intermediate (7) (step 10)

A mixture of 15 g of reduced iron, 1 g of ammonium chloride, and 5 mL of $H_2O$ was stirred under heating in a steam bath. 1 mL of acetic acid was added, and the resultant solution was stirred for 5 min. After that, 50 mL of isopropyl alcohol were added, and the solution was refluxed under heating for 30 min. A solution containing 15 g of the oily matter of the intermediate (6) and 20 mL of isopropyl alcohol were dropped into the above solution over 30 min, and the resultant solution was further refluxed under heating for 4 hr. The reaction solution was filtered through celite, and the filtrate was concentrated and dissolved in ethyl acetate. The solution was washed twice with 50 mL of water. The organic layer was dried with anhydrous magnesium sulfate and concentrated to obtain oily matter weighing 13.2 g (yield =95.3%i) of an intermediate (7).

Synthesis of Example Compound MC-1 (step 11)

A mixture of 10.9 g of the intermediate (7), 150 mL of acetonitrile, and 14.3 g of a compound B was stirred at room temperature, and 4.9 mL of pyridine were dropped in the mixture over 5 min. The reaction solution was stirred at room temperature for 1 hr, and 100 mL of ethyl acetate were added. The resultant solution was washed twice with 50 mL of dilute hydrochloric acid water and 50 mL of water. The organic layer was dried with anhydrous magnesium sulfate and concentrated to obtain oily matter weighing 23.2 g. This coarse oily matter was purified by column chromatography by using a solvent mixture of hexane and ethyl acetate, thereby obtaining only matter weighing 17.8 g (yield =72.8%) of an example compound MC-1. The structure of this compound was confirmed by NMR and an MS spectrum.

Synthesis Example 2 (Synthesis of Example Compound MC-2)

Synthesis of intermediate C

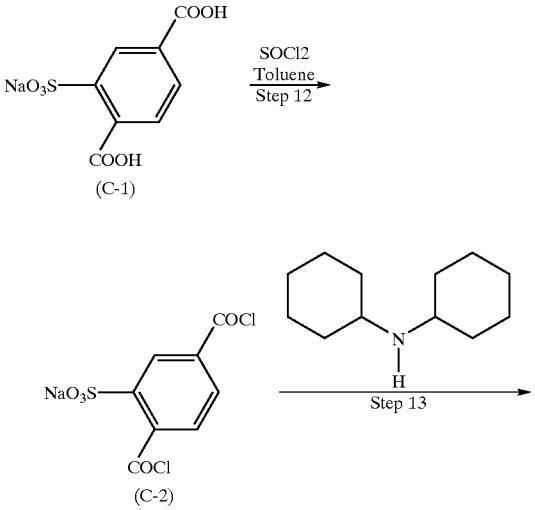

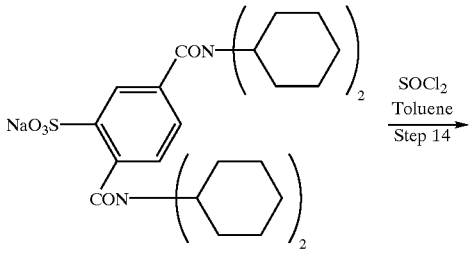

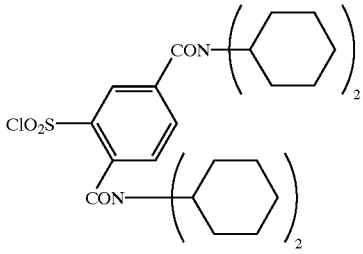

Synthesis of example compound MC-2

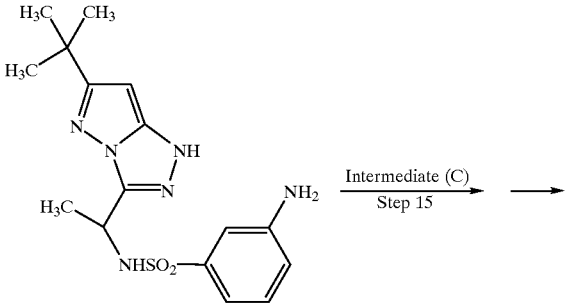

-continued

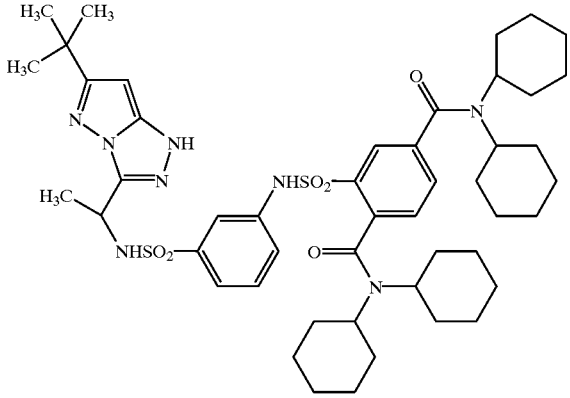

Example compound MC-2

Synthesis of Intermediate (C) (Steps 12, 13, & 14)

A mixture of 53.6 g of 2-sulfoterephthalic acid mono Na (C-1), 200 mL of toluene, 2 mL of DMAC, and 32.1 mL of thionyl chloride was stirred on an oil bath at 100° C. for 5 hr. The toluene and the excess thionyl chloride were distilled off under aspirator reduced pressure. 50 mL of toluene were added, and the resultant solution was distilled off twice by azeotropy. 50 mL of THF were added to the concentrated product, and the resultant solution was stirred at room temperature to obtain a slurry solution of an intermediate (C-2).

This slurry solution was divisionally added little by little to a mixture of 145 g of dicyclohexylamine and 300 mL of THF. After the resultant solution was allowed to react at room temperature for 1 hr, 600 mL of ethyl acetate and 300 mL of dilute hydrochloric acid water were added with stirring. The precipitated white crystal was filtered off, and the organic layer was separated and washed twice with 200 mL of water. This organic layer was dried with anhydrous magnesium sulfate and concentrated to obtain a residue. The residue was crystallized by 250 mL of acetonitrile to obtain a white crystal weighing 38.5 g of an intermediate (C-3).

A mixture of 38.5 g of this intermediate (C-3), 80 mL of toluene, 0.5 mL of DMAC, and 19.2 g of thionyl chloride was stirred at 100° C. for 5 hr. After the reaction solution was cooled, 200 mL of ethyl acetate and 100 mL of water added to perform extraction, and the resultant solution was washed twice with 100 mL of water. The organic layer was dried with anhydrous magnesium sulfate and concentrated to obtain oily matter weighing 45.2 g of the intermediate (C).

Synthesis of example compound MC-2 (step 15)

A mixture of 10.7 g of the compound (7), 200 mL of acetonitrile, and 5 mL of pyridine was stirred at room temperature, and 18 g of the intermediate (C) were dropped in it. After the resultant solution was stirred for 2 hr, 200 mL of ethyl acetate and 75 mL of dilute hydrochloric acid water were added to perform extraction, and the solution was washed twice with 75 mL of water. The organic layer was dried with anhydrous magnesium sulfate and concentrated to obtain oily matter weighing 27.5 g. This oily matter was crystallized by acetonitrile to obtain a white crystal weighing 21.5 g (yield =78.1%, melting point =177 to 180° C.) Of an example compound MC-2. The structure of this compound was confirmed by NMR and an MS spectrum. Synthesis example 3 (synthesis of example compound MC-3)

Synthesis of intermediate D

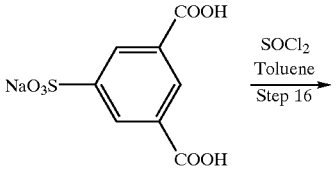

(D-1)

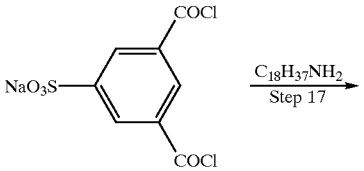

(D-2)

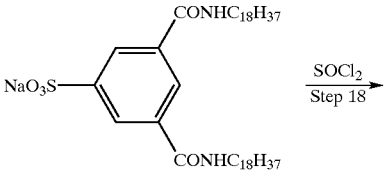

(D-3)

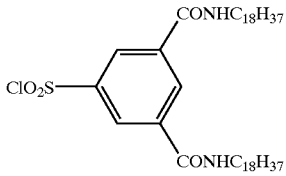

(D)

Synthesis of example compound MC-3

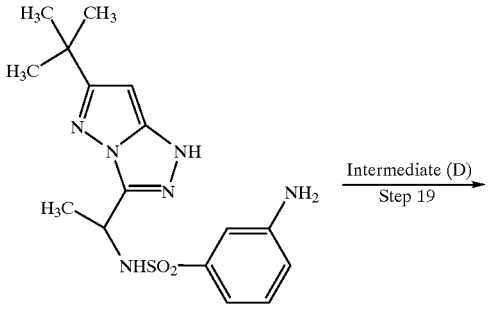

(7)

-continued

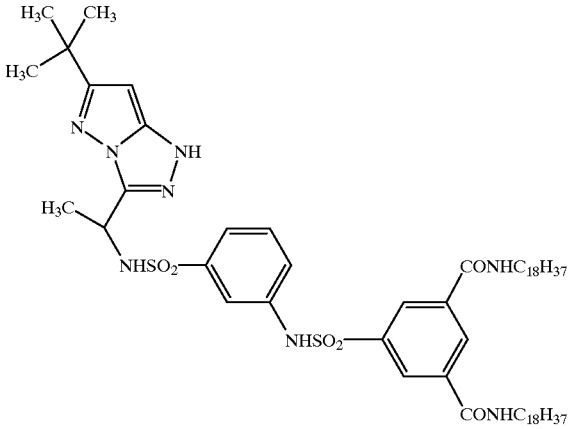

example compound MC-3

Synthesis of Intermediate (D) (Steps 16, 17, & 18)

A mixture of 26.8 g of 5-sulfoisophthalic acid mono Na (D-1), 100 mL of toluene, and 5 mL of DMF was stirred at room temperature, and 16 mL of thionyl chloride were dropped over 30 min. After being stirred at room temperature for 1 hr, the solution was refluxed under heating for 4 hr in an oil bath. The toluene and the excess thionyl chloride were distilled off under aspirator reduced pressure. 50 mL of toluene were added, and the resultant solution was distilled off twice by azeotropy. 50 mL of THF were added to the concentrated product, the resultant solution was stirred at room temperature, and 53.9 g of octadecylamine were added to it. Subsequently, 30.8 mL of triethylamine were dropped, and the reaction solution was stirred at 50° C. for 1 hr and cooled. The precipitated crystal was filtered and washed with dilute hydrochloric acid water and acetonitrile to obtain a crystal weighing 56.4 g of an intermediate (D-3).

56.4 g of this intermediate (D-3) were dispersed in 200 mL of toluene and 5 mL of DMF, and the dispersion was stirred and refluxed under heating in an oil bath. 25 mL of thionyl chloride were dropped over 30 min, and the resultant solution was further stirred under heating for 2 hr. After the reaction solution was cooled, 200 mL of ethyl acetate and 100 mL of water were added to perform extraction, and the solution was washed twice with 100 mL of water. The organic layer was dried with anhydrous magnesium sulfate and concentrated to obtain oily matter. This oily matter was crystallized by methylene chloride and hexane to obtain a white crystal weighing 49.8 g of a compound (D).

Synthesis of Example Compound MC-3 (Step 19)

A mixture of 10.9 g of the intermediate (7), 200 mL of acetonitrile, and 22.6 of the intermediate (D) was stirred at room temperature, and 5 mL of pyridine were dropped in it over 10 min. After that, the resultant solution was heated to 45° C. and allowed to react for 2 hr. 200 mL of ethyl acetate and 75 mL of dilute hydrochloric acid water were added to perform extraction, and the solution was washed twice with 75 mL of water. The organic layer was dried with anhydrous magnesium sulfate and concentrated to obtain oily matter weighing 32.8 g. This oily matter was crystallized by a solvent mixture of acetonitrile and ethanol to obtain a white crystal weighing 27.9 g (yield=85%, melting point=65 to 70° C.) Of an example compound MC-3. The structure of this compound was confirmed by NMR and an MS spectrum. Synthesis example 4 (synthesis of example compound MC-4)

Synthesis of intermediate E

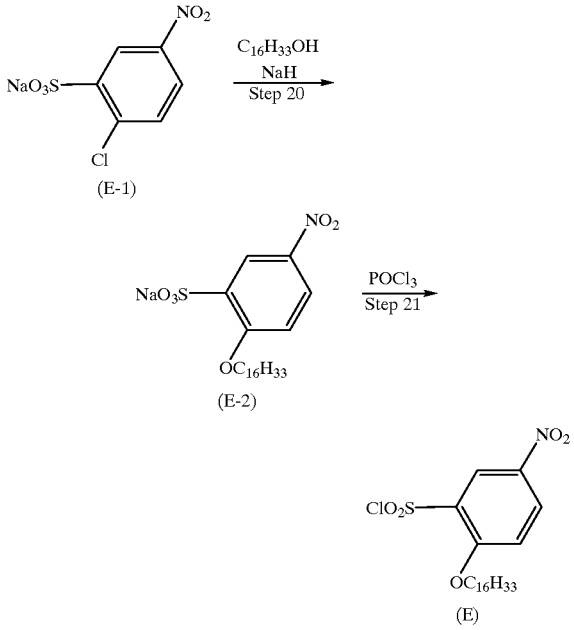

Synthesis of example compound MC-4

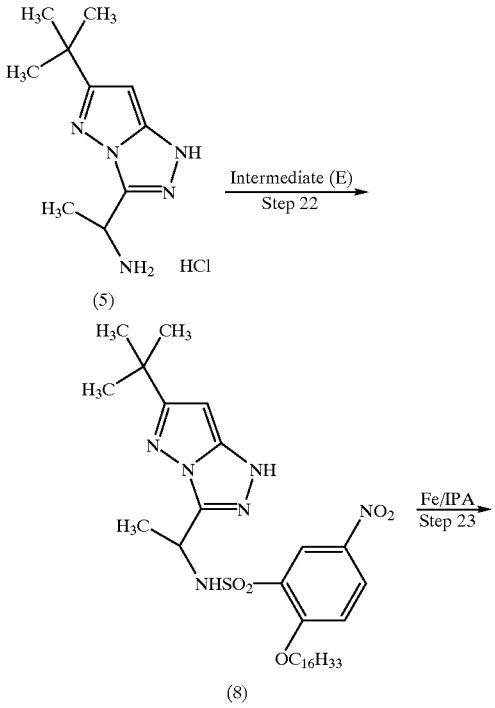

-continued

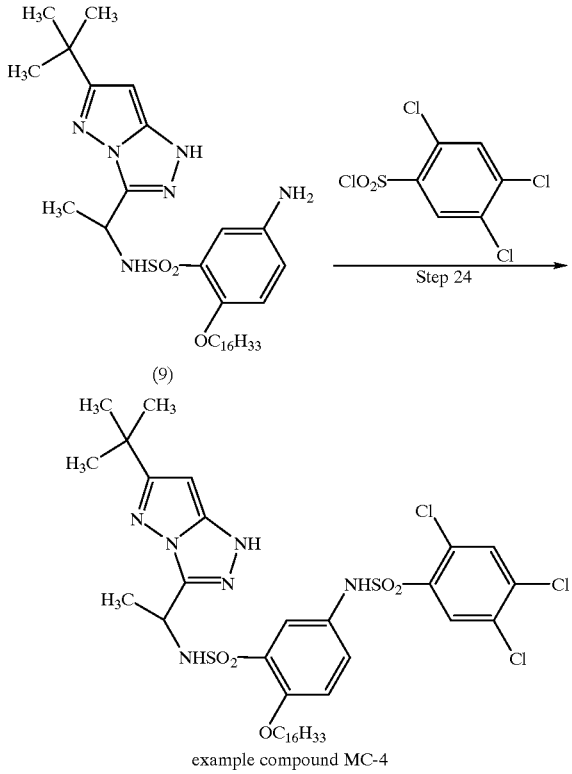

example compound MC-4

Synthesis of Intermediate (E) (Steps 20 & 21)

A mixture of 121 g of hexadecyl alcohol, 21 g of NaH (60%), and 200 mL of THF was stirred and refluxed under heating for 2 hr. After the THF was distilled off under reduced pressure, 200 mL of DMAC were added, and the resultant solution was stirred at room temperature. 130 g of 5-nitro-2-chlorobenzenesulfonic acid Na (E-1) were added to the solution over 15 min. After being stirred at room temperature for 1 hr, the solution was gradually heated to 80° C. and again stirred for 1 hr. After 500 mL of ethyl acetate were added, the reaction solution was poured into ice water to separate the organic layer, and the organic layer was washed twice with 150 mL of dilute hydrochloric acid water and 150 mL of water. This organic layer was dried with anhydrous magnesium sulfate and concentrated to obtain oily matter. This oily matter was dispersed in acetone to obtain a precipitated crystal weighing 186 g of an intermediate (E-2).

A mixture of 56.2 g of this intermediate (E-2), 200 mL of acetonitrile, 1 mL of DMF, and 36.9 g of phosphorus oxychloride was refluxed under heating for 1 hr. The reaction solution was cooled, and 300 mL of ethyl acetate were added. After that, the reaction solution was poured into ice water to separate the organic layer, and the organic layer was washed twice with 150 mL of dilute hydrochloric acid water and 150 mL of water. This organic layer was dried with anhydrous magnesium sulfate and concentrated to obtain oily matter. This oily matter was crystallized by hexane to obtain a white crystal weighing 50.6 g of an intermediate (E).

Synthesis of Intermediate (8) (step 22)

A mixture of 26.0 g of the intermediate (5), 98.5 g of the intermediate (E), and 300 mL of acetonitrile was cooled with ice and stirred, and 97 mL of triethylamine were dropped at 10° C. or less. The ice bath was removed, and the resultant solution was stirred at room temperature for 1 hr. 500 mL of ethyl acetate and 300 mL of dilute hydrochloric acid water were added to the reaction solution to perform extraction. The organic layer was separated and washed twice with 300 mL of water. This organic layer was dried with anhydrous magnesium sulfate and concentrated to obtain oily matter weighing 113 g. This oily matter was dissolved in 50 mL of ethyl acetate, and 150 mL of concentrated sulfuric acid were dropped into the solution at room temperature. After the reaction solution was stirred at 60 to 70° C. for 2 hr, 700 mL of ethyl acetate were added, and the resultant solution was poured into 500 mL of ice water with stirring. This solution was separated, and the organic layer was washed twice with 300 mL of water. This organic layer was dried with anhydrous magnesium sulfate and concentrated to obtain oily matter weighing 98 g. This oily matter was purified by column chromatography by using a solvent mixture of hexane and ethyl acetate to obtain oily matter weighing 48 g of an intermediate (8).

Synthesis of Intermediate (9) (Step 23)

A mixture of 50 g of reduced iron, 1 g of ammonium chloride, and 25 mL of $H_2O$ was stirred at 90° C. in a steam bath. 1 mL of acetic acid was added, and the resultant solution was stirred for 5 min. After that, 300 mL of isopropyl alcohol were added, and the solution was refluxed under heating for 30 min. A solution containing 48 g of the oily matter of the intermediate (8) and 50 mL of isopropyl alcohol was dropped into the resultant solution over 30 min, and the solution was further refluxed under heating for 4 hr. The reaction solution was filtered through celite, the filtrate was concentrated and dissolved in ethyl acetate, and the solution was washed twice with 50 mL of water. The organic layer was dried with anhydrous magnesium sulfate and concentrated to obtain oily matter weighing 39 g (yield= 85%) of an intermediate (9).

Synthesis of Example Compound MC-4 (Step 24)

A mixture of 12 g of the intermediate (9), 100 mL of acetonitrile, 50 mL of THF, and 5.9 g of 2,4,5-trichlorobenzenesulfonyl chloride was stirred at room temperature. 3.0 mL of triethylamine were dropped over 5 min, and the reaction solution was stirred at room temperature for 1 hr. 100 mL of ethyl acetate were added, and the resultant material was washed twice with 50 mL of dilute hydrochloric acid water and 50 mL of water. The organic layer was dried with anhydrous magnesium sulfate and concentrated to obtain oily matter weighing 16.8 g. This coarse oily matter was purified by column chromatography by using a solvent mixture of hexane and ethyl acetate. The obtained oily matter weighing 12.3 g was crystallized by a solvent mixture of hexane and ethyl acetate to obtain a white crystal weighing 9.8 g (yield=57.9%, melting point=160 to 166° C.) Of an example compound MC-4. The structure of this compound was confirmed by NMR and an MS spectrum.

Synthesis Example 5 (Synthesis of Example Compound MC-5)

A mixture of 12 g of the intermediate (9), 100 mL of acetonitrile, 50 mL of THF, and 6.15 g of 3,5-dimethoxycarbonylbenzenesulfonyl chloride was stirred at room temperature. 3.0 mL of triethylamine were dropped over 5 min, and the reaction solution was stirred at room temperature for 1 hr. 100 mL of ethyl acetate were added, and the resultant material was washed twice with 50 mL of dilute hydrochloric acid water and 50 mL of water. The organic layer was dried with anhydrous magnesium sulfate and concentrated to obtain oily matter weighing 16.8 g. This coarse oily matter was purified by column chromatography by using a solvent mixture of hexane and ethyl acetate to obtain oily matter weighing 12.1 g (yield =71.1%) of an example compound MC-5. The structure of this compound was confirmed by NMR and an MS spectrum. Synthesis example 6 (synthesis of example compound MC-15)

10.9 g of MC-3 were dissolved in 50 mL of ethyl acetate, and 19.05 g of N-chlorosuccinimide were added to the solution. After being stirred at room temperature for 1 hr, the reaction solution was washed twice with 50 mL of water, and the organic layer was dried with anhydrous magnesium sulfate and concentrated to obtain oily matter weighing 11.3 g. This coarse oily matter was purified by column chromatography by using a solvent mixture of hexane and ethyl acetate to obtain oily matter weighing 9.55 g (yield=84.6%) of an example compound MC-15. The structure of this compound was confirmed by NMR and an MS spectrum.

It is possible for the magenta coupler of the present invention to be introduced into a photographic light-sensitive material by various known dispersion methods. An oil-in-water dispersion method is desirable, in which the magenta coupler of the present invention is dissolved in an high-boiling organic solvent (a low-boiling organic solvent being used together, if necessary) and dispersed in gelatin solution to obtain an emulsion. The resultant material is added to the silver halide emulsion.

The high-boiling organic solvent, which are used in the oil-in-water dispersion method, are exemplified in, for example, U.S. Pat. No. 2,322,027, the disclosure of which is incorporated herein by reference.

The high-boiling organic solvents, which can be used in the oil-in-water dispersion method, include, for example, phthalic acid esters such as dibutyl phthalate, dioctyl phthalate, dicyclohexyl phthalate, bis (2-ethylhexyl) phthalate, decyl phthalate, and bis (2,4-di-tert-amylphenyl) isophthalate, bis (1,1-diethylpropyl) phthalate; esters of phosphoric acid or phosphonic acid such as diphenyl phosphate, triphenyl phosphate, tricresyl phosphate, 2-ethylhexyl diphenyl phosphate, dioctyl butyl phosphate, tricyclohexyl phosphate, tri-2-ethyhexyl phosphate, tridecyl phosphate, and bis (2-ethylhexyl) phenyl phosphate; benzoic acid esters such as 2-ethyhexyl benzoate, 2,4-dichlorobenzoate, tridecyl benzoate, and 2-ethylhexyl-p-hydroxy benzoate; amides such as N,N-diethyl dodecane amide, N,N-diethyl urarylamide, N,N,N,N-tetrakis (2-ethylhexyl) isophbthalic acid amide; alcohols or phenols such as isostearyl alcohol, and 2,4-di-tert-amyl phenol; aliphatic esters such as dibutoxyethyl succinate, bis (2-ethylhexyl) succinate, 2-hexyldecyl tetradecanoate, tributyl citrate, dibutyl azelate, isostearyl lactate, and trioctyl tosilate; aniline derivatives such as N,N-dibutyl-2-butoxy-5-tert-octyl aniline; chlorinated paraffin containing 10 to 80% of chlorine; trimesinic acid esters such as tributyl trimesinate; dodecyl benzene; diisopropyl naphthalene; phenols such as 2,4-di-tert-amylphenol, 4-dodecyloxy phenol, 4-dodecyloxy carbonyl phenol, and 4-(4-dodecyloxy phenyl sulfonyl) phenol; carboxylic acids such as 2-(2,4-di-tert-amylphenoxy lactic acid, and 2-ethoxyoctane decanoic acid; and alkyl phosphoric acids such as bis (2-ethylhexyl) phosphoric acid and diphenyl phosphoric acid. In addition to the high- boiling organic solvents exemplified above, it is also possible to use the compounds disclosed in, for example, JP-A-6-258803, the disclosure of which is incorporated herein by reference, as high-boiling organic solvents.

Among the compounds exemplified above, it is desirable to use as the high-boiling organic solvent phosphoric acid esters, amides and aliphatic esters singly or in combination with aniline derivatives.

It is desirable for the mass ratio of the high-boiling organic solvent to the coupler of the present invention to fall within a range of between 0 and 1.0, preferably between 0 and 0.5, and particularly preferably between 0 and 0.2. Also, it is possible to use as an auxiliary solvent an organic solvent having a boiling point not lower than 30° C. and not higher than about 160° C. such as ethyl acetate, butyl acetate, ethyl propionate, methyl ethyl ketone, cyclohexanone, 2-ethoxyethyl acetate or dimethyl formamide together with the high-boiling organic solvent described above.

It is desirable for the coupler of the present invention to be present together with a polymer soluble in an organic solvent. Such a dispersion is described in, for example, PCT International Laid-open Application WO88/00723, JP-A's-63-44658, 63-44658, 63-250648, 64-537, 1-179944, 2-230240, and 7-104449, the disclosures of which are incorporated herein by reference.

The photographic light-sensitive material of the present invention is featured in that at least one magenta coupler represented by formulas (M-1) to (M-4) is contained in at least one silver halide emulsion layer.

The total amount of the couplers used of the present invention, i.e., the couplers represented by formulas (M-1) to (M-4), which are contained in the photographic light-sensitive material of the present invention, is desirably 0.01 g and 10 g, more desirably 0.1 g and 2 g per $m^2$, and is desirably $1\times10^{-3}$ mol to 1 mol, more desirably $3\times10^{-3}$ mol to $3\times10^{-1}$ mol per mol of the silver halide contained in the same photosensitive emulsion layer.

Where the photosensitive layer is of a unit structure consisting of at least two photosensitive emulsion layers differing from each other in sensitivity, it is desirable for the amount of the coupler used in the present invention to be $2\times10^{-3}$ mol to $2\times10^{-1}$ mol per mol of the silver halide in the low-speed layer and to be $3\times10^{-2}$ mol to $3\times10^{-1}$ mol per mol of the silver halide in the layers except for the low-speed layer.

The couplers represented by the formulas (M-1) to (M-4) are used in the present invention. However, it is also possible to use another coupler in combination with the couplers represented by the formulas noted above. It should be noted, however, that a desired result obtained in the present invention can be promoted with increase in the degree of contribution of the color developing pigment of the coupler of the present invention to the total concentration of the pigment that develops substantially the same color. To be more specific, it is desirable to use the coupler defined in the present invention in an amount that permits the contribution to the color developing concentration to be at least 30%, preferably to be at least 50%, and further preferably to be at least 70%.

In a light-sensitive material of the present invention, at least one sensitive layer need only be formed on a support. A typical example is a silver halide photographic light-sensitive material having, on a support, at least one sensitive layer consisting of a plurality of silver halide emulsion layers sensitive to substantially the same color but different in sensitivity. This sensitive layer is a unit sensitive layer sensitive to one of blue light, green light, and red light. In a multilayered silver halide color photographic light-sensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RLIRH.

In addition, as described in Jpn. Pat. Appln. KOKOKU Publication No. (hereinafter referred to as JP-B-)55-34932, layers can be arranged in the order of a blue-sensitive layer/GH/RH/GL/RL from the one farthest from a support. Furthermore, as described in JP-A's-56-25738 and 62-63936, layers can be arranged in the order of a blue-sensitive layer/(3L/RL/GH/RH from the one farthest from a support.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464.

In addition, the order of a high-speed emulsion layer/low-speed emulsion layer/mediun-speed emulsion layer or low-speed emulsion layer/medium-speed emulsion layer/high-speed emulsion layer can be used. Furthermore, the arrangement can be changed as described above even when four or more layers are formed.

To improve the color reproducibility, as described in U.S. Pat. Nos. 4,663,271, 4,705,744, 4,707,436, and JP-A's-62-160448 and 63-89850, the disclosures of which are incorporated herein by reference, a donor layer (CL) with an interlayer effect, which has a different spectral sensitivity distribution from that of a main sensitive layer such as BL, GL, or RL, is preferably formed adjacent to, or close to, this main sensitive layer.

A silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 μm or less or large grains having a projected area diameter of about 10 μm, and an emulsion can be either a polydisperse or monodisperse emulsion.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. Nos. 3,574,628, 3,655,394, and GB1,413,748, the disclosures of which are incorporated herein by reference, are also favorable. Talbular grains having an aspect ratio of about 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17643, 18716, and 307105, the disclosures of which are incorporated herein by reference, and they are summarized in a table to be presented later.

In a light-sensitive material of the present invention, it is possible to mix, in the same layer, two or more types of emulsions different in at least one of the characteristics, i.e., the grain size, grain size distribution, halogen composition, grain shape, and sensitivity, of a photosensitive silver halide emulsion.

It is also possible to preferably use surface-fogged silver halide grains described in U.S. Pat. No. 4,082,553, the disclosure of which is incorporated herein by reference, internally fogged silver halide grains described in U.S. Pat. No. 4,626,498 and JP-A-59-214852, the disclosures of which are incorporated herein by reference, and colloidal silver, in photosensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A, method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-light-sensitive, fine-grain silver halide. The non-light-sensitive, fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol%, and silver chloride and/or silver iodide can be added if necessary. The fine-grain silver halide preferably contains 0.5 to 10 mol % of silver iodide. The average grain size (the average value of the equivalent-circle diameters of projected areas) of the fine-grain silver halide is preferably 0.01 to 0.5 μm, and more preferably, 0.02 to 2 μm.

The non-light-sensitive, fine-grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this layer containing fine silver halide grains.

The silver coating amount of a light-sensitive material of the present invention is preferably 6.0 g/m$^2$ or less, and most preferably, 4.5 g/m$^2$ or less.

Photographic additives usable in the present invention are also described in RDS, and the relevant portions are summarized in the following table.

| | Additives | RD17643 | RD18716 |
|---|---|---|---|
| 1. | Chemical sensitizers | page 23 | page 648, right column |
| 2. | Sensitivity increasing agents | | do |

-continued

| | | | |
|---|---|---|---|
| 3. | Spectral sensitizers, super sensitizers | pages 23–24 | page 648, right column to page 649, right column |
| 4. | Brighteners | page 24 | page 647, right column |
| 5. | Light absorbents, filter dyes, ultraviolet absorbents | pages 25–26 | page 649, right column to page 650, left column |
| 6. | Binders | page 26 | page 651, left column |
| 7. | Plasticizers, lubricants | page 27 | page 650, right column |
| 8. | Coating aids, surface active agents | pages 26–27 | do |
| 9. | Antistatic agents | page 27 | do |
| 10. | Matting agents | | |

| | Additives | RD307105 |
|---|---|---|
| 1. | Chemical sensitizers | page 866 |
| 2. | Sensitivity increasing agents | |
| 3. | Spectral sensitizers, super sensitizers | pages 866–868 |
| 4. | Brighteners | page 868 |
| 5. | Light absorbent, filter dye, ultraviolet absorbents | page 873 |
| 6. | Binder | pages 873–874 |
| 7. | Plasticizers, lubricants | page 876 |
| 8. | Coating aids, surface active agents | pages 875–876 |
| 9. | Antistatic agents | pages 876–877 |
| 10. | Matting agent | pages 878–879 |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, the disclosures of which are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat. No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of a compound which releases a photographically useful group are as follows. Development inhibitor release compounds: compounds (particularly T-101 (page 30), T-1.04 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferred examples of additives other than couplers are as follows.

Dispersants of oil-soluble organic compounds: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of oil-soluble organic compounds: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No.

4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11and F-II-8 on pages 33 to 55 of EP445627A, III-1 to III-36, particularly III-1 and III-3 on pages 17 to 28 of EP457153A, fine-crystal dispersions of Dye-1 to Dye-124 on pages 8 to 26 of W088/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

The present invention can be applied to various color light-sensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784.

A support which can be suitably used in the present invention is described in, e.g., RD. No. 17643, page 28, RD. No. 18716, page 647, right column to page 648, left column, and RD. No. 307105, page 879, the disclosures of which are incorporated herein by reference.

In a light-sensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in *Photogr. Sci. Eng.,* A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness—film thickness)/film thickness.

In a light-sensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A light-sensitive material according to the present invention can be developed by conventional methods described in RD. No. 17643, pp. 28 and 29, RD. No. 18716, page 651, left to right columns, and RD No. 307105, pp. 880 and 881.

Color negative film processing solutions used in the present invention will be described below.

Compounds described in JP-A-4-121739, page 9, upper right column, line 1 to page 11, lower left column, line 4, the disclosure of which is incorporated herein by reference, can be used in a color developer of the present invention. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, or 2-methyl-4-[N-ethyl-N-(4-hydroxybutyl)amino]aniline is preferred.

The use amount of any of these color developing agents is preferably 0.01 to 0.08 mol, more preferably, 0.015 to 0.06 mol, and most preferably, 0.02 to 0.05 mol per liter (to be referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxylalkyl group, sulfoalkyl group, or carboxyalkyl group is preferable. Examples are N,N-di(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these derivatives, N,N-di(sulfoethyl)hydroxylamine is particularly preferred. Although these derivatives can be used together with hydroxylamine, it is preferable to use one or two types of these derivatives instead of hydroxylamine.

The use amount of a preservative is preferably 0.02 to 0.2 mol, more preferably, 0.03 to 0.15 mol, and most preferably, 0.04 to 0.1 mol per L. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L. Sulfite is preferably used at a concentration 1.1 to 3 times the above concentration in a replenisher.

The pH of a color developer is preferably 9.8 to 11.0, and more preferably, 10.0 to 10.5. In a replenisher, the pH is preferably set to be higher by 0.1 to 1.0 than these values. To stably maintain this pH, a known buffering agent such as carbonate, phosphate, sulfosalicylate, or borate is used. The replenishment rate of a color developer is preferably 80 to 1,300 mL per $m^2$ of a light-sensitive material. However, the replenishment rate is preferably smaller in order to reduce environmental pollution. For example, the replenishment rate is preferably 80 to 600 mL, and more preferably, 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into the color developer from 1 $m^2$ of a light-sensitive material when the sensitive material is color-developed V: the replenishment rate (L) of the color developer replenisher for 1 $m^2$ of the light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6, the disclosures of which are incorporated herein by reference, can be applied to a processing solution having bleaching capacity in the present invention. This bleaching agent preferably has an oxidation-reduction potential of 150 mV. Favored practical examples of the bleaching agent are described in JP-A's-5-72694 and 5-173312, the disclosures of which are incorporated herein by reference. In particular, 1,3-diaminopropane tetraacetic acid and ferric complex salt of a compound as practical example 1 in JP-A-5-173312, page 7 are preferred.

To improve the biodegradability of a bleaching agent, it is preferable to use compound ferric complex salts described in JP-A-4-251845, JP-A-4-268552, EP588,289, EP591,934, and JP-A-6-20 8213, the disclosures of which are incorporated herein by reference, as the bleaching agent. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$C_{T}\times(V_1+V_2)/V_1+C_P$$

where $C_R$: the concentrations of components in a replenisher $C_T$: the concentrations of components in a mother solution (processing tank solution)

$C_P$: the concentrations of components consumed during processing $V_1$:the replenishment rate (mL) of a replenisher having bleaching capacity per $m^2$ of a light-sensitive material $V_2$:an amount (mL) carried over from a pre-bath by $m^2$ of the light-sensitive material Additionally, a bleaching solution preferably contains a pH buffering agent, and more preferably contains succinic acid, maleic acid, malonic acid, glutaric acid, adipic acid, or dicarboxylic acid with little odor. Also, the use of known bleaching accelerators described in JP-A-53-95630, RD No.17129, and U.S. Pat. No. 3,893,858, the disclosures of which are incorporated herein by reference, is preferable.

It is preferable to replenish 50 to 1,000 mL of a bleaching replenisher to a bleaching solution per $m^2$ of a light-sensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19, the disclosures of which are incorporated herein by reference, can be applied to a processing solution with fixing capacity.

To improve the fixing rate and preservability, compounds represented by formulas (I) and (II) described in JP-A-6-301169, the disclosure of which is incorporated herein by reference, are preferably added singly or together to a processing solution with fixing capacity. To improve the preservability, the use of sulfinic acid such as p-toluenesulfinate described in JP-A-1-224762, the disclosure of which is incorporated herein by reference is also preferable. To improve the desilvering characteristics, ammonium is preferably used as a cation in a solution with bleaching capacity or in a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059, the disclosure of which is incorporated herein by reference.

The replenishment rate of a replenisher in the bleach-fixing or fixing step is preferably 100 to 1,000 mL, more preferably, 150 to 700 mL, and most preferably, 200 to 600 mL per $m^2$ of a light-sensitive material. In the bleach-fixing or fixing step, an appropriate silver collecting apparatus is preferably installed either in-line or off-line to collect silver.

When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferred.

Contents described in aforementioned JP-A-4-125558, page 12, lower right column, line 6 to page 13, lower right column, line 16 can be preferably applied to the washing and stabilization steps. To improve the safety of the work environment, it is preferable to use azolylmethylamines described in EP504,609 and EP519,190 or N-methylolazoles described in JP-A-4-362943, the disclosures of which are incorporated herein by reference, instead of formaldehyde in a stabilizer and to make a magenta coupler divalent to form a solution of surfactant containing no image stabilizing agent such as formaldehyde. To reduce adhesion of dust to a magnetic recording layer formed on a light-sensitive material, a stabilizer described in JP-A-6-289559, the disclosures of which are incorporated herein by reference, can be preferably used.

The replenishment rate of washing water and a stabilizer is preferably 80 to 1,000 mL, more preferably, 100 to 500 mL, and most preferably, 150 to 300 mL per $m^2$ of a light-sensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A-3-46652, JP-A-3-53246, JP-A-3-55542, JP-A-3-121448, and JP-A-3-126030, the disclosures of which are incorporated herein by reference. A reverse permeable membrane used in this processing is preferably a low-pressure reverse permeable membrane.

In the processing of the present invention, it is particularly preferable to perform processing solution evaporation correction disclosed in JIII Journal of Technical Disclosure No. 94-4992, the disclosure of which is incorporated herein by reference. In particular, a method of performing correction on the basis of (formula-1) on page 2 by using temperature and humidity information of an environment in which a processor is installed is preferred. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferred.

Practical examples of processing agents, automatic processors, and evaporation correction methods suited to practicing the present invention are described in the same JIII Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen-permeable vessel disclosed in JP-A-63-17453, vacuum-packed powders and granules disclosed in JP-A-4-19655 and JP-A-4-230748, granules containing a water-soluble polymer disclosed in JP-A-4-221951, tablets disclosed in JP-A-51-61837 and JP-A-6-102628, and a paste disclosed in International Patent Laid-Open No. 57-500485, the disclosures of which are incorporated herein by reference. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen-permeable material is preferred. More specifically, polyethyleneterephthalate or a composite material of polyethylene and nylon is favorable. A vessel made of any of these materials preferably has a thickness of 500 to 1,500 $\mu$m and an oxygen permeability of 20 $mL/m^{2\cdot24}$ hrs·atm or less.

Color reversal film processing solutions used in the present invention will be described below.

Processing for a color reversal film is described in detail in Aztech Ltd., Known Technology No. 6 (1991, April 1), page 1, line 5 to page 10, line 5 and page 15, line 8 to page 24, line 2, and any of the contents can be preferably applied.

In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferred in terms of work environment, and N-methyloltriazole is particularly preferred as N-methylolazole. The contents pertaining to a color developer, bleaching solution, fixing solution, and washing water described in the color negative film processing can be preferably applied to the color reversal film processing.

Preferred examples of color reversal film processing agents containing the above contents are the E-6 processing agent manufactured by Eastman Kodak Co. and the CR-56 processing agent manufactured by Fuji Photo Film Co., Ltd.

A color photographic light-sensitive material of the present invention is also suitably used as a negative film for an advanced photo system (to be referred to as an APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z). A color photosensitive film of the present invention is also suited as a film with lens such as the Fuji Film FUJICOLOR UTSURUNDESU SUPER SLIM.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferable. Examples of a film processor for the MINI-LAB CHAMPION are the FP922AL, FP562B, FP562B,AL, FP362B, and FP362B,AL, and a recommended processing chemical is the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100and AT200 or AT100, respectively.

The APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladldin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

The present invention will be described in more detail below by way of its examples. However, the present invention is not limited to these examples.

EXAMPLE 1

Making of Sample 101

A color light-sensitive material including two layers having the following compositions was formed on an undercoated cellulose triacetate film support to make sample 101. The numbers represent addition amounts per $m^2$. The amount of a silver halide is indicated by a silver amount. The amount of a sensitizing dye added to a silver halide is the amount per mol of the silver halide.

1st layer: Green-sensitive emulsion layer

| | |
|---|---|
| Silver bromoiodide monodisperse tabular grain silver | 2.00 g |
| Average equivalent-sphere grain size | 0.3 μm |
| Variation coefficient 18% | |
| AgI content 4.0 mol % | |
| Sensitizing dye S-1 | 0.20 g |
| Sensitizing dye S-2 | 0.15 g |
| Sensitizing dye S-3 | 0.15 g |
| Gelatin | 3.50 g |
| Coupler G-1 | 0.30 g |
| High-boiling organic solvent Oil-1 | 0.15 g |
| Surfactant W-5 | 25 mg |
| 2nd layer: Protective layer | |
| Gelatin | 2.00 g |
| polymethylmethacrylate (average grain size 2.0 μm) | 0.10 g |
| Surfactant W-1 | 0.15 g |
| Gelatin hardener H-1 | 0.17 g |

Making of Samples 102-121

Samples 102 to 121 were made following the same procedures as for sample 101 except: that the magenta coupler (G-1) in the first layer of sample 101 was replaced as shown in Table 2.

Compounds used in the formation of each layer of samples 101 to 120 are present below.

Oil-1

Tricrecyl phosphate

W-1

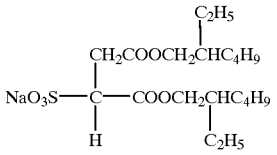

W-5

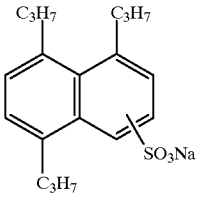

H-1

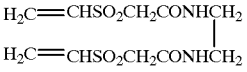

-continued

S-1

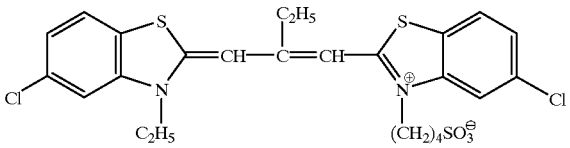

S-2

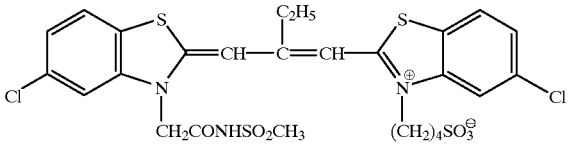

S-3

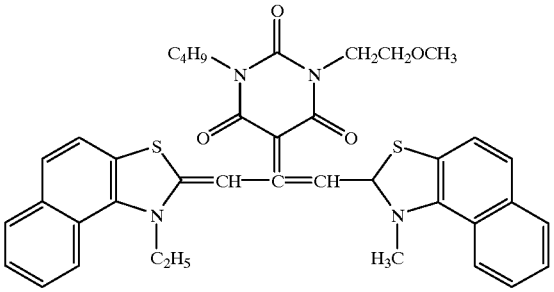

G-1

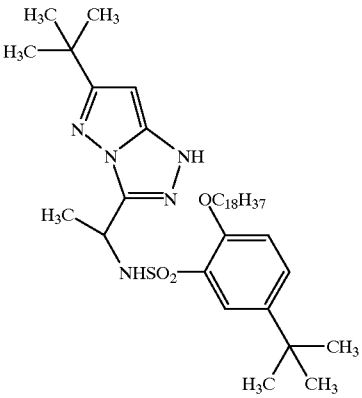

G-2

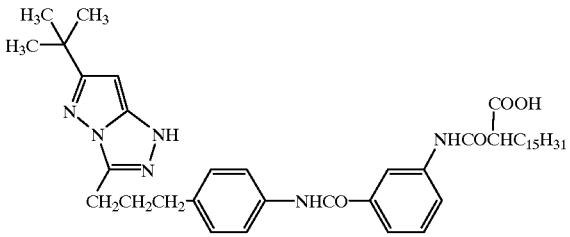

JP-A-1-102557 Example compound M-2

-continued

G-3

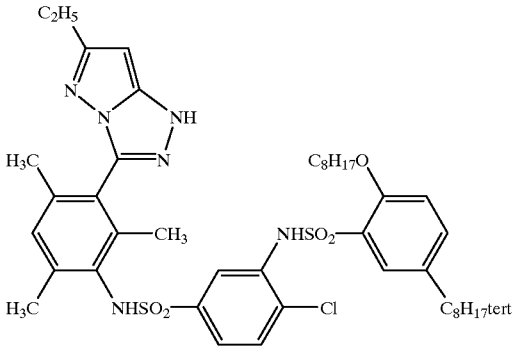

JP-A-5-100382 Example compound N-59
JP-A-9-281675 Example compound C-27
JP-A-9-90582 Example compound C-27

G-4

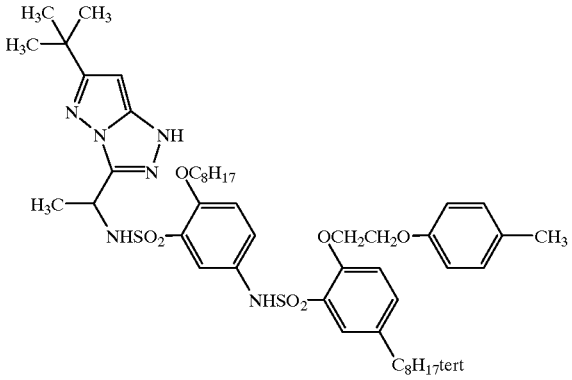

JP-A-5-100382 Example compound N-63

Evaluation of color generation. efficiency and sensitivity decrease by mixed solution retention: In the preparation of the first layer of Example 1, a coupler and a high-boiling organic solvent were previously emulsion-dispersed in the solution of a silver halide emulsion. A sample coated with the resultant solution mixture within 5 min after the mixing and a sample coated with the solution mixture retained 3 hr after the mixing were exposed to white light at a color temperature of 4,800° K. through a wedge having a continuously changing density. After that, the following development was performed, and the magenta density of each resultant sample was measured. The color generation efficiency was evaluated by calculating the maximum color generation density value of the sample coated within 5 min after the mixing. The larger the maximum color generation density value, the higher the color generation efficiency.

The sensitivity decrease by mixed solution retention was evaluated by checking a sensitivity change at a density of 0.5 of the sample coated in 3 hr after the mixing by using the sample coated within 5 min after the mixing. The value is the logarithm of an exposure amount by which a density of 0.5 is given, and "−" indicates sensitivity decrease. The larger the value, the larger the sensitivity change.

Evaluation of yellow stains: Each sample was exposed to white light of 500 lux for 1 sec and subjected to the following development. The obtained samples were irradiated with a 5,000-lux fluorescent lamp for two weeks, and the yellow stain density was measured. Evaluation was done by subtracting the blank density from the increased yellow density. The smaller the value, the less yellow stains were generated.

The results are summarized in Table 2.

TABLE 2

| Sample No. | 1st layer Magenta coupler | 1st layer Oil/coupler ratio (wt) | Color generation efficiency (Dmax) | Sensitivity decrease by mixed solution retention | Yellow stain |
|---|---|---|---|---|---|
| 101 (comparative example) | Comparative coupler G-1 | 0.5 | 0.43 | −0.02 | 0.04 |
| 102 (comparative example) | Comparative coupler G-2 | 0.5 | 1.62 | −0.08 | 0.14 |
| 103 (comparative example) | Comparative coupler G-2 | 0.0 | 1.58 | −0.12 | 0.06 |
| 104 (comparative example) | Comparative coupler G-3 | 0.5 | 0.75 | −0.03 | 0.19 |
| 105 (comparative example) | Comparative coupler G-3 | 0.0 | 0.19 | −0.02 | 0.05 |
| 106 (comparative example) | Comparative coupler G-4 | 0.5 | 0.96 | −0.04 | 0.03 |
| 107 (comparative example) | Comparative coupler G-4 | 0.0 | 0.25 | −0.02 | 0.02 |
| 108 (present invention) | MC-1 | 0.5 | 1.67 | −0.01 | 0.02 |
| 109 (present invention) | MC-1 | 0.0 | 1.63 | −0.02 | 0.01 |
| 110 (present invention) | MC-3 | 0.5 | 1.66 | −0.00 | 0.04 |
| 111 (present invention) | MC-3 | 0.0 | 1.64 | −0.01 | 0.02 |
| 112 (present invention) | MC-4 | 0.5 | 1.68 | −0.02 | 0.01 |
| 113 (present invention) | MC-4 | 0.0 | 1.63 | −0.01 | 0.01 |
| 114 (present invention) | MG-5 | 0.0 | 1.64 | −0.00 | 0.01 |
| 115 (present invention) | MC-20 | 0.0 | 1.61 | −0.02 | 0.02 |
| 116 (present invention) | MC-46 | 0.0 | 1.63 | −0.01 | 0.01 |
| 117 (present invention) | MC-37 | 0.5 | 1.35 | −0.01 | 0.01 |
| 118 (present invention) | MC-38 | 0.5 | 1.29 | −0.01 | 0.02 |
| 119 (present invention) | MC-39 | 0.5 | 1.32 | −0.01 | 0.01 |
| 120 (present invention) | MC-40 | 0.5 | 1.27 | −0.01 | 0.01 |
| 121 (present invention) | MC-58 | 0.5 | 1.70 | −0.01 | 0.01 |

Sample 101 using a 4-equivalent pyrazole magenta coupler having no dissociative group in a ballast portion nearly satisfied sensitivity decrease by mixed solution retention and yellow stains but was inferior in color generation efficiency. Sample 102 using a coupler having a dissociative group in a ballast portion had a high color generation efficiency but generated yellow stains and decreased the sensitivity when retained after mixed with a silver halide. Also, sample 103 containing no high-boiling organic solvent had a high color generation efficiency and generated yellow stains little but further decreased the sensitivity by mixed solution retention. Sample 104 using a coupler having a structure closer to that of the present invention was superior in sensitivity decrease by mixed solution retention but had problems in color generation efficiency and yellow stains. Sample 106 had a low color generation efficiency similar to sample 101. In particular, sample 107 used in the absence of a high-boiling organic solvent further decreased the color generation efficiency. All pKa values of —$NHSO_2$— group of samples 115, 116 and 121 (couplers MC-20, 46 and 58) are less than 12. 108 to 121 are samples of the present invention. Samples 108 to 116, and 121 using compounds of the present invention having a pKa of 12 or less had a high color generation efficiency even in the absence of a high-boiling organic solvent. Also, samples 117 to 120 lowered the sensitivity little by mixed solution retention and were also favorable in the other properties. That is, these samples of the present invention obviously well achieved the objects of the present invention.

| Processing Step | Time | Temperature | Tank volume | Replenishment rate |
|---|---|---|---|---|
| 1st development | 6 min | 38° C. | 12 L | 2,200 mL/$m^2$ |
| 1st washing | 2 min | 38° C. | 4 L | 7,500 mL/$m^2$ |
| Reversal | 2 min | 38° C. | 4 L | 1,100 mL/$m^2$ |
| Color development | 6 min | 38° C. | 12 L | 2,200 mL/$m^2$ |
| Pre-bleaching | 2 min | 38° C. | 4 L | 1,100 mL/$m^2$ |
| Bleaching | 6 min | 38° C. | 12 L | 220 mL/$m^2$ |
| Fixing | 4 min | 38° C. | 8 L | 1,100 mL/$m^2$ |
| 2nd washing | 4 min | 38° C. | 8 L | 7,500 mL/$m^2$ |
| Final rinsing | 1 min | 25° C. | 2 L | 1,100 mL/$m^2$ |

The compositions of the processing solutions were as follows.

| <1st developer> | <Tank solution> | <Replenisher> |
|---|---|---|
| Nitrilo-N,N,N-trimethylene phosphonic acid•pentasodium salt | 1.5 g | 1.5 g |
| Diethylenetriamine pentaacetic acid•pentasodium salt | 2.0 g | 2.0 g |
| Sodium sulfite | 30 g | 30 g |
| Hydroquinone•potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid•pentasodium salt | 3.0 g | the same as tank solution |
| Stannous chloride•dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> <Replenisher> | <Tank solution> | |
|---|---|---|
| Nitrilo-N,N,N-trimethylene phosphonic acid•pentasodium salt | 2.0 g | 2.0 g |
| Sodium sulfite | 7.0 g | 7.0 g |
| Trisodium phosphate•dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline•3/2 sulfuric acid•monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid•disodium salt•dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.30 | 6.10 |

The pH was adjusted by acetic acid or sodium hydroxide.

| <Bleaching solution> | <Tank solution> | <Replenisher> |
|---|---|---|
| Ethylenediaminetetraacetic acid•disodium salt•dihydrate | 2.0 g | 4.0 g |
| Ethylenediaminetetraacetic acid•Fe(III)•ammonium•dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | the same as tank solution |
| Sodium bisulfite | 5.0 g | the same as tank solution |
| Water to make | 1,000 mL | the same as tank solution |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

EXAMPLE 2

Making of Sample 201

A multilayered color light-sensitive material including layers having the following compositions was formed on a 127-μm thick undercoated cellulose triacetate film support to make sample 201. The numbers represent addition amounts per $m^2$. Note that the effects of added compounds are not restricted to the described purposes.

1st layer: Antihalation layer

| | |
|---|---|
| Black colloidal silver | 0.25 g |
| Gelatin | 2.40 g |
| Ultraviolet absorbent U-3 | 0.20 g |
| Ultraviolet absorbent U-4 | 0.10 g |
| Ultraviolet absorbent U-5 | 0.30 g |
| High-boiling organic solvent Oil-1 | 0.050 g |
| High-boiling organic solvent Oil-2 | 0.050 g |
| Dye D-4 | 1.0 mg |
| Dye D-8 | 2.5 mg |
| Fine crystal solid dispersion of dye E-1 | 0.05 g |

2nd layer: Interlayer

| | |
|---|---|
| Gelatin | 0.40 g |
| Compound Cpd-A | 0.2 mg |
| Compound Cpd-J | 1.0 mg |
| Compound Cpd-K | 3.0 mg |
| Compound Cpd-M | 0.030 g |
| High-boiling organic solvent Oil-3 | 0.010 g |
| High-boiling organic solvent Oil-4 | 0.010 g |
| High-boiling organic solvent Oil-6 | 2.0 mg |
| High-boiling organic solvent Oil-7 | 4.0 mg |
| Dye D-7 | 2.5 mg |

3rd layer: Interlayer

| | |
|---|---|
| Yellow colloidal silver | silver 0.010 g |
| Gelatin | 0.30 g |
| Compound Cpd-M | 0.010 g |
| High-boiling organic solvent Oil-3 | 0.010 g |

4th layer: Low-speed red-sensitive emulsion layer

| | |
|---|---|
| Emulsion A | silver 0.20 g |
| Emulsion B | silver 0.20 g |
| Emulsion C | silver 0.10 g |
| Gelatin | 0.60 g |
| Coupler C-1 | 0.050 g |
| Coupler C-2 | 0.10 g |
| Coupler C-3 | 0.010 g |
| Coupler C-5 | 6.0 mg |
| Coupler C-6 | 5.0 mg |
| Coupler C-8 | 0.050 g |
| Compound Cpd-A | 1.0 mg |
| Compound Cpd-I | 0.020 g |
| Compound Cpd-J | 5.0 mg |
| High-boiling organic solvent Oil-1 | 0.10 g |
| Additive P-1 | 0.02 g |

5th layer: Medium-speed red-sensitive emulsion layer

| | |
|---|---|
| Emulsion C | silver 0.25 g |
| Emulsion D | silver 0.20 g |
| Gelatin | 0.60 g |
| Coupler C-1 | 0.20 g |
| Coupler C-2 | 0.050 g |
| Coupler C-3 | 0.020 g |
| Coupler C-5 | 7.0 mg |
| Coupler C-8 | 0.050 g |
| Ultraviolet absorbent U-1 | 0.010 g |
| Ultraviolet absorbent U-2 | 0.010 g |
| High-boiling organic solvent Oil-1 | 0.10 g |
| Additive P-1 | 0.020 g |

6th layer: High-speed red-sensitive emulsion layer

| | |
|---|---|
| Emulsion E | silver 0.25 g |
| Emulsion F | silver 0.25 g |
| Gelatin | 1.40 g |
| Coupler C-1 | 0.10 g |
| Coupler C-3 | 0.60 g |
| Coupler C-5 | 0.010 g |
| Coupler C-8 | 0.20 g |
| Ultraviolet absorbent U-1 | 0.010 g |
| Ultraviolet absorbent U-2 | 0.010 g |
| High-boiling organic solvent Oil-1 | 0.10 g |
| Compound Cpd-K | 2.0 mg |
| Compound Cpd-F | 0.050 g |
| Additive P-1 | 0.10 g |
| Dye D-9 | 6.0 mg |

-continued

7th layer: Interlayer

| | |
|---|---|
| Gelatin | 0.70 g |
| Additive P-2 | 0.10 g |
| Compound Cpd-I | 0.010 g |
| Dye D-5 | 0.020 g |
| Dye D-9 | 6.0 mg |
| Compound Cpd-M | 0.040 g |
| Compound Cpd-O | 3.0 mg |
| Compound Cpd-P | 2.5 mg |
| High-boiling organic solvent Oil-5 | 0.050 g |

8th layer: Interlayer

| | |
|---|---|
| Yellow colloidal silver | silver 0.010 g |
| Gelatin | 1.00 g |
| Additive P-1 | 0.05 g |
| Ultraviolet absorbent U-1 | 0.010 g |
| Ultraviolet absorbent U-3 | 0.010 g |
| Compound Cpd-A | 0.050 g |
| Compound Cpd-M | 0.050 g |
| High-boiling organic solvent Oil-3 | 0.010 g |
| High-boiling organic solvent Oil-5 | 0.050 g |

9th layer: Low-speed green-sensitive emulsion layer

| | |
|---|---|
| Emulsion G | silver 0.20 g |
| Emulsion H | silver 0.30 g |
| Emulsion I | silver 0.30 g |
| Gelatin | 1.20 g |
| Comparative coupler G-1 | 0.15 g |
| Compound Cpd-R | 5.0 mg |
| Compound Cpd-B | 0.030 g |
| Compound Cpd-S | 0.010 g |
| Compound Cpd-D | 0.020 g |
| Compound Cpd-E | 0.020 g |
| Compound Cpd-G | 2.5 mg |
| Compound Cpd-F | 0.040 g |
| Compound Cpd-K | 2.0 mg |
| Compound Cpd-L | 0.020 g |
| Ultraviolet absorbent U-5 | 5.0 mg |
| High-boiling organic solvent Oil-5 | 0.15 g |
| High-boiling organic solvent Oil-4 | 8.0 mg |
| High-boiling organic solvent Oil-8 | 0.010 g |
| Additive P-2 | 5.0 mg |

10th layer: Medium-speed green-sensitive emulsion layer

| | |
|---|---|
| Emulsion I | silver 0.20 g |
| Emulsion J | silver 0.20 g |
| Internally fogged silver bromide emulsion (cubic, average equivalent-sphere grain size 0.11 $\mu$m) | silver 5.0 mg |
| Gelatin | 0.50 g |
| Comparative coupler G-1 | 0.18 g |
| Compound Cpd-R | 5.0 mg |
| Compound Cpd-B | 0.030 g |
| Compound Cpd-S | 0.010 g |
| Compound Cpd-D | 0.020 g |
| Compound Cpd-F | 0.050 g |
| Compound Cpd-G | 2.0 mg |
| High-boiling organic solvent Oil-5 | 0.10 g |
| High-boiling organic solvent Oil-8 | 0.020 g |

11th layer: High-speed green-sensitive emulsion layer

| | |
|---|---|
| Emulsion K | silver 0.55 g |
| Gelatin | 0.70 g |
| Comparative coupler G-1 | 0.30 g |
| Compound Cpd-R | 0.010 g |
| Compound Cpd-B | 0.080 g |
| Compound Cpd-S | 0.015 g |
| Compound Cpd-D | 0.020 g |
| Compound Cpd-F | 0.040 g |
| Compound Cpd-K | 5.0 mg |
| High-boiling organic solvent Oil-1 | 0.10 g |
| High-boiling organic solvent Oil-8 | 0.030 g |

12th layer: Interlayer

| | |
|---|---|
| Gelatin | 0.30 g |
| Compound Cpd-M | 0.05 g |
| High-boiling organic solvent Oil-3 | 0.025 g |
| High-boiling organic solvent Oil-5 | 0.025 g |
| Dye D-6 | 5.0 mg |

-continued

| | |
|---|---|
| 13th layer: Yellow filter layer | |
| Yellow colloidal silver | silver 0.015 g |
| Gelatin | 0.60 g |
| Compound Cpd-C | 0.010 g |
| Compound Cpd-M | 0.030 g |
| Compound Cpd-L | 0.010 g |
| High-boiling organic solvent Oil-5 | 0.020 g |
| Fine crystal solid dispersion of dye E-2 | 0.030 g |
| Fine crystal solid dispersion of dye E-3 | 0.020 g |
| 14th layer: Interlayer | |
| Gelatin | 0.30 g |
| 15th layer: Low-speed blue-sensitive emulsion layer | |
| Emulsion L | silver 0.17 g |
| Emulsion M | silver 0.17 g |
| Gelatin | 0.80 g |
| Coupler C-4 | 0.15 g |
| Coupler C-5 | 0.010 g |
| Coupler C-7 | 0.20 g |
| Compound Cpd-I | 0.010 g |
| Compound Cpd-M | 0.010 g |
| High-boiling organic solvent Oil-2 | 0.050 g |
| 16th layer: Medium-speed blue-sensitive emulsion layer | |
| Emulsion N | silver 0.18 g |
| Emulsion O | silver 0.13 g |
| Internally fogged silver bromide emulsion (cubic, average equivalent-sphere grain size 0.11 μm) | silver 0.010 g |
| Gelatin | 0.90 g |
| Coupler C-4 | 0.30 g |
| Coupler C-5 | 0.020 g |
| Coupler C-7 | 0.30 g |
| Compound Cpd-N | 2.0 mg |
| High-boiling organic solvent Oil-1 | 0.080 g |
| 17th layer: High-speed blue-sensitive emulsion layer | |
| Emulsion O | silver 0.20 g |
| Emulsion P | silver 0.20 g |
| Gelatin | 1.50 g |
| Coupler C-3 | 5.0 mg |
| Coupler C-4 | 0.20 g |
| Coupler C-5 | 0.020 g |
| Coupler C-7 | 1.15 g |
| High-boiling organic solvent Oil-1 | 0.10 g |
| Ultraviolet absorbent U-5 | 0.10 g |
| Compound Cpd-B | 0.20 g |
| Compound Cpd-N | 5.0 mg |
| Compound Cpd-Q | 0.20 g |
| 18th layer: 1st protective layer | |
| Gelatin | 0.60 g |
| Ultraviolet absorbent U-1 | 0.10 g |
| Ultraviolet absorbent U-3 | 0.20 g |
| Ultraviolet absorbent U-4 | 0.30 g |
| Ultraviolet absorbent U-5 | 0.20 g |
| Compound Cpd-O | 5.0 mg |
| Compound Cpd-A | 0.030 g |
| Compound Cpd-H | 0.20 g |
| Compound Cpd-B | 0.10 g |
| Dye D-1 | 8.0 mg |
| Dye D-2 | 0.010 g |
| Dye D-3 | 0.010 g |
| High-boiling organic solvent Oil-3 | 0.10 g |
| 19th layer: 2nd protective layer | |
| Colloidal silver | silver 0.11 mg |
| Fine grain silver iodobromide emulsion (average grain size 0.06 μm, AgI content 1 mol %) | silver 0.10 g |
| Gelatin | 0.50 g |
| 20th layer: 3rd protective layer | |
| Gelatin | 0.60 g |
| Polymethylmethacrylate (average grain size 1.5 μm) | 0.10 g |
| 6:4 copolymer of methylmethacrylate and methacrylic acid (average grain size 1.5 μm) | 0.10 g |
| Silicone oil SO-1 | 0.050 g |
| Surfactant W-2 | 3.0 mg |

-continued

| | |
|---|---|
| Surfactant W-3 | 8.0 mg |
| Surfactant W-1 | 0.040 g |
| Surfactant W-7 | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzoisothiazoline-3-one, 2-phenoxyethanol, phenethylalcohol, and p-benzoic butylester were added as antiseptic and mildewproofing agents.

The photosensitive emulsions used in sample 201 are shown in Tables 3 to 5.

TABLE 3

Silver bromoiodide emulsions used in sample 101

| Emulsion | Characteristics | Average equivalent-sphere grain size (μm) | Variation coefficient (%) | AgI content (%) |
|---|---|---|---|---|
| A | Monodisperse tetradecahedral grain | 0.16 | 10 | 4.0 |
| B | Monodisperse cubic internal latent image type grain | 0.25 | 10 | 4.8 |
| C | Monodisperse tabular grain Average aspect ratio 2.0 | 0.30 | 15 | 3.8 |
| D | Monodisperse tabular grain Average aspect ratio 3.0 | 0.40 | 18 | 4.8 |
| E | Monodisperse tabular grain Average aspect ratio 3.0 | 0.60 | 15 | 2.0 |
| F | Monodisperse tabular grain Average aspect ratio 4.5 | 0.70 | 12 | 1.8 |
| G | Monodisperse cubic grain | 0.15 | 9 | 3.5 |
| H | Monodisperse cubic internal latent image type grain | 0.24 | 12 | 3.5 |
| I | Monodisperse tabular grain Average aspect ratio 4.0 | 0.30 | 17 | 3.5 |
| J | Monodisperse tabular grain Average aspect ratio 5.0 | 0.45 | 16 | 3.0 |
| K | Monodisperse tabular grain Average aspect ratio 5.5 | 0.80 | 13 | 3.3 |
| L | Monodisperse tetradecahedral grain | 0.33 | 10 | 4.5 |
| M | Monodisperse cubic grain | 0.33 | 9 | 4.5 |
| N | Monodisperse tabular grain Average aspect ratio 3.0 | 0.50 | 10 | 2.5 |
| O | Monodisperse tabular grain Average aspect ratio 6.0 | 0.90 | 9 | 2.0 |
| P | Monodisperse tabular grain Average aspect ratio 6.0 | 1.10 | 8 | 1.8 |

TABLE 4

Spectral sensitization of emulsions A–P

| Emulsion | Added sensitizing dye | Addition amount (g) per mol of silver halide |
|---|---|---|
| A | S-1 | 0.010 |
| | S-2 | 0.25 |
| | S-3 | 0.010 |
| | S-13 | 0.025 |

TABLE 4-continued

Spectral sensitization of emulsions A–P

| Emulsion | Added sensitizing dye | Addition amount (g) per mol of silver halide |
|---|---|---|
| B | S-2 | 0.25 |
| | S-8 | 0.015 |
| | S-13 | 0.025 |
| C | S-2 | 0.20 |
| | S-8 | 0.030 |
| | S-13 | 0.025 |
| D | S-1 | 0.030 |
| | S-2 | 0.15 |
| | S-3 | 0.020 |
| | S-13 | 0.10 |
| E | S-1 | 0.020 |
| | S-2 | 0.15 |
| | S-8 | 0.020 |
| | S-13 | 0.10 |
| F | S-1 | 0.020 |
| | S-2 | 0.15 |
| | S-8 | 0.10 |
| | S-13 | 0.025 |
| G | S-4 | 0.30 |
| | S-5 | 0.10 |
| | S-12 | 0.10 |
| H | S-4 | 0.20 |
| | S-12 | 0.10 |
| I | S-4 | 0.25 |
| | S-5 | 0.10 |
| | S-12 | 0.15 |

TABLE 5

Spectral sensitization of emulsions A–P (continuation of Table 4)

| Emulsion | Added sensitizing dye | Addition amount (g) per mol of silver halide |
|---|---|---|
| J | S-4 | 0.40 |
| | S-9 | 0.10 |
| | S-12 | 0.15 |
| K | S-4 | 0.25 |
| | S-5 | 0.050 |
| | S-9 | 0.050 |
| | S-12 | 0.15 |
| | S-14 | 0.050 |
| L | S-6 | 0.25 |
| | S-7 | 0.15 |
| | S-10 | 0.050 |
| M | S-6 | 0.10 |
| | S-10 | 0.15 |
| | S-11 | 0.25 |
| N | S-10 | 0.25 |
| | S-11 | 0.25 |
| O | S-6 | 0.10 |
| | S-10 | 0.20 |
| | S-11 | 0.25 |
| P | S-6 | 0.050 |
| | S-7 | 0.050 |
| | S-10 | 0.20 |
| | S-11 | 0.25 |

The compounds used in the formation of each layer of sample 201 are presented below.

C-1

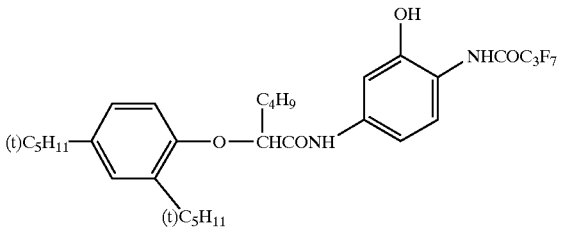

C-2

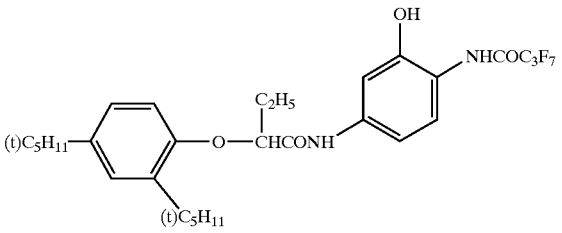

C-3

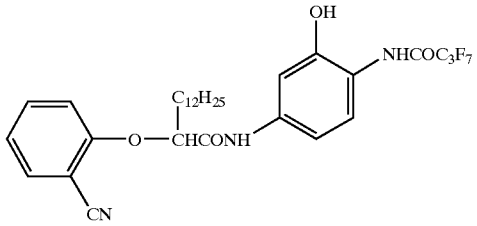

C-4

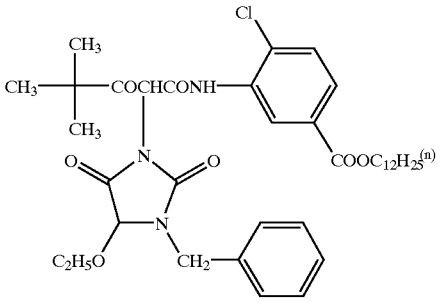

-continued
C-5
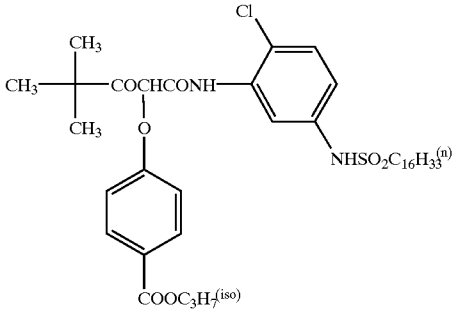
C-6
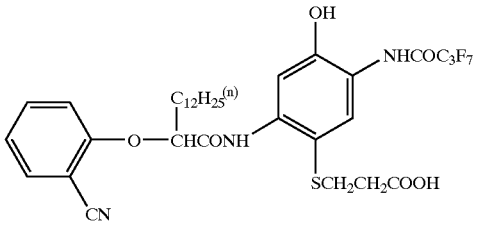
C-7
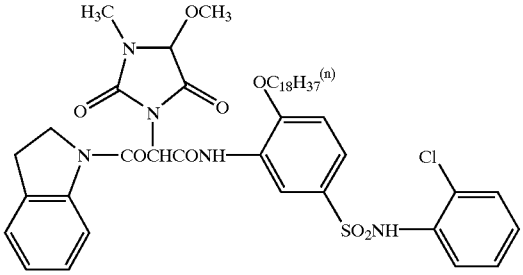
C-8
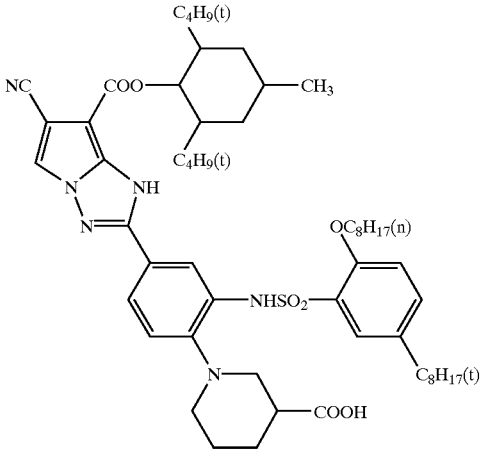
C-9
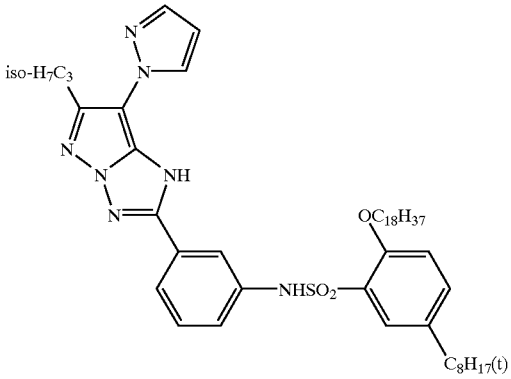
Oil-1
Tricresyl phosphate
Oil-2
Tri-n-hexyl phosphate
Oil-3
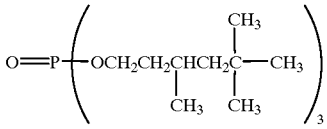
Oil-4
Tricyclohexyl phosphate
Oil-5
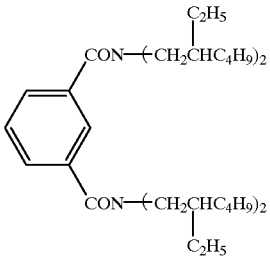

-continued
Oil-6
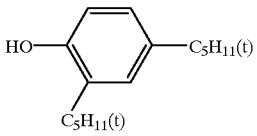
Oil-7
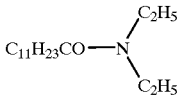
Oil-8
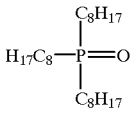
Cpd-A
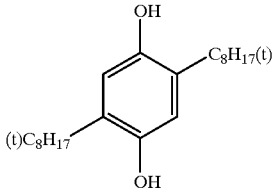
Cpd-B
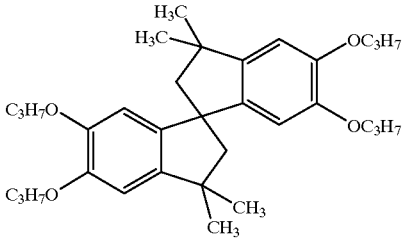
Cpd-C
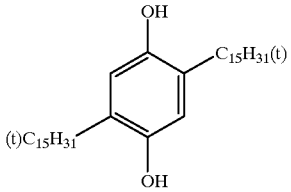
Cpd-D
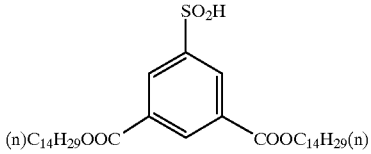
Cpd-E
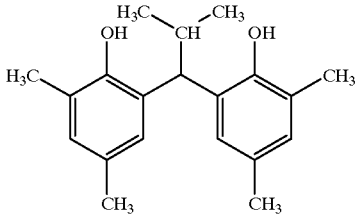
Cpd-F
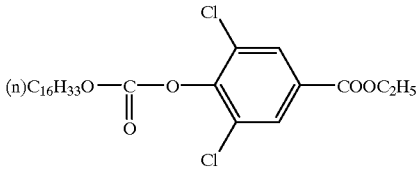
Cpd-G
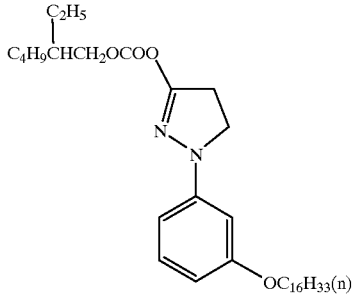
Cpd-H
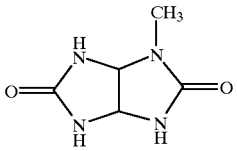
Cpd-I
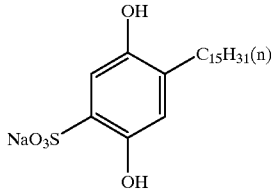
Cpd-J
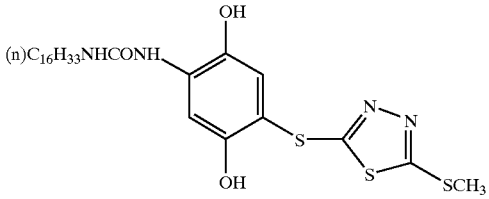
Cpd-K
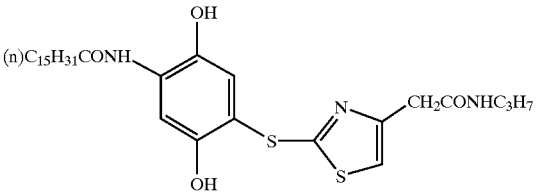

-continued
Cpd-L
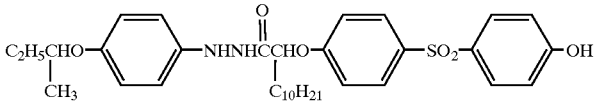
Cpd-M
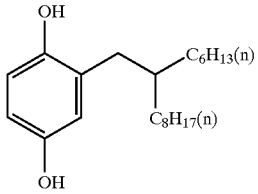
Cpd-N
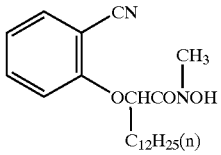
Cpd-O
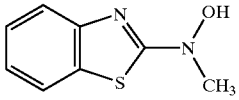
Cpd-P
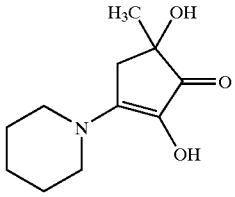
Cpd-Q
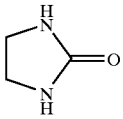
Cpd-R
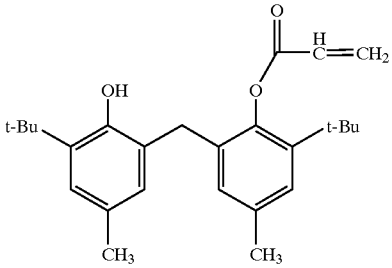
Cpd-S
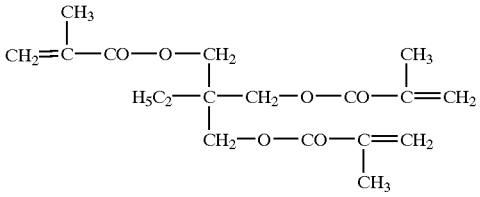
U-1
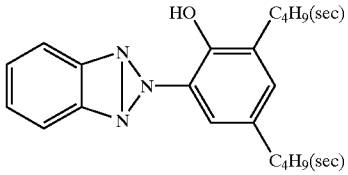
U-2
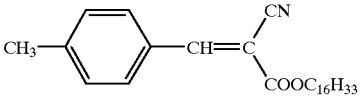
U-3
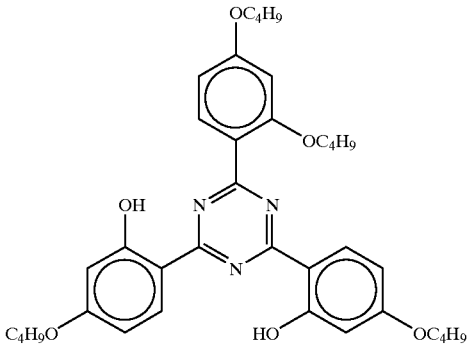
U-4
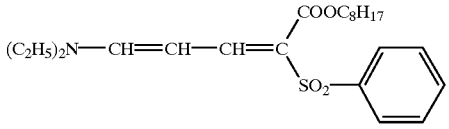

-continued
S-8
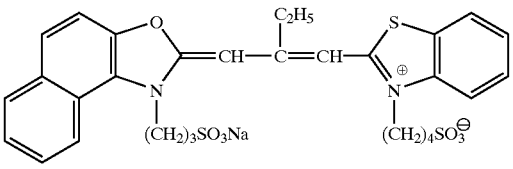
S-9
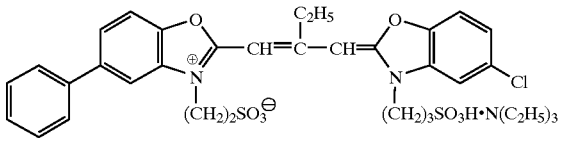
S-10
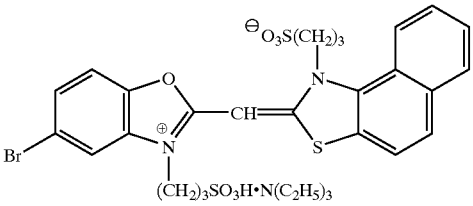
S-11
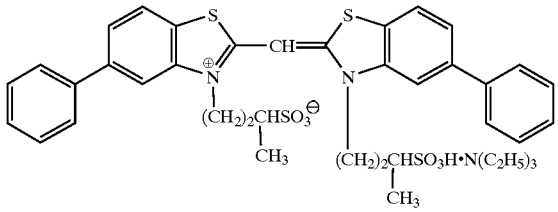
S-12
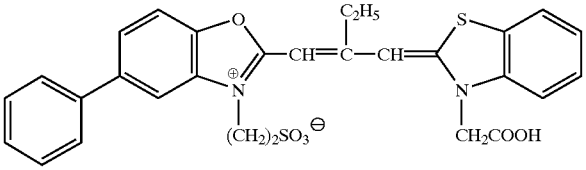
S-13
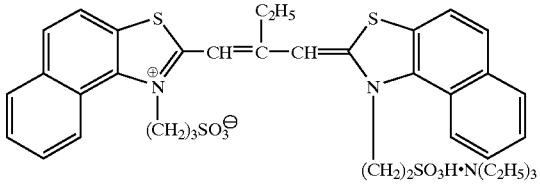
S-14
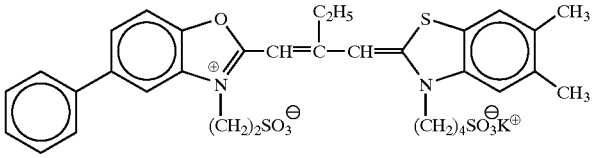
D-1
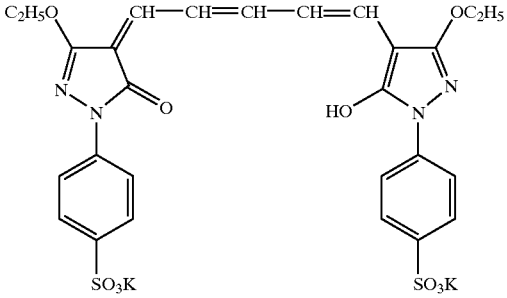
D-2
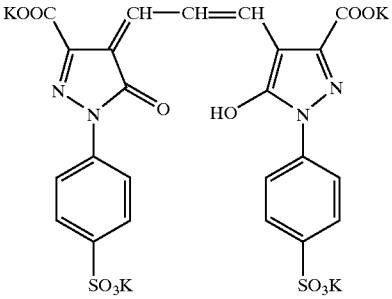
D-3
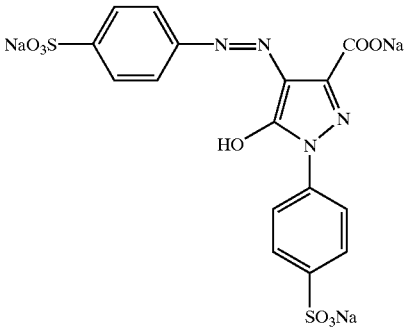

-continued
D-4
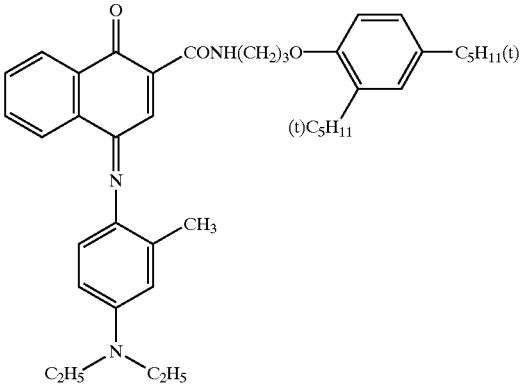
D-5
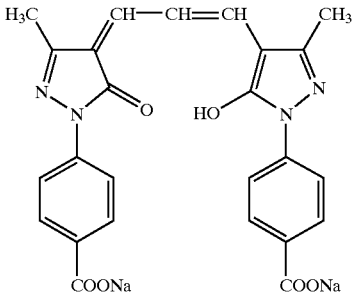
D-6
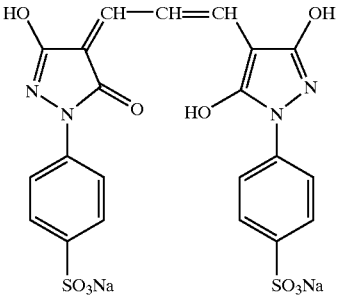
D-7
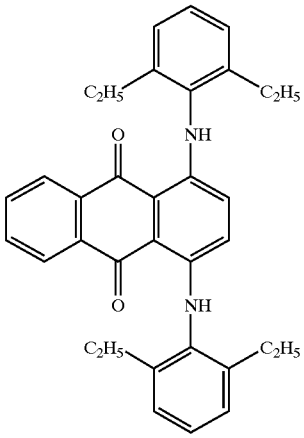
D-8
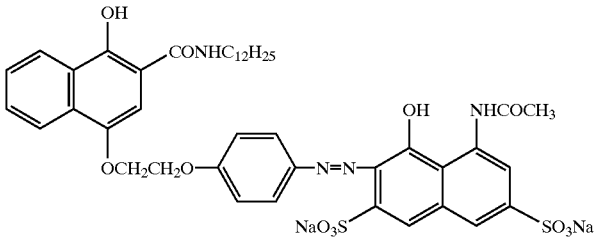
D-9
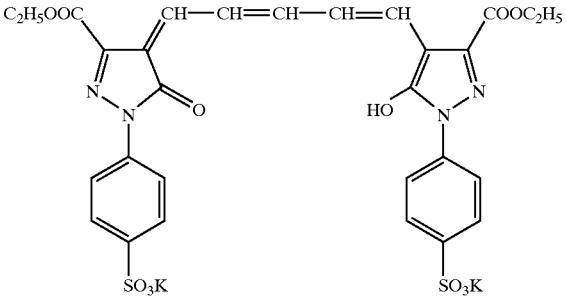
E-1
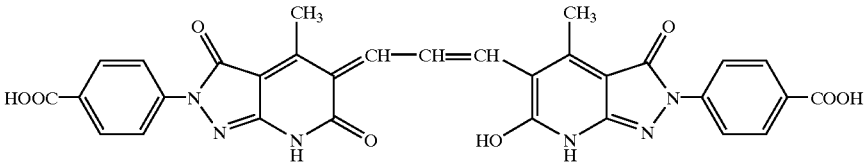

-continued
E-2
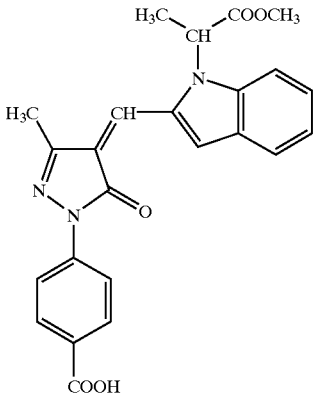
E-3
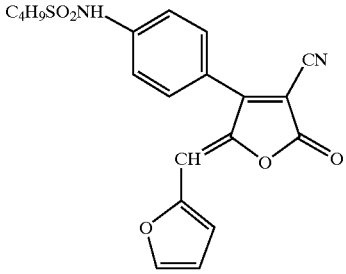
W-1
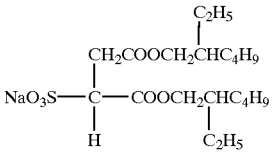
W-2
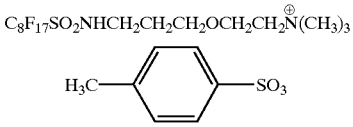
W-3
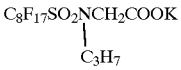
W-4
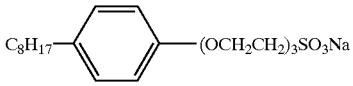
W-5
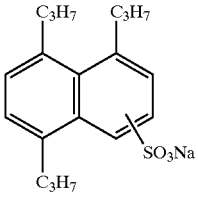
W-6
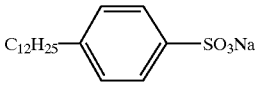
W-7
$C_8F_{17}SO_3Li$
P-1
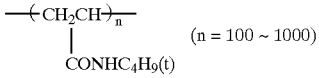
(n = 100 ~ 1000)
P-2
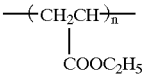
(n = 100 ~ 1000)
SO-1
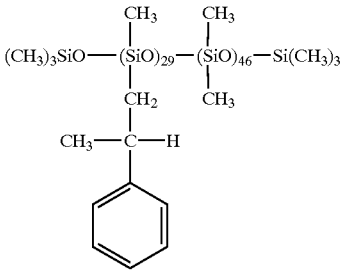
F-1
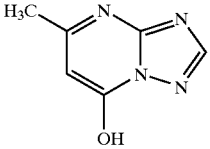
F-2
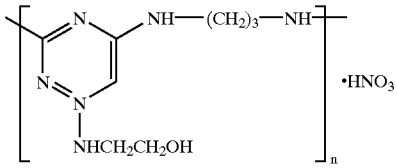
(n = 3 ~ 4)

-continued

F-3

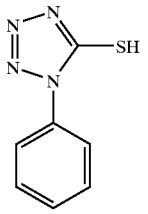

F-4

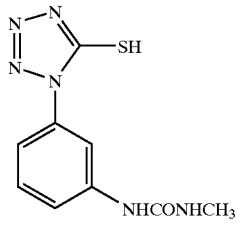

F-5

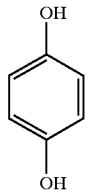

F-6

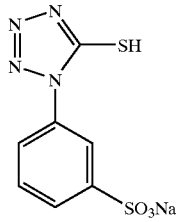

F-7

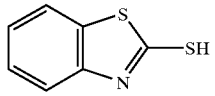

F-8

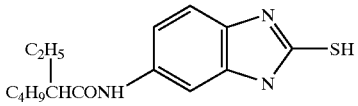

F-9

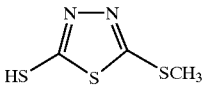

Preparation of Dispersions of Organic Solid Disperse Dyes

The dye E-1 was dispersed by the following method. That is, water and 200 g of Pluronic F88 (ethylene oxide-propylene oxide block copolymer) manufactured by BASF CORP. were added to 1,430 g of a dye wet cake containing 30% of methanol, and the resultant material was stirred to form a slurry having a dye concentration of 6%. Next, Ultra Visco Mill (UVM-2) manufactured by Imex K.K. was filled with 1,700 mL of zirconia beads with an average grain size of 0.5 nm, and the slurry was milled through UVM-2 at a peripheral speed of approximately 10 m/sec and a discharge rate of 0.5 L/min for 8 hr. The beads were filtered out, and water was added to dilute the material to a dye concentration of 3%. After that, the material was heated to 90° C. for 10 hr for a stabilization purpose. The average grain size of the obtained fine dye grains was 0.60 $\mu$m. The grain size distribution (grain size standard deviation×100/average grain size) was 18%.

Following the same procedure as above, solid dispersions of the dyes E-2 and E-3 were obtained. The average grain sizes were found to be 0.54 and 0.56 $\mu$m, respectively.

Making of Samples 202–217

Samples 202 to 217 were made by changing the couplers in the 9th to 11th green-sensitive emulsion layers of sample 201 obtained as above to equal molar quantities of couplers shown in Table 6.

TABLE 6

| | 9th layer - 11th layer | |
|---|---|---|
| Sample No. | Magenta coupler | Oil/coupler ratio (wt) |
| 201 (Comparative example) | Comparative coupler G-1 | 0.0 |
| 202 (Comparative example) | Comparative coupler G-2 | 0.5 |
| 203 (Comparative example) | Comparative coupler G-2 | 0.0 |
| 204 (Comparative example) | Comparative coupler G-3 | 0.5 |
| 205 (Comparative example) | Comparative coupler G-3 | 0.0 |
| 206 (Comparative example) | Comparative coupler G-4 | 0.5 |
| 207 (Comparative example) | Comparative coupler G-4 | 0.0 |
| 208 (Present invention) | MC-1 | 0.5 |
| 209 (Present invention) | MC-1 | 0.0 |
| 210 (Present invention) | MC-3 | 0.5 |
| 211 (Present invention) | MC-3 | 0.0 |
| 212 (Present invention) | MC-4 | 0.5 |
| 213 (Present invention) | MC-4 | 0.0 |
| 214 (Present invention) | MC-5 | 0.0 |
| 215 (Present invention) | MC-20 | 0.0 |
| 216 (Present invention) | MC-46 | 0.0 |
| 217 (Present invention) | MC-58/C-9 = 3/1 (mol ratio) | 0.2 |

Samples 201 to 217 thus obtained were subjected to evaluations of the color generation, efficiency and the sensitivity decrease by mixed solution retention in the same manner as in Example 1. Table 7 shows the results.

TABLE 7

| Sample No. | Color generation efficiency (Dmax) | | | Sensitivity decrease by mixed solution retention | | |
|---|---|---|---|---|---|---|
| | Cyan image | Magenta image | Yellow image | Cyan image | Magenta image | Yellow image |
| 201 (comparative example) | 3.32 | 1.54 | 3.56 | −0.02 | −0.02 | −0.03 |
| 202 (comparative example) | 3.15 | 3.37 | 3.37 | −0.01 | −0.13 | −0.02 |
| 203 (comparative example) | 2.78 | 3.22 | 3.09 | −0.01 | −0.12 | −0.01 |
| 204 (comparative example) | 3.37 | 1.54 | 3.61 | −0.02 | −0.02 | −0.01 |
| 205 (comparative example) | 3.33 | 0.76 | 3.58 | −0.01 | −0.03 | −0.02 |
| 206 (comparative example) | 3.40 | 1.21 | 3.63 | −0.00 | −0.01 | −0.01 |
| 207 (comparative example) | 3.38 | 0.61 | 3.60 | −0.02 | −0.02 | −0.02 |
| 208 (present invention) | 3.38 | 3.41 | 3.59 | −0.01 | −0.02 | −0.01 |
| 209 (present invention) | 3.36 | 3.42 | 3.29 | −0.01 | −0.01 | −0.02 |
| 210 (present invention) | 3.42 | 3.42 | 3.51 | −0.01 | −0.01 | −0.01 |
| 211 (present invention) | 3.35 | 3.28 | 3.49 | −0.02 | −0.01 | −0.02 |
| 212 (present invention) | 3.41 | 3.37 | 3.38 | −0.01 | −0.02 | −0.01 |
| 213 (present invention) | 3.39 | 3.14 | 3.40 | −0.02 | −0.01 | −0.02 |
| 214 (present invention) | 3.28 | 3.33 | 3.61 | −0.01 | −0.01 | −0.01 |
| 215 (present invention) | 3.27 | 3.35 | 3.43 | −0.02 | −0.01 | −0.02 |
| 216 (present invention) | 3.37 | 3.41 | 3.63 | −0.01 | −0.01 | −0.01 |
| 217 (present invention) | 3.31 | 3.29 | 3.57 | −0.01 | −0.02 | −0.01 |

The results shown in Table 7 indicate that sample 201 had a low color generation efficiency similar to sample 101 of Example 1. Each of samples 202 and 203 had a high color generation efficiency but decreased the sensitivity of a magenta image more than the sensitivities of cyan and yellow images by mixed solution retention, resulting in a bad sensitivity balance of the three colors. Also, each of samples 204 to 207 had a relatively small decrease in the sensitivity of a magenta color image by mixed solution retention but had a low color generation efficiency, and this broke the color generation density balance of cyan and yellow. In contrast, each of samples 208 to 217 of the present invention decreased the sensitivity of a magenta image little by mixed solution retention, had a good sensitivity balance of the three colors, and also had a good color generation balance of the three colors.

In addition, the evaluation of yellow stains was performed in the same manner as in Example 1. Consequently, superior effects were obtained by samples 208 to 217 of the present invention as in Example 1.

EXAMPLE 3

Samples 301 to 312 were made following the same procedures as for sample 101 except. that the magenta coupler in the first layer of sample 101 was replaced as shown in Table 8. The obtained samples were evaluated in the same manner as in the evaluation of the color generation efficiency described in Example 1. The results are shown in Table 8.

TABLE 8

| Sample No. | 1st layer | | Color generation efficiency (Dmax) |
|---|---|---|---|
| | Magenta coupler | Oil/coupler ratio (wt) | |
| 301 (comparative example) | Comparative coupler G-5 | 0.5 | 1.52 |
| 302 (comparative example) | Comparative coupler G-5 | 0.0 | 0.83 |
| 303 (comparative example) | Comparative coupler G-6 | 0.5 | 1.35 |
| 304 (comparative example) | Comparative coupler G-6 | 0.0 | 0.64 |
| 305 (comparative example) | Comparative coupler G-7 | 0.5 | 1.42 |
| 306 (comparative example) | Comparative coupler G-7 | 0.0 | 0.57 |
| 307 (present invention) | MC-15 | 0.5 | 1.68 |
| 308 (present invention) | MC-15 | 0.0 | 1.59 |
| 309 (present invention) | MC-16 | 0.5 | 1.72 |
| 310 (present invention) | MC-16 | 0.0 | 1.67 |
| 311 (present invention) | MC-60 | 0.5 | 1.70 |
| 312 (present invention) | MC-60 | 0.0 | 1.63 |

Couplers used in samples 301 to 306 are presented below.

G-5

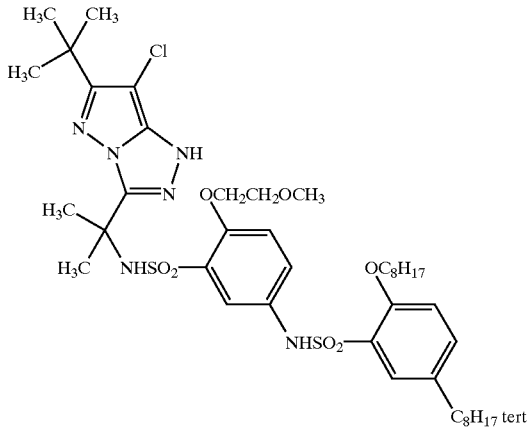

JP-A-5-100382 Example compound M-49

G-6

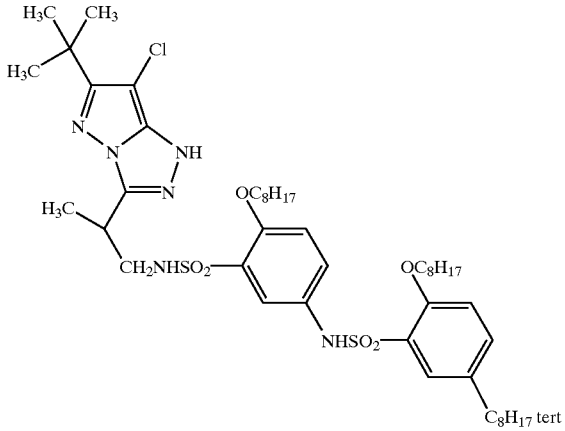

JP-A-63-103245 Example compound M-21

G-7

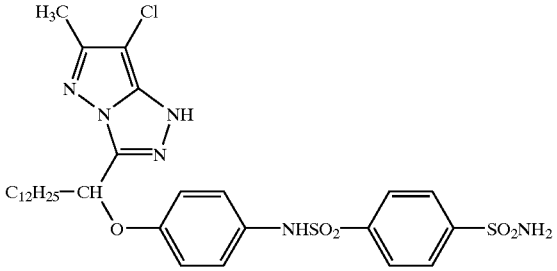

JP-A-5-150419 Example compound (2)

G-8

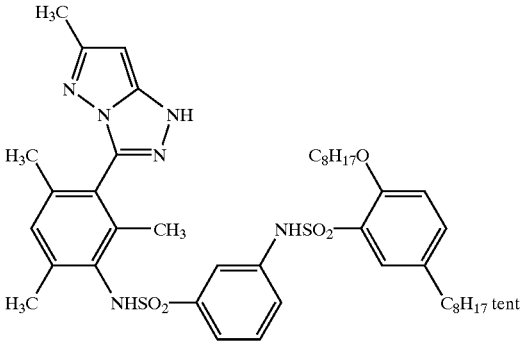

-continued

G-9

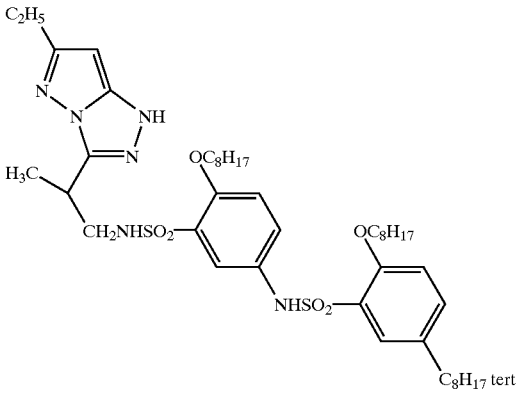

G-10

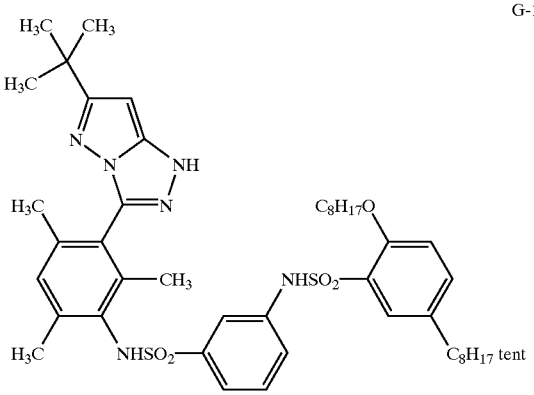

The results shown in Table 8 reveal that each coupler having the structure of the present invention had a high color generation efficiency even when it was a 2-equivalent coupler, and exhibited a high color generation efficiency even in the absence of a high-boiling organic solvent. That, is, these couplers achieved oilless processing as one object of the present invention.

EXAMPLE 4

Samples Z-1, Z-2, and Z-3 were made following the same procedures as for sample 201 in Example 2 of JP-A-9-146237 except that a coupler ExM-3 in the 8th and 9th layers was replaced with 0.6-fold mols of the coupler MC-16 of the present invention and the comparative couplers G-6 and G-7. Also, samples Z-4, Z-5, and Z-6 were made following the same procedures as for samples Z-1, Z-2, and Z-3 except that high-boiling organic solvents HBS-1 and HBS-3 in the 8th and 9th layers of samples Z-1, Z-2, and Z-3 were removed.

These samples Z-1 to Z-6 were processed and their color generation efficiencies were evaluated by the methods described in Example 1. As a consequence, effects similar to those of Example 3 of the present invention were obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material comprising at least one silver halide emulsion layer on a support, said at least one emulsion layer containing a magenta coupler represented by formula (M-2):

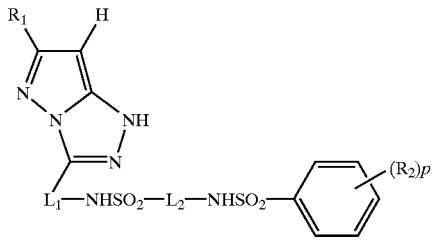

where $R_1$ represents a substituted or unsubstituted alkyl group, each of $L_1$ and $L_2$ independently represents a substituted or unsubstituted alkylene group, or a substituted or unsubstituted arylene group, $R_2$ represents a halogen atom, nitro group, cyano group, —$COR_3$, —$COOR_3$, —$CON(R_4)R_3$, —$N(R_4)COOR_3$, —$N(R_4)CON(R_5)R_3$, —$CON(R_4)SO_2R_3$, or —$N(R_4)COR_3$, p is an integer from 1 to 5, wherein a plurality of $R_2$'s may be the same or different if p is not less then 2, and each of $R_3$, $R_4$, and $R_5$ independently represents a hydrogen atom, a substituted or unsubstituted alkyl group, or a substituted or unsubstituted aryl group, $R_3$ and $R_4$ may be combined to form a ring, and the value or pKa at 25° C. of —$NHSO_2$—which bonds to $L_2$ and the phenyl group in a magenta coupler represented by formula (M-2) is not more than 12 in a solution of THF/$H_2O$=6/4.

2. The silver halide color photographic light-sensitive material according to claim 1, wherein the magenta coupler is represented by formula (M-5):

(M-5)

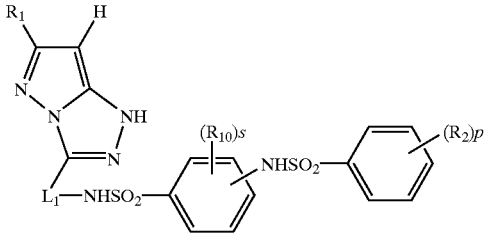

wherein $R_2$ and p have the same meanings as in formula (M-2) of claim 2, $R_1$ represents a secondary or tertiary unsubstituted alkyl group having 1 to 8 carbon atoms, $R_{10}$ represents a substitutent, s is an integer from 0 to 3 , wherein a plurality of $R_{10}$'s may be the same or different is s is not less than 2, and $L_1$ represents a substituted or unsubstituted alkylene group represented by formula (M-5a) or a substituted or unsubtituted arylene group represented by formula (M-5b)

(M-5a)

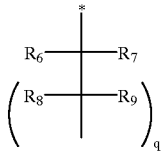

where each of $R_6$, $R_7$, $R_8$, and $R_9$ independently represents a hydrogen atom, a halogen atom, a substituted or unsubstitutd alkyl group, or a substituted or unsubstituted aryl group, q is an integer from 0 to 3, wherein a plurality of $R_8$'s and $R_9$'s may be the same or different is q is not less than 2, two of $R_6$, $R_7$, $R_8$, and $R_9$ may be combined to form a ring, and * indicates the position where this alkylene group bonds to the pyrazoloazole ring (M-5b)

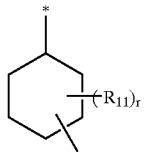

where $R_{11}$ represents a hydrogen atom, a halogen atom, a substituted or unsubstituted alkyl group, a substituted or unsubstituted aryl group, a substituted or unsubstituted alkoxy group, or a substituted or unsubstituted aryloxy group, r represents an integer from 1 to 4, wherein a plurality of $R_{11}$'s may be the same or different if r is not less than 2, and * indicates the position where this arylene group bonds to the pyrazoloazole ring.

3. The silver halide color photographic light-sensitive material according to claim 2, wherein the magenta coupler is represented by formula (M-7):

(M-7)

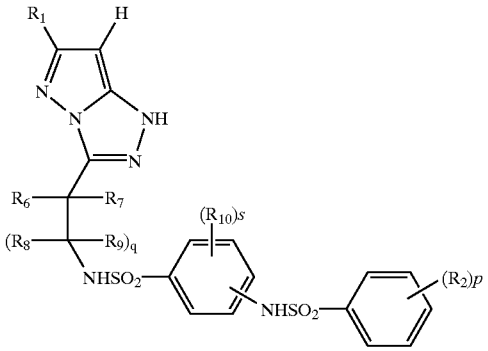

Where $R_1$ represents a secondary or tertiary unsubstituted alkyl group having 3 to 8 carbon atoms, $R_2$ represents a halogen atom (chlorine or bromine), a cyano group, —$COR_3$, —$COOR_3$, or —$CON(R_4)R_3$, each of $R_3$ and $R_4$ independently represents a hydrogen atom, a substituted or unsubstituted alkyl group, or a substituted or unsubstituted aryl group, $R_3$ and $R_4$ may be combined to form a ring, p is 2 or 3, each of $R_6$, $R_7$, $R_8$, and $R_9$ independently represents a hydrogen atom, or an alkyl group having 1 to 4 carbon atoms, wherein at least one of $R_6$ and $R_7$ represents a methyl group, an ethyl group, or an isopropyl group, q is 0 or 1, $R_{10}$ represents a halogen atom, a substituted or unsubstituted alkyl group having 1 to 25 carbon atoms in the alkyl moiety, a substituted or unsubstituted alkoxy group having 1 to 25 carbon atoms in the alkoxy moiety, or a substituted or unsubstituted aryloxy group having 6 to 30 carbon atoms in the aryloxy moiety, and s is 0, 1, or 2.

4. The silver halide color photographic light-sensitive material according to claim 3, wherein the magenta coupler is represented by formula (M-8):

(M-8)

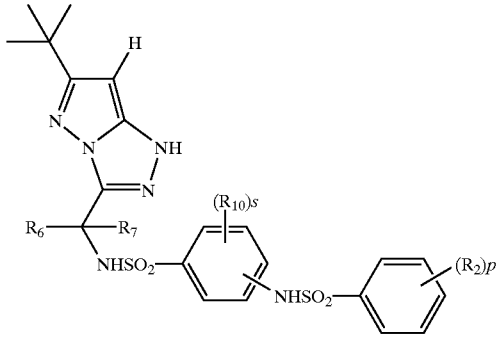

where $R_2$ represents a halogen atom (chlorine or bromine), a cyano group, —$COR_3$, —$COOR_3$, or —$CON(R_4)R_3$, $R_3$ represents a substituted or unsubstituted alkyl group having 1 to 25 carbon atoms in the alkyl moiety, or a substituted or unsubstituted aryl group having 6 to 30 carbon atoms in the aryl moiety, $R_4$ represents a hydrogen atom, a substituted or unsubstituted alkyl group having 1 to 25 carbon atoms in the alkyl moiety, or a substituted or unsubstituted aryl group having 6 to 30 carbon atoms in the aryl moiety, $R_3$ and $R_4$ may be combined to form a ring, p, $R_6$, $R_7$, $R_{10}$ and s have the same meanings as in formula (M-7) of claim 3.

5. The silver halide color photographic light-sensitive material according to claim 4, wherein $R_3$ in formula (M-8) represents an unsubstituted cycloalkyl group having 5 to 7 carbon atoms, and $R_{10}$ in formula (M-8) represents a halogen atom, an unsubstituted alkoxy group having 10 to 22 carbon atoms, or an unsubstituted aryloxy group having 10 to 14 carbon atoms.

6. A silver halide color photographic light-sensitive material comprising at least one silver halide emulsion layer on a support, said at least one emulsion layer containing a magenta coupler represented by formula (M-3):

(M-3)

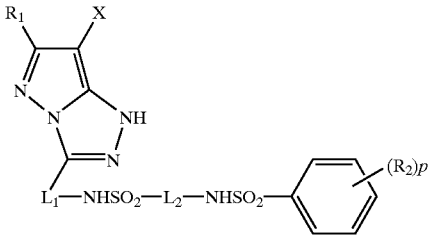

Where $R_1$, $L_1$, $L_2$, $R_2$, and p have the same meanings as in formula (M-2) of claim 1, and X represents a group or an atom which splits off during a coupling reaction with an oxidized form of a developing agent, and the value of pKa at 25° C. of —$NHSO_2$— which bonds to $L_2$ and the phenyl group in a magenta coupler represented by formula (M-3) is not more than 12 in a solution of THF/$H_2O$=6/4.

7. The silver halide color photographic light-sensitive material according to claim 6, wherein the magenta coupler is represented by formula (M-6):

(M-6)

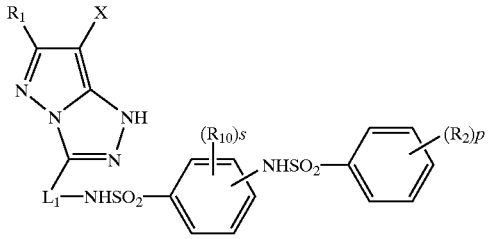

where $R_1$, $L_1$, $R_2$, p and X have the same meanings as in formula (M-3) of claim 7, $R_{10}$ represents a halogen atom or a substituent, and s is an integer from 0 to 3, wherein a plurality of $R_{10}$'s may be the same or different if s is not less than 2.

8. The silver halide color photographic light-sensitive material according to claim 7, wherein the magenta coupler is represented by formula (M-9):

(M-9)

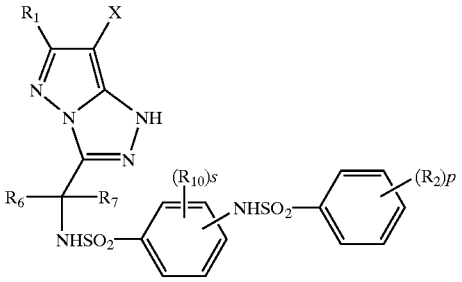

where $R_1$ represents a secondary or tertiary unsubstituted alkyl group having 3 to 8 carbon atoms, X represents a chlorine atom or a substituted or unsubstituted aryloxy group having 6 to 30 carbon atoms in the aryloxy moiety, $R_2$ represents a halogen atom (chlorine or bromine), a cyano group, —$COR_3$, —$COR_3$, —$COOR_3$, or —$CON(R_4)R_3$, each or $R_3$ and $R_4$ independently represents a hydrogen atom, a substituted or unsubstituted alkyl group, or a substituted or unsubstituted aryl group, $R_3$ and $R_4$ may be combined to form a ring, p is 2 or 3, each of $R_6$ and $R_7$ independently represents a hydrogen atom, or an unsubstituted alkyl group having 1 to 4 carbon atoms, wherein at least one of $R_6$ and $R_7$ represents a methyl group, an ethyl group, or an isopropyl group, $R_{10}$ represents a halogen atom, a substituted or unsubstituted alkyl group having 1 to 25 carbon atoms in the alkyl moiety, a substituted or unsubstituted alkoxy group having 1 to 25 carbon atoms in the alkoxy group having 6 to 30 carbon atoms in the aryloxy moiety, and s is 0, 1, or 2.

* * * * *